US009004718B2

(12) United States Patent
Myers et al.

(10) Patent No.: US 9,004,718 B2
(45) Date of Patent: Apr. 14, 2015

(54) LED DECORATIVE ILLUMINATED TRIM SYSTEM

(71) Applicant: Belwith Products, LLC, Grandville, MI (US)

(72) Inventors: Gary L. Myers, Monee, IL (US); John D. Veleris, Northbrook, IL (US); Michael Aaron Cohen, Buffalo Grove, IL (US); Lisa Kay Koskela, Grand Rapids, MI (US); Alyssa M. Nelson, Crown Point, IN (US)

(73) Assignee: Belwith Products, LLC, Grandville, MI (US)

( * ) Notice: Subject to any disclaimer, the term of this patent is extended or adjusted under 35 U.S.C. 154(b) by 62 days.

(21) Appl. No.: 13/869,614

(22) Filed: Apr. 24, 2013

(65) Prior Publication Data

US 2013/0279160 A1 Oct. 24, 2013

Related U.S. Application Data

(60) Provisional application No. 61/637,828, filed on Apr. 24, 2012.

(51) Int. Cl.

| | |
|---|---|
| ***F21K 99/00*** | (2010.01) |
| ***F21V 19/00*** | (2006.01) |
| ***F21S 4/00*** | (2006.01) |
| *F21V 33/00* | (2006.01) |
| *F21S 2/00* | (2006.01) |
| *F21V 17/10* | (2006.01) |

(Continued)

(52) U.S. Cl.

CPC ..... *F21K 9/50* (2013.01); *F21V 19/001* (2013.01); *F21V 33/0012* (2013.01); *F21V 33/006* (2013.01); *F21S 2/00* (2013.01); *F21S 4/008* (2013.01); *F21V 17/101* (2013.01); *F21V 17/102* (2013.01); *F21V 17/104* (2013.01); *F21V 19/003* (2013.01); *F21W 2121/00* (2013.01); *F21Y 2101/02* (2013.01)

(58) Field of Classification Search

CPC ..... F21K 99/00; F21K 9/50; F21V 19/00; F21V 19/001; F21V 17/101; F21V 17/00; F21V 17/10; F21S 2/00; F21S 4/008; F21Y 2103/00; F21Y 2103/006

See application file for complete search history.

(56) References Cited

U.S. PATENT DOCUMENTS

| | | | |
|---|---|---|---|
| D197,857 | S | 3/1964 | Harper |
| D197,858 | S | 3/1964 | Harper |

(Continued)

OTHER PUBLICATIONS

Belwith Products, LLC, "Light Integrated Trim (LIT): Modular lighting strip system," Belwith Keeler© brochure; © 2012 Belwith Products, LLC.

(Continued)

*Primary Examiner* — Bao Q Truong

(74) *Attorney, Agent, or Firm* — Leydig, Voit & Mayer, Ltd.

(57) ABSTRACT

A decorative illuminated trim system having at least one mountable base track. The base tracks include a recessed LED seat and two parallel attachment grooves. The trim system includes a cover with two rails. The cover is partially translucent and adjacent the base track such that the rails engage with the attachment grooves. The trim system has at least one LED string between the cover and the LED seat. The LED string includes LED bulbs that receive electric current from an electricity source and emit light. Some of the light emitted by the LED string passes through the cover.

16 Claims, 63 Drawing Sheets

(51) Int. Cl.
*F21W 121/00* (2006.01)
*F21Y 101/02* (2006.01)

(56) References Cited

U.S. PATENT DOCUMENTS

| | | | | |
|---|---|---|---|---|
| D197,859 | S | 3/1964 | Harper | |
| 3,215,039 | A | 11/1965 | Gill, Jr. | |
| D209,075 | S | 10/1967 | Wellhofer | |
| D246,203 | S | 10/1977 | Harris | |
| D384,757 | S | 10/1997 | Sun | |
| D384,758 | S | 10/1997 | Sun | |
| 5,898,814 | A | 4/1999 | Yamamoto | |
| D437,962 | S | 2/2001 | Thomas, Jr. | |
| D459,014 | S | 6/2002 | Chen | |
| D468,480 | S | 1/2003 | Schuyler | |
| 6,637,924 | B2 | 10/2003 | Pelka et al. | |
| D515,715 | S | 2/2006 | Egawa | |
| D552,566 | S | 10/2007 | Moriyama | |
| D579,599 | S | 10/2008 | Salatto-Rose | |
| 7,578,596 | B2 | 8/2009 | Martin | |
| D613,445 | S | 4/2010 | Beghelli | |
| 7,832,918 | B2 * | 11/2010 | Chien | 362/641 |
| D670,429 | S | 11/2012 | Myers et al. | |
| D670,430 | S | 11/2012 | Myers et al. | |
| D670,431 | S | 11/2012 | Myers et al. | |
| 8,534,864 | B2 * | 9/2013 | Forteza et al. | 362/223 |
| 2006/0146531 | A1 * | 7/2006 | Reo et al. | 362/244 |
| 2007/0291420 | A1 * | 12/2007 | Chen | 360/324 |
| 2011/0075416 | A1 * | 3/2011 | Chou et al. | 362/235 |
| 2011/0141722 | A1 * | 6/2011 | Acampora et al. | 362/218 |

OTHER PUBLICATIONS

United States Patent and Trademark Office, non-final Office Action issued in related U.S. Appl. No. 29/418,916 on Jul. 12, 2013.
United States Patent and Trademark Office, non-final Office Action issued in related U.S. Appl. No. 29/418,918 on Jul. 12, 2013.
U.S. Appl. No. 29/418,916, filed Apr. 23, 2012, Myers et al.
U.S. Appl. No. 29/418,918, filed Apr. 23, 2012, Myers et al.
U.S. Appl. No. 29/423,808, filed Jun. 5, 2012, Myers et al.
U.S. Appl. No. 29/423,811, filed Jun. 5, 2012, Myers et al.
U.S. Appl. No. 29/423,814, filed Jun. 5, 2012, Myers et al.
United States Patent and Trademark Office, non-final Office Action issued in related U.S. Appl. No. 29/423,808 on Jul. 12, 2013.
United States Patent and Trademark Office, non-final Office Action issued in related U.S. Appl. No. 29/423,811 on Jul. 12, 2013.
United States Patent and Trademark Office, non-final Office Action issued in related U.S. Appl. No. 29/418,914 on Jul. 12, 2013.

* cited by examiner

LED DECORATIVE ILLUMINATED TRIM SYSTEM

CROSS-REFERENCE TO RELATED APPLICATIONS

This patent application claims the benefit of U.S. Provisional Patent Application No. 61/637,828 filed Apr. 24, 2012.

BACKGROUND

The present disclosure relates to elongated light sources, specifically, to light sources mountable to various surfaces in usable in various configurations.

In almost any inhabited space, it is desirable to provide lighting for various purposes. In some instances, it is particularly desirable to provide lighting that illuminates an area while adding a decorative element to the space or, alternatively, does not take away from existing decorative features. Additionally, traditional light fixtures tend to be at least quasi-permanent in nature and require lighting sockets or other electrical hardware precisely installed in the mounting surface to function. In order to add traditional lighting fixtures to a space, substantial construction is often required to tap into current electrical sources, or even to run electrical wiring to a lighting fixture's intended location. The result is a relatively inflexible lighting construction that requires precise planning to install and is not easily modified.

SUMMARY

In one aspect, the disclosure relates to a decorative illuminated trim system having at least one elongate base track mountable to a support surface. The base tracks include a recessed light emitting diode (LED) seat and two substantially parallel attachment grooves. The decorative illuminated trim system also includes a cover with two rails. The cover is at least partially translucent and disposed adjacent the base track such that the rails engage with the attachment grooves. The decorative illuminated trim system also has at least one LED string disposed between the cover and the LED seat. The LED string includes at least one LED bulb capable of receiving electric current from an electricity source and emitting light. At least some of the light emitted by the LED string passes through the cover.

In another aspect, the disclosure describes a method of assembling a decorative illuminated trim system. The method includes providing at least one elongate base track mountable to a support surface. The base track includes a recessed LED seat and two substantially parallel attachment grooves. The method also includes providing at least one cover that has two rails and is at least partially translucent. The method includes installing the cover over the base track such that the rails engage with the attachment grooves. The method also includes installing at least one LED string between the cover and the LED seat, wherein the LED string includes at least one LED bulb capable of receiving electric current from an electricity source and emitting light. At least some light emitted by the LED string passes through the cover.

In yet another aspect, the disclosure describes a decorative illuminated trim system. The decorative illuminated trim system includes at least one elongate base track mountable to a support surface. The base track includes a recessed LED seat and two substantially parallel attachment grooves. The decorative illuminated trim system includes at least one cover that has two rails and is at least partially translucent. The cover is disposed adjacent the base track such that the rails engage with the attachment grooves. The decorative illuminated trim system includes at least one LED string disposed between the cover and the LED seat. The LED string includes at least one LED bulb capable of receiving electric current from an electricity source and emitting light. At least some light emitted by the LED string passes through the cover. The decorative illuminated trim system also includes a decorative element disposed over the cover. The decorative element includes at least one window that allows some light emitted by the LED string to pass through, and at least one opaque area that does not allow light emitted by the LED string to pass through. The decorative illuminated trim system also includes at least one jacket substantially surrounding the LED string. The jacket is at least partially translucent and allows at least some light emitted by the LED string to pass through the jacket.

DETAILED DESCRIPTION

Figure 1:
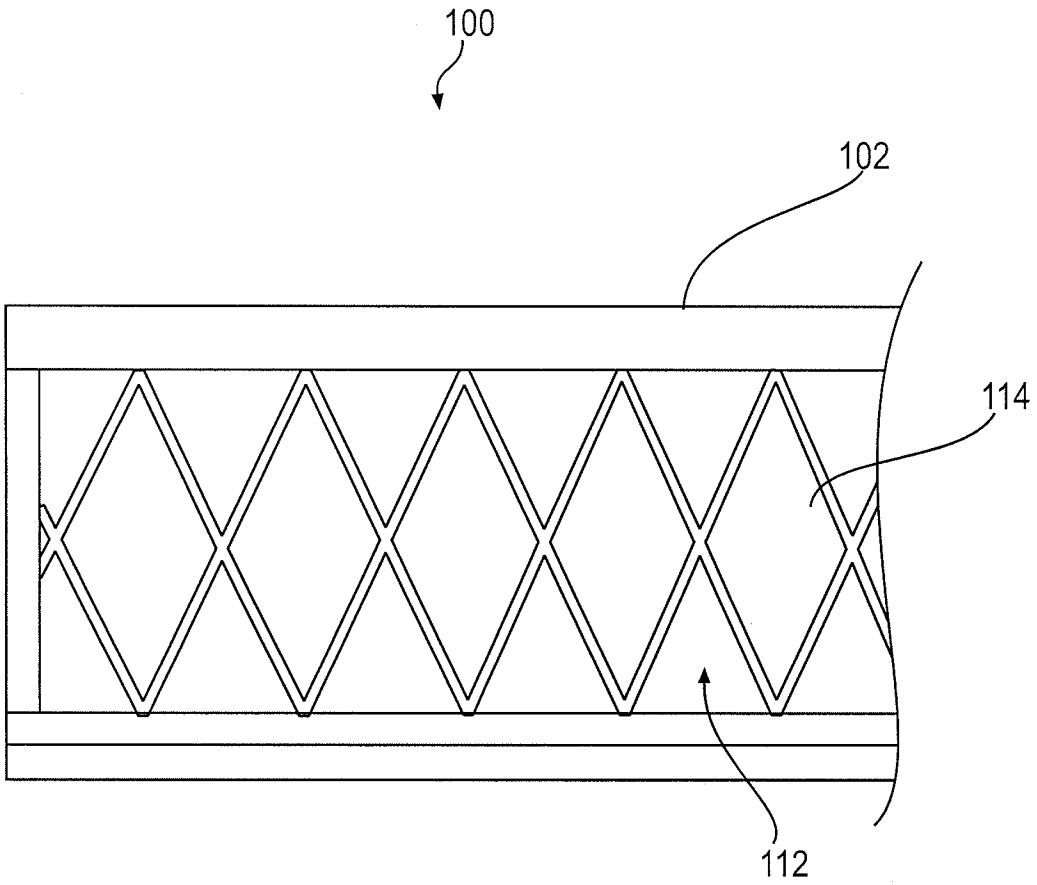
FIG. 1 is a front elevational view of a LED decorative illuminating trim system.
Figure 2:
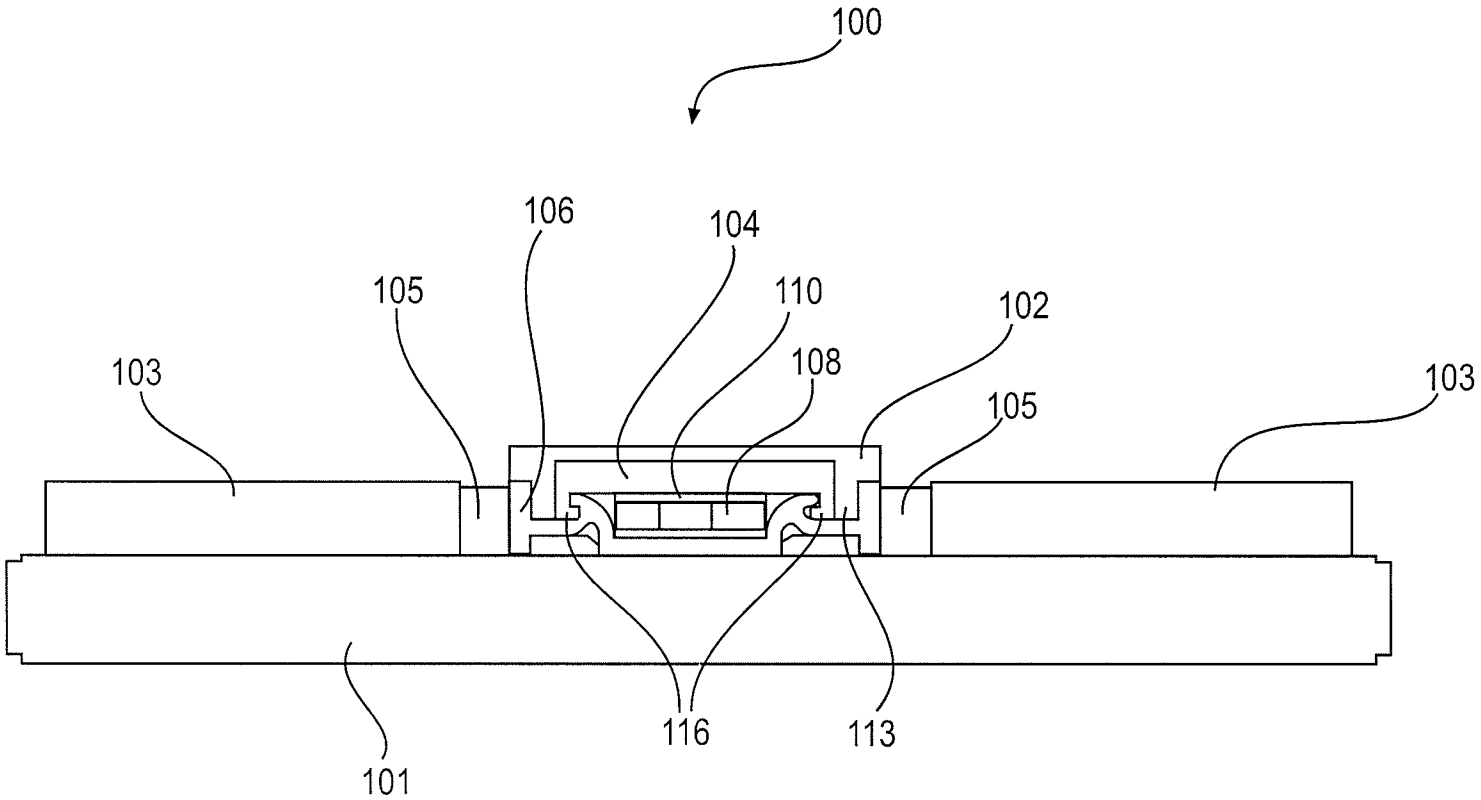
FIG. 2 is a side sectional view of the LED decorative illuminated trim system of FIG. 1 mounted to a wall.

With reference to the figures, wherein like reference numbers and like shown features represent like features, a LED decorative illuminated trim system is described herein. Referring to FIGS. 1 and 2 the LED decorative illuminated trim system 100 can include a decorative element 102, a cover 104, a base track 106, a LED string 108, and a jacket 110. In some embodiments, the base track 106 and cover 104 can attach to one another to enclose a LED string 108. The LED string 108 can be capable of receiving electric current from any electricity source, such as an electrical socket, a battery, or a hard-wired electrical source. The LED string can include at least one LED bulb 109 capable of receiving electric current from an electricity source and emitting light. The decorative element 102 can fit over the cover 104. In other embodiments, the decorative element 102 can attach to the base track 106 and enclose the LED string 108 without a separate cover.

Figure 3:
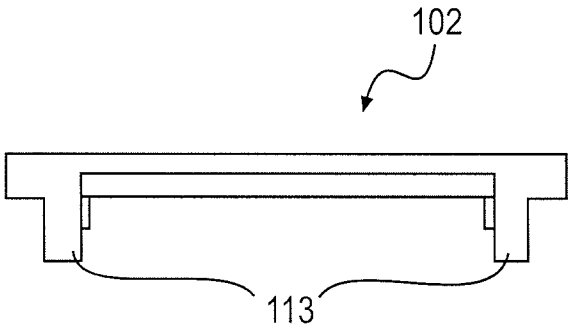
FIG. 3 is a side elevational view of a decorative element.

Referring to FIG. 3, a decorative element 102 can have any suitable decorative features and windows 112 in any of a variety of shapes and patterns. FIG. 1 shows an embodiment of a decorative element 102, however, it will be appreciated that the decorative element can have any suitable patterns and/or shape. The windows 112 can either be holes in a decorative element 102, or can be transparent or translucent sections within the decorative element. In some embodiments, the windowed areas 112 can be disposed such that the windowed areas are located where there is no LED bulb 109 directly disposed behind the windowed area. Thus, the LED bulbs 109 can be hidden by opaque areas 114 of the decorative element 102 to conceal discrete bright spots from the LED bulbs in the LED string 108. The decorative element 102 embodiment illustrated in FIG. 3 has substantially parallel protrusions 113. The protrusions 113 can be adapted to fit around the cover 104 and abut the alignment track 122. The decorative element 102 can be secured to the base track 106 in any suitable manner, such as by friction fit, snapping, sliding, and/or adhesive. It is contemplated that the decorative element 102 can be easily removed and replaced with another decorative element individually without requiring additional deconstruction of the LED decorative illuminated trim system.

Figure 4:
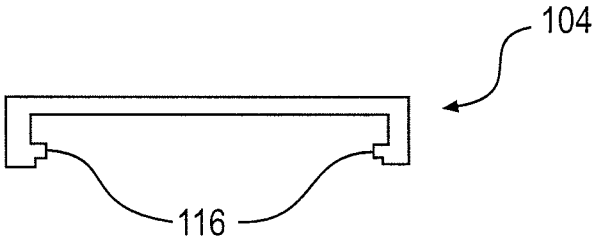
FIG. 4 is a side elevational view of a cover.

Referring to FIG. 4, the cover 104 can have two rails 116 that extend along at least a portion of the length of the cover 104. The rails 116 can be dimensioned and made of a material such that they can flex and snap fit to the base track 106. Alternatively, the rails 116 can be dimensioned to slide onto the base track 106. The cover 104 can be made of a transparent or translucent material to permit light to pass therethrough, such as light emitted from the LED string 108. The cover 104 can also be suitably textured to help diffuse the light from the LED string 108 in a desired manner. For example, the cover 104 can include a plurality of ridges to diffuse the light from the LED string 108 across the cover.

Figure 5:
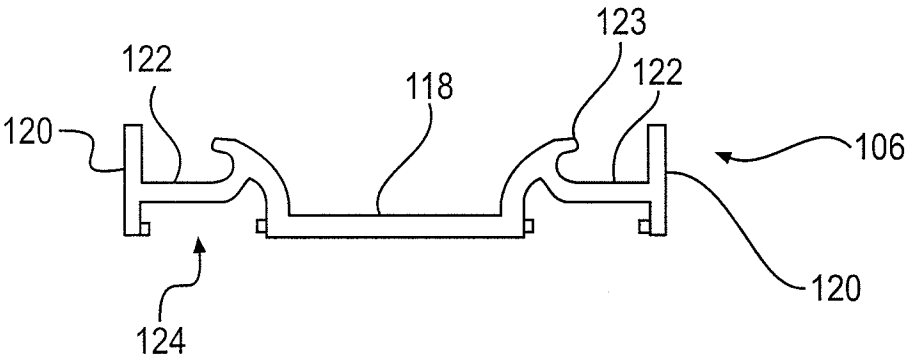
FIG. 5 is a side elevational view of a base track.
Figure 6:
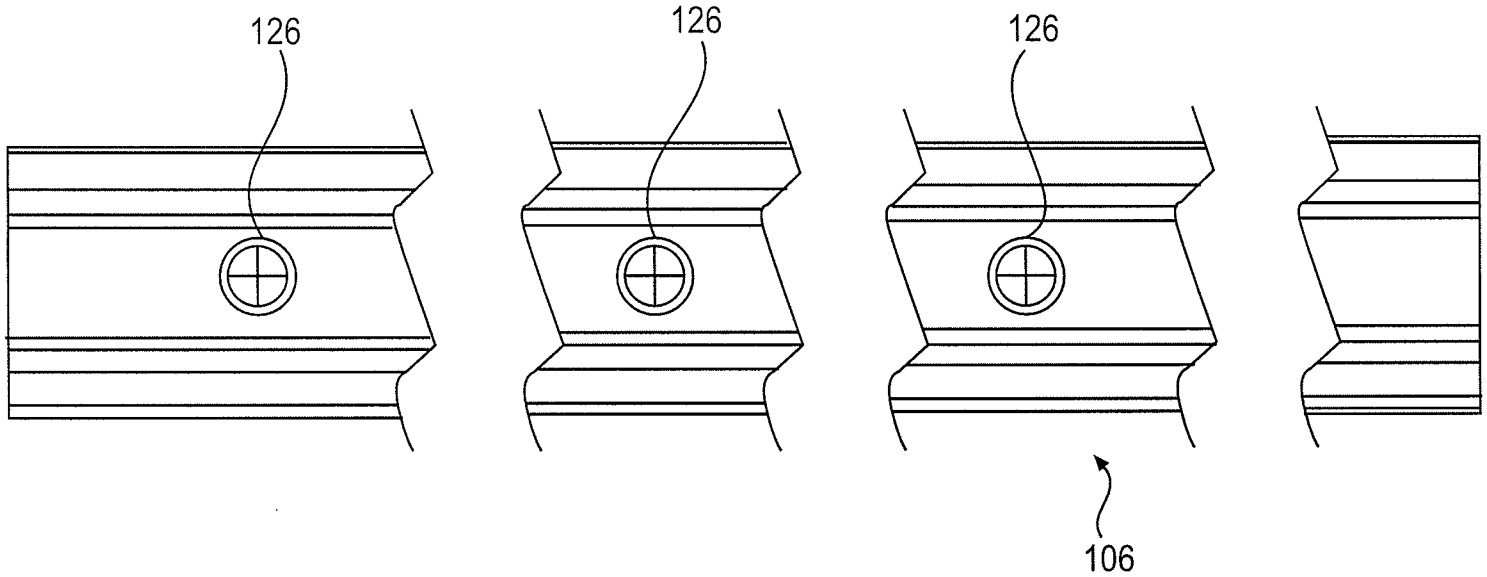
FIG. 6 is a fragmentary front elevational view of the base track of FIG. 5.
Figure 7:
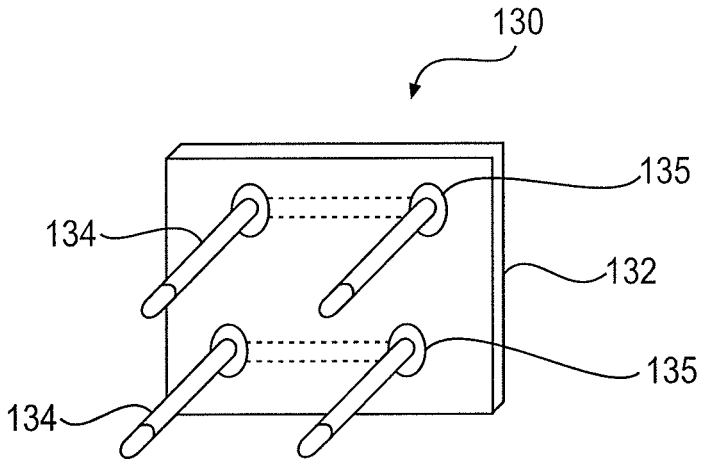
FIG. 7 is a perspective view of a connector base.
Figure 8:
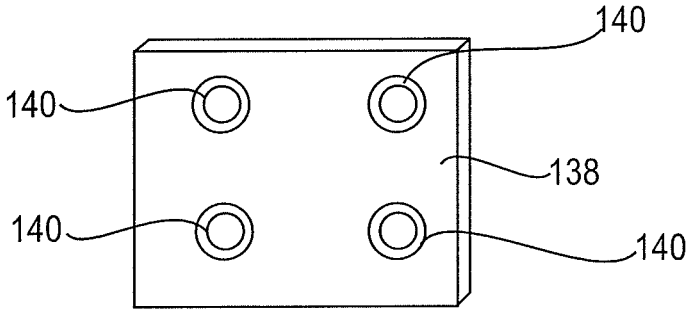
FIG. 8 is a perspective view of a connector plate.
Figure 9:
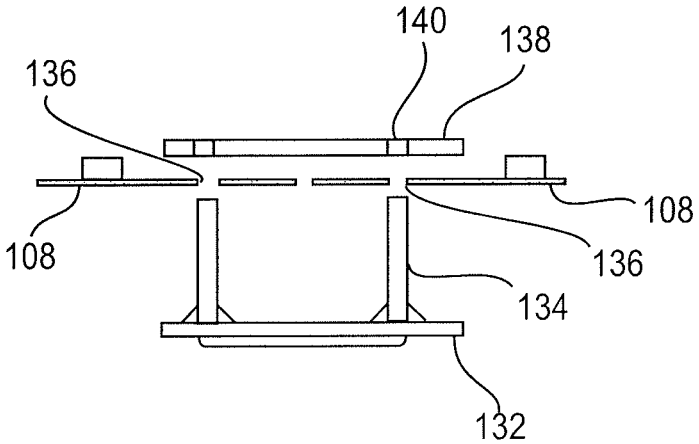
FIG. 9 is an exploded sectional view of the connector base of FIG. 7, the connector plate of FIG. 8, and two adjacent sections of LED string.
Figure 37:
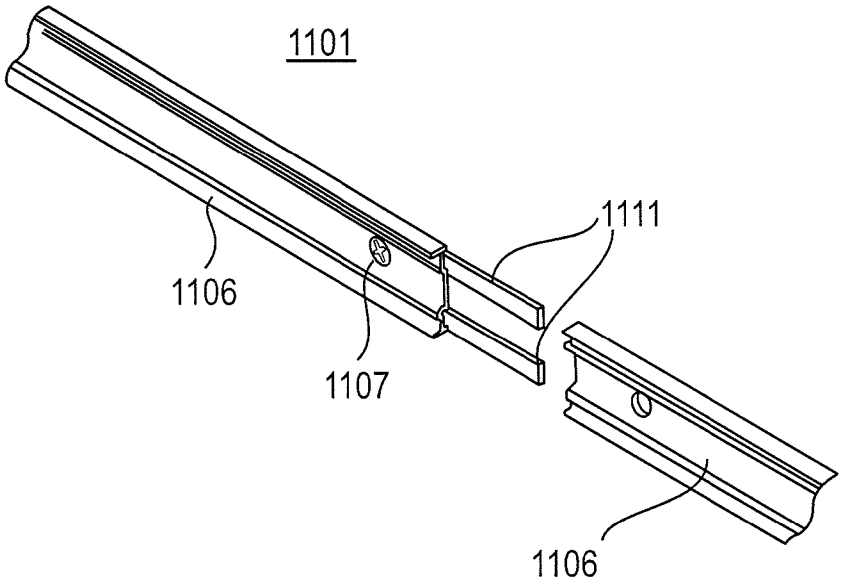
Figure 36:
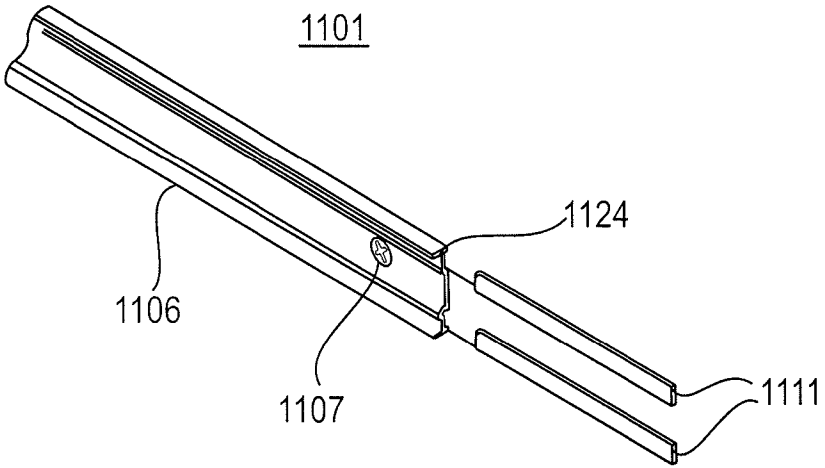

Referring to FIG. 5, the base track 106 serves as a mounting structure for the LED string 108. The base track 106 can include a recessed LED seat 118, base track ends 120, attachment grooves 122, and alignment tracks 124. The LED seat 118 can be any suitable shape and size to receive an LED string 108. The recessed LED seat 118 can be reflective or non-reflective. The base track 106 can be mounted to any of a variety of support surfaces, such as the wall 101 as shown in FIG. 2. As shown, the base track 106 can be mounted between tiles 103, such as can be disposed as part of a backsplash in a kitchen. The base track ends 120 can abut an adjacent surface on a wall. For example, as shown in FIG. 2, the base track ends 120 can abut grout 105 disposed between the base track 106 and tile 103, and the base track ends can be sized to prevent grout or sealant from overflowing into the base track attachment grooves 122. The alignment tracks 124 can be configured to receive an alignment connector 111 (such as shown in FIGS. 36 and 37). The attachment grooves 122 can be formed with a peak 123 to permit a pliable material, such as a cover 104, to flex over and snap into place in the attachment grooves. In some embodiments, such as the embodiment illustrated in FIG. 2, the rails 116 of the cover 104 can engage with the base track 106 in the attachment grooves 122, and the protrusions 113 of the decorative element 102 can fit into the attachment grooves 122 between the base track ends 120 and the rails 116. The base track 106 can also have countersunk holes 126 disposed in the recessed LED seat (as shown in FIG. 6), which can be used to attach the base track to a surface, such as a wall 101, using fasteners.

Figure 10:
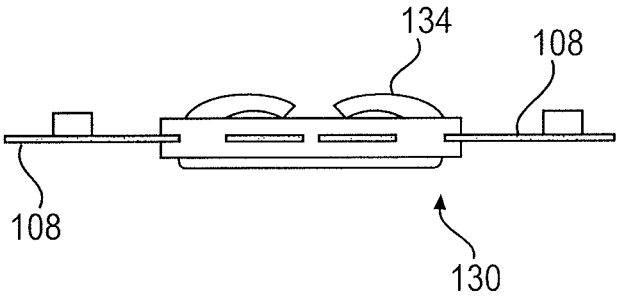
FIG. 10 is a sectional view of the connector base of FIG. 7 connected to the connector plate of FIG. 8 and two adjacent sections of LED string.

It will be appreciated that the LED decorative illuminated trim system 100 can have any suitable shape and size. The system can include a suitable structure for electrically connecting adjacent LED strings 108. As disclosed, substantially any number of additional adjacent LED strings 108 can be connected to one another and receive electric current to power LED bulbs 109 from a single electrical source or multiple electrical sources. Referring to FIGS. 7-16, connector elements 130 can be used to connect adjacent LED strings 108 together at any of a variety of angles. For example, the connector element 130 can include wires 134 that can be disposed on a connector board 132 for electrically connecting two LED strings 108 in a straight line. The wires 134 can pass through holes 135 in the connector board 132. To make the connection, two holes 136 in each of the adjacent LED strings 108 can be lined up with two holes 135 on a connector board 132. The holes 136 in the LED strings 108 are formed in a conductive material 137 in electronic connection to the LED bulbs in the string such that electric current can run between the LED bulbs and the conductive material. The adjacent LED string 108 can also be aligned with another two holes 135 of the connector board 132. The wires 134 of the connector board 132 can pass through the four holes 136 in the two sections of LED strings 108 and then into corresponding holes 140 in a connecter plate 138. The wires 134 can be crimped, such as shown in FIG. 10, to provide a secure electrical and physical connection from the conductive material 137 in one LED string 108 to the conductive material in the next LED string. Electricity can then run through the first LED string 108, through the conductive material 137 forming the holes 136 in the LED string, through the wires 134 that pass through the holes and contact the conductive material, and into the adjacent LED string via its conductive material. It will be appreciated that the connector elements 130 can have any suitable shape and size with any suitable configuration for electrically connecting adjacent LED strings 108.

Figure 12:
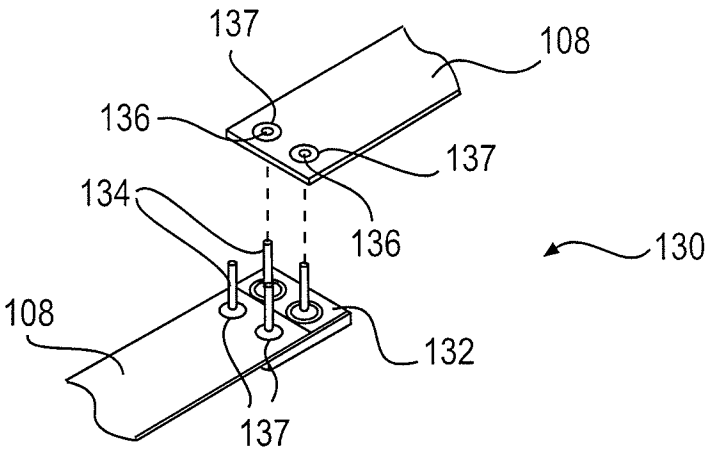
FIGS. 11-16 show an embodiment of a process for connecting adjacent LED strings using connector elements.
Figure 11:
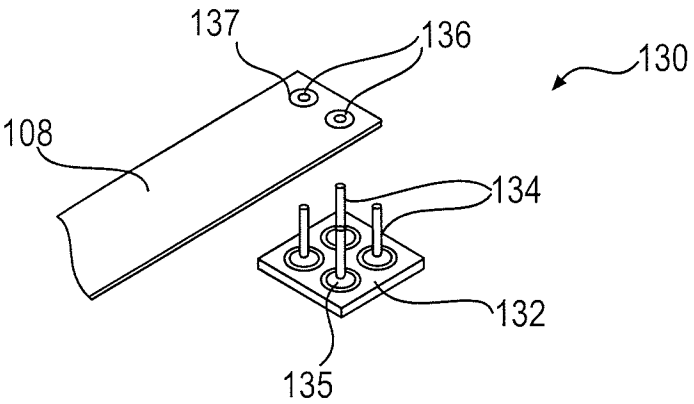
Figure 14:
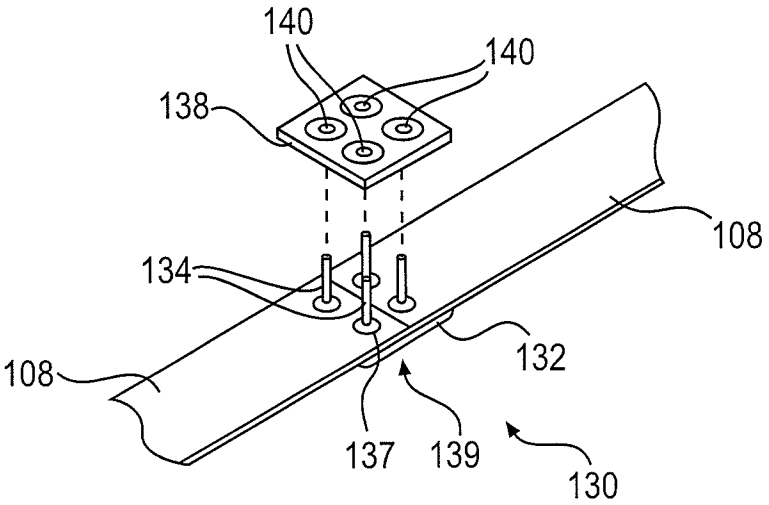
Figure 13:
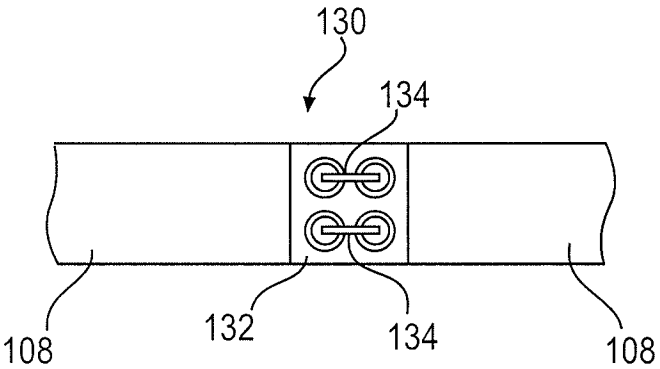
Figure 16:
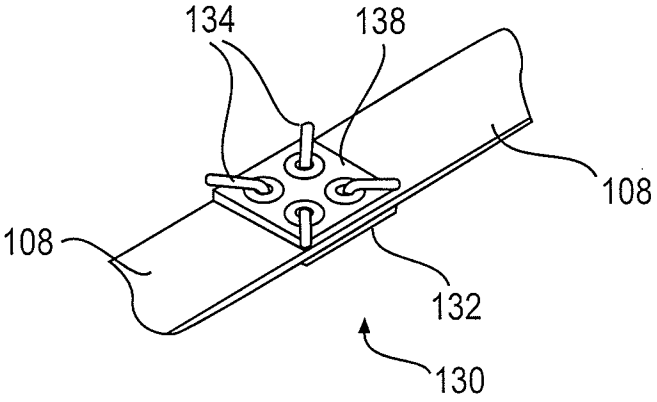
Figure 15:
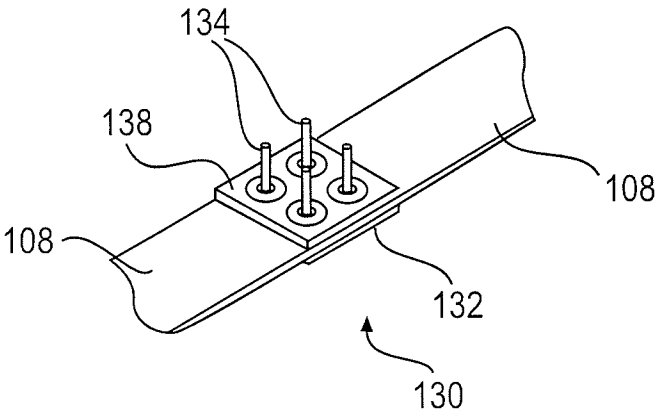
Figure 17:
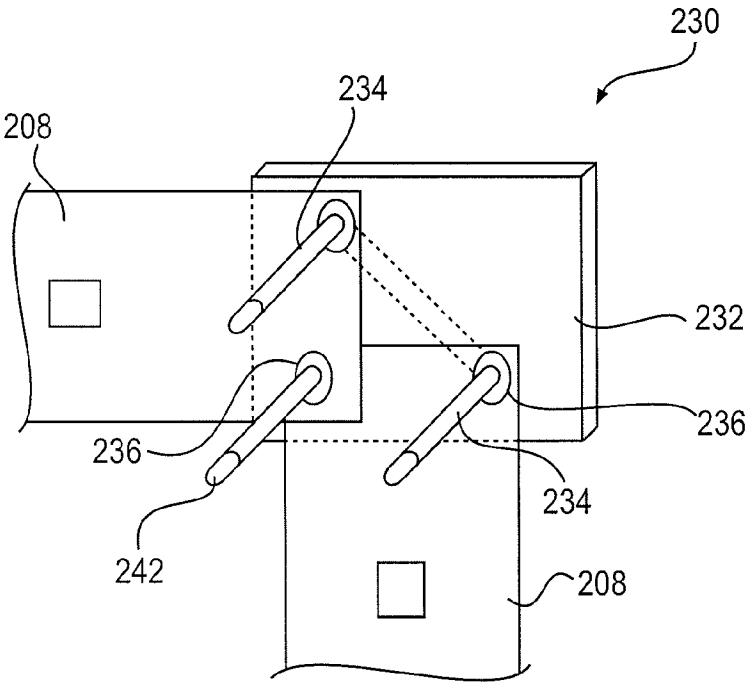
FIG. 17 is a perspective view of a connector base connected to a connector plate and two perpendicularly disposed sections of a LED string.

FIGS. 11-16 show a process for connecting adjacent LED strings 108 together. FIG. 11 shows the LED string 108 fitting onto one end of each of two wires 134 from the connector board 132 through holes 136 formed in the LED string. FIG. 12 shows a second LED string 108 fitting onto the opposite ends of the two wires 134. The two wires 134 can pass through the holes 135 in the connector board 132 and through holes 136 in the second LED string 108 such that the two LED strings abut one another adjacent the connector board. FIG. 13 shows two LED strings 108 connected to one another through a connector board 132, with wires 134 serving to secure a physical and electrical connection between the two LED strings. In this embodiment, the two wires 134 contact the conductive material 137 that forms the holes 136 in each LED string 108, and provide an electrical connection between the adjacent LED strings. FIG. 14 shows the connector plate 138 fitting over the wires 134 through holes 140 in the connector plate and the connector board 132 bridging a junction 139 of the two adjacent LED strings 108. FIG. 15 shows the connector plate 138 in position over the junction between adjacent LED strings 108 with wires 134 from the connector board 132 through the holes 140. FIG. 16 shows the connector elements 130 fully installed connecting adjacent LED strings 108. The wires 134 can bend against the connector plate 138 to secure the adjacent LED strings between the connector plate and the connector board 132. In some embodiments, the holes 135 in the connector board and the connector plate are each formed by conductive material. When the wires 134 are crimped against the connector plate 138, an electronic connection is made through the stacked respective conductive material of the connector plate, the LED string 108, and the connector board 132. The wires 134, therefore, can provide an electronic connection between adjacent LED strings 108.

FIGS. 17-23 show an angled connector element 230 for connecting two LED strings 208 disposed at an angle, such as 90 degrees. The angled connector element 230 can consist of a wire 234 and/or a pin 242 attached to a connector board 232. The pin 242 can line up with one hole 236 in each of the adjacent LED strings 108, and each end of the wire 234 can connect to the other holes 236 in the LED strings to make an electrical connection between the two. A connector plate 238 can be provided and the pin 242 and wire 234 can be crimped similar to the connector element 130 in FIG. 10 to provide an electrical and physical connection between adjacent sections.

Figure 19:
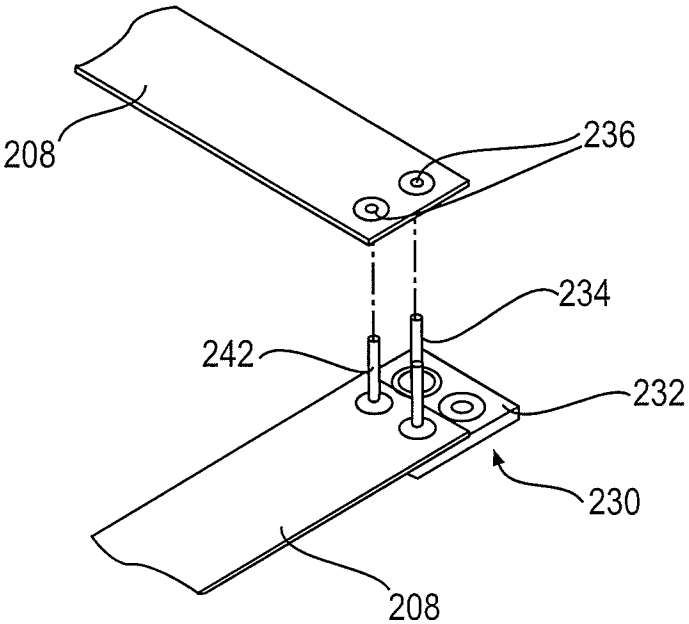
FIGS. 18-23 show another embodiment of a process for connecting adjacent LED strings using connector elements.
Figure 18:
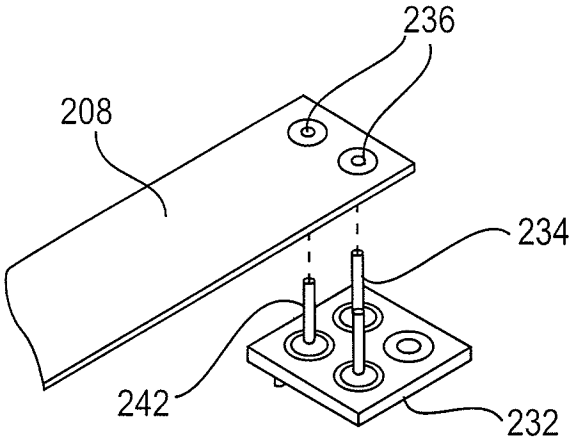
Figure 21:
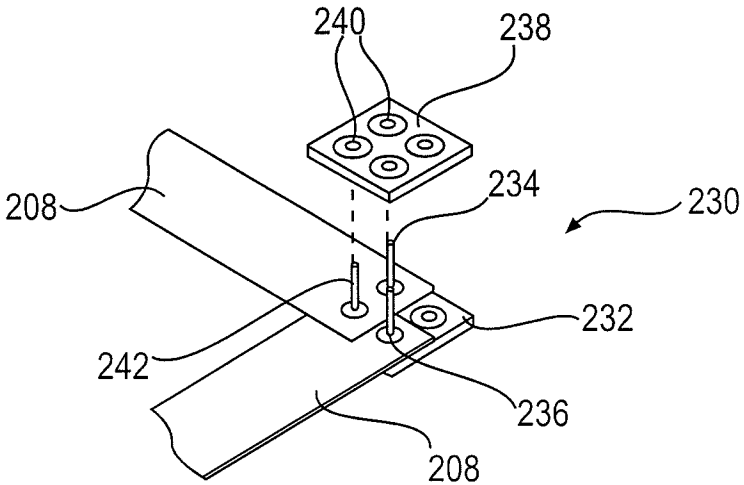
Figure 20:
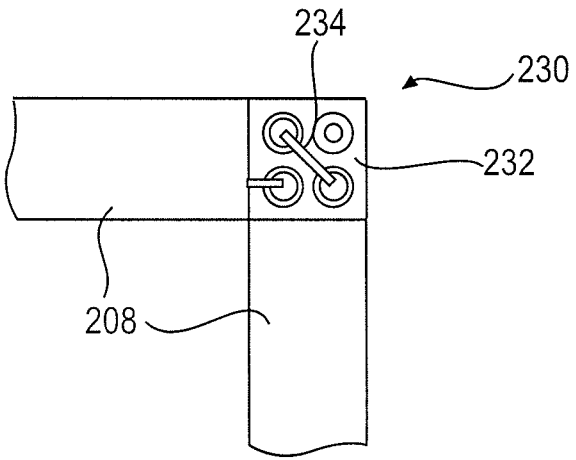
Figure 23:
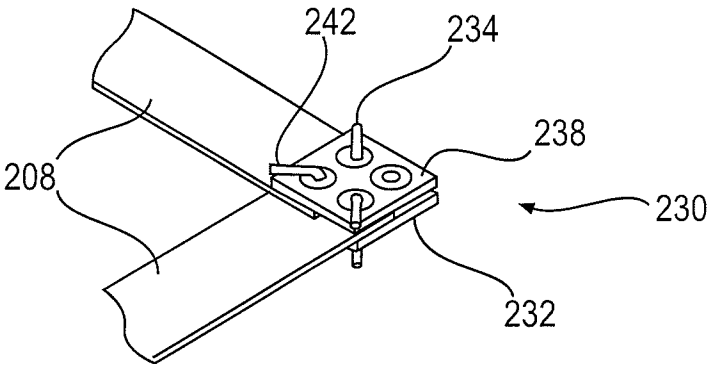
Figure 22:
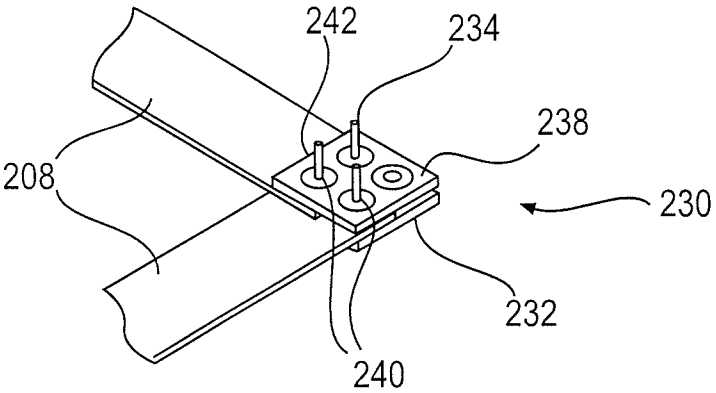

FIGS. 18-23 show a process for connecting two adjacent LED strings 208 at an angle, such as a 90 degree angle. FIG. 18 shows an LED string 208 fitting onto a wire 234 and a pin 242 from a connector board 232 through holes 236 in the LED string. FIG. 19 shows a second LED string 208 with holes 236 fitting onto an additional wire 234 from the connector board 232 and the pin 242 from the connector board such that the two LED strings 208 are aligned at an angle to one another. In this embodiment, at least one hole 236 from each LED string 208 fits over the pin 242 such that a portion of each LED string overlap one another. FIG. 20 shows the two LED strings 208 connected to one another at a substantially 90 degree angle through the connector board 232, with wires 234 serving to secure a physical and electrical connection between the two LED strings and the pin serving to secure a physical connection. FIG. 21 shows a connector plate 238 fitting over the wires 234 and the pin 242 through holes 240 in the connector plate. FIG. 22 shows the connector plate 238 in position at the junction between adjacent LED strings 208 with wires 234 and the pin 242 from the connector board 232 through the holes 240 in the connector plate. FIG. 23 shows the connector elements 230 fully installed connecting adjacent LED strings 208. The wires 234 can bend against the connector plate 238 to secure the adjacent LED strings between the connector plate and the connector board 232. The wires 234 also provide an electronic connection between adjacent LED strings 208.

FIGS. 7-23 also illustrate how the decorative illuminated trim system disclosed herein can be implemented as a modular system that is flexible in length and design depending on what is required for a particular application. If additional lengths of decorative illuminated trim are required, adjacent lengths of LED string can be linked together as shown to provide flexibility in installation and application.

Figure 24:
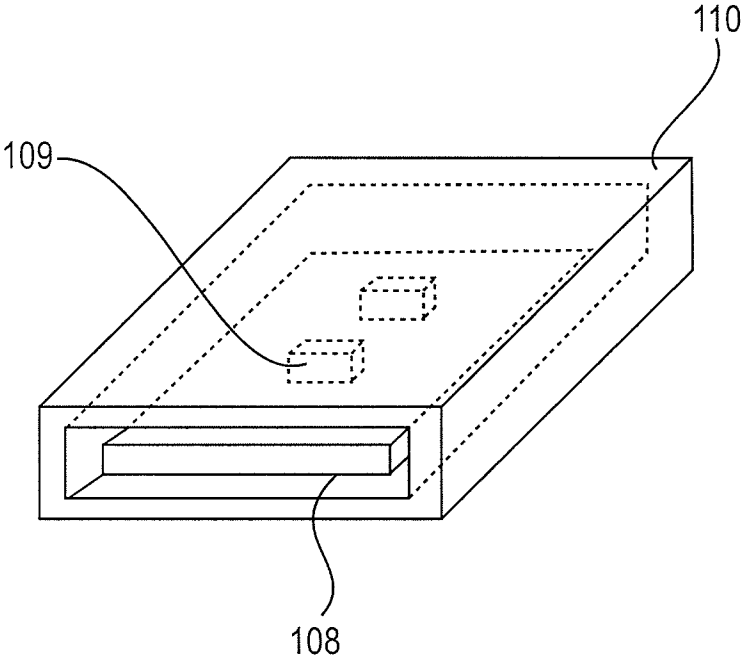
FIG. 24 is a perspective view of an embodiment of a jacket covering a LED string.

FIG. 24 shows portion of an LED string 108 surrounded by a translucent jacket 110 which can be made from a suitable material, such as silicone. The jacket 110 can be smooth or can have grooves, such as co-linear grooves, to diffuse the light from the LED string 108. The jacket 110 can cover the entire length of the LED string 108 or only a portion of the length of the LED string 108. To prevent water infiltration, the ends of the jacket 110 can be sealed using an elastic sealant, such as silicone. It will be appreciated that the jacket 110 can be made of any suitable material.

Figure 25:
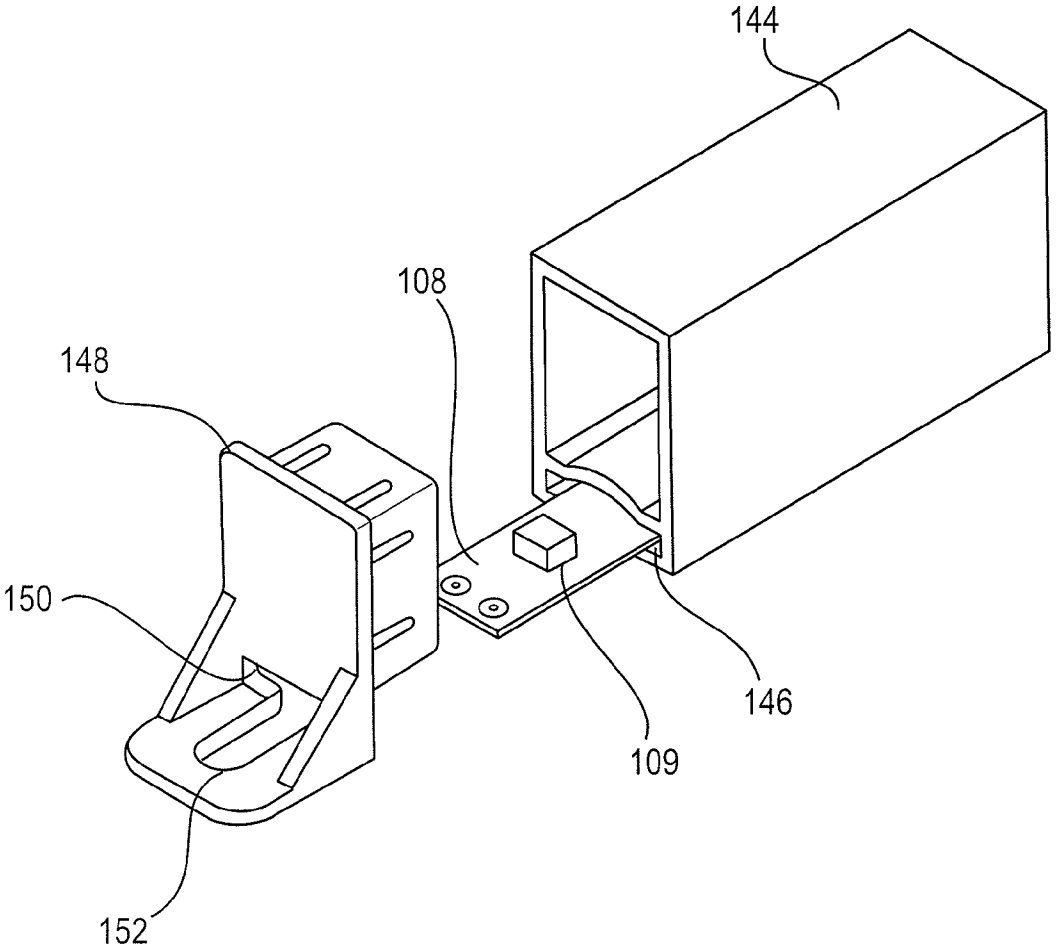
FIG. 25 is a perspective view of a utility housing for an LED string.
Figure 27:
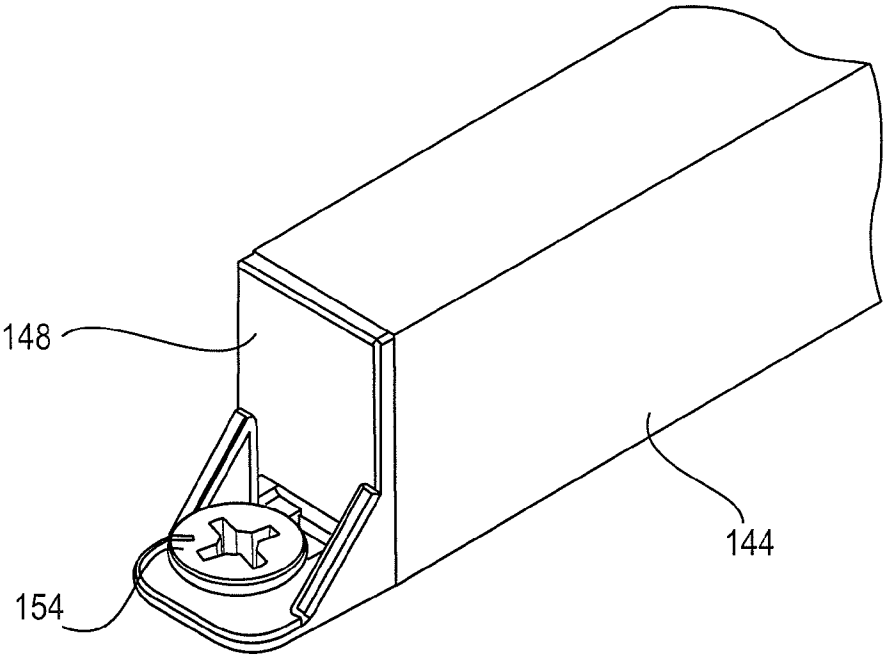
FIGS. 26-27 show an embodiment of a process for fastening the housing of FIG. 25 to a support structure in accordance with the disclosure.
Figure 26:
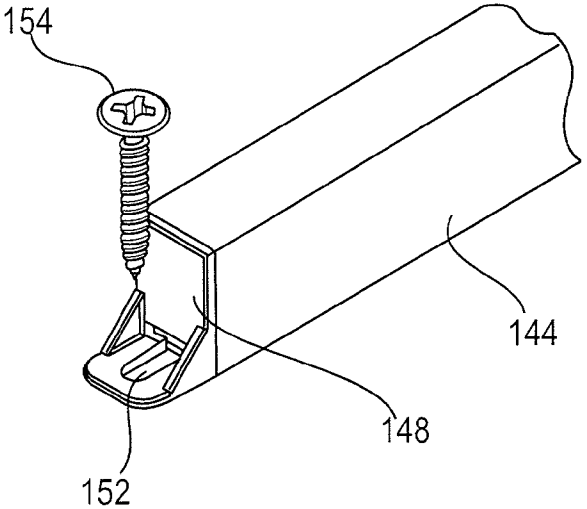

FIG. 25 shows a utility housing 144 for an LED string 108. As shown, the LED string 108 can be disposed in a channel 146, and the housing 144 can be transparent or translucent to provide light transmission therethrough. The housing 144 could also be opaque to in embodiments where the utility housing is used to break up the lighting between lighted trim sections. The housing 144 can be tubular and can include an end cap 148. The end cap 148 can fit within the tubular housing 144 and can include a slot 150 for the LED string 108 to pass therethrough for connection to a power supply or adjacent LED string. The end cap 144 can also include a mounting slot 152 for receiving a suitable fastener 154 for attaching the housing to a structure such as a wall as shown in FIGS. 26 and 27.

Figure 28:
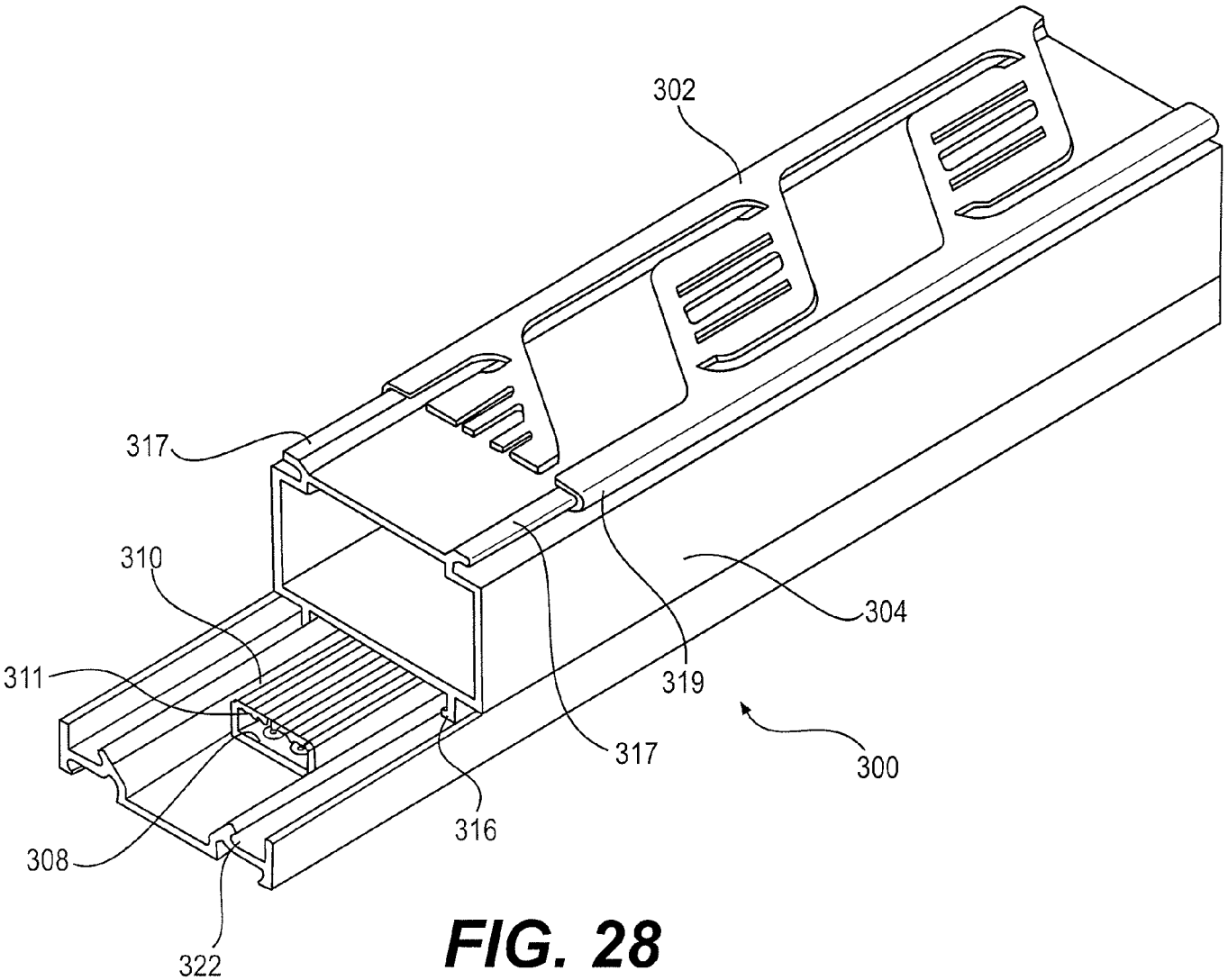
FIG. 28 shows a perspective view of an embodiment of a LED decorative illuminated trim system with a tubular cover.

FIG. 28 shows an embodiment of a LED decorative illuminated trim system 300 where the base track 306 receives an LED string 308 with a jacket 310. As shown, the jacket 310 can include a plurality of ridges 311 for dispersing light from the LED string 308. A cover 304 can attach to the base track attachment grooves 322 such as by snap fitting or sliding such that rails 316 engage the attachment grooves. The cover can have ribs 317 protruding from the cover that are adapted to engage with tracks 319 of a decorative element 302. The tracks 319 can snap fit or slidingly engage the ribs 317. The decorative element 302 can be opaque. The cover 304 can be transparent or translucent to permit light to pass therethrough. The cover 304 can be tubular.

Figure 29:
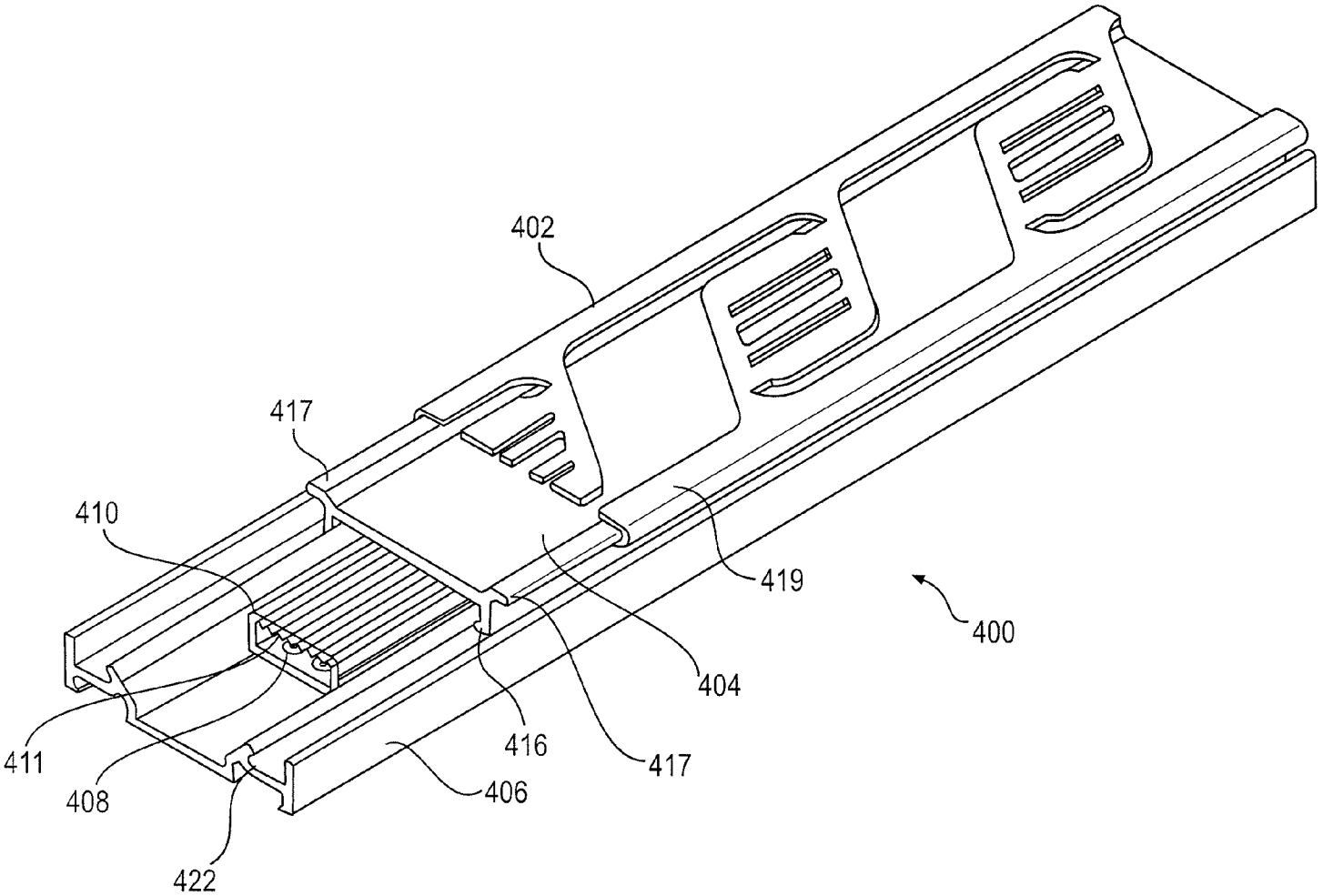
FIG. 29 shows a perspective view of another embodiment of a LED decorative illuminated trim system.

FIG. 29 shows another embodiment of a LED decorative illuminated trim system 400 where the base track 406 receives an LED string 408 with a jacket 410. As shown, the jacket 410 can include a plurality of ridges 411 for dispersing light from the LED string 408. A cover 404 can attach to the base track attachment grooves 422 such as by snap fitting or sliding such that rails 416 engage the attachment grooves. The cover can have ribs 417 protruding from the cover that are adapted to engage with tracks 419 of a decorative element 402. The tracks 419 can snap fit or slidingly engage the ribs 417. The decorative element 402 can be opaque. The cover 404 can be transparent or translucent to permit light to pass therethrough.

Figure 30:
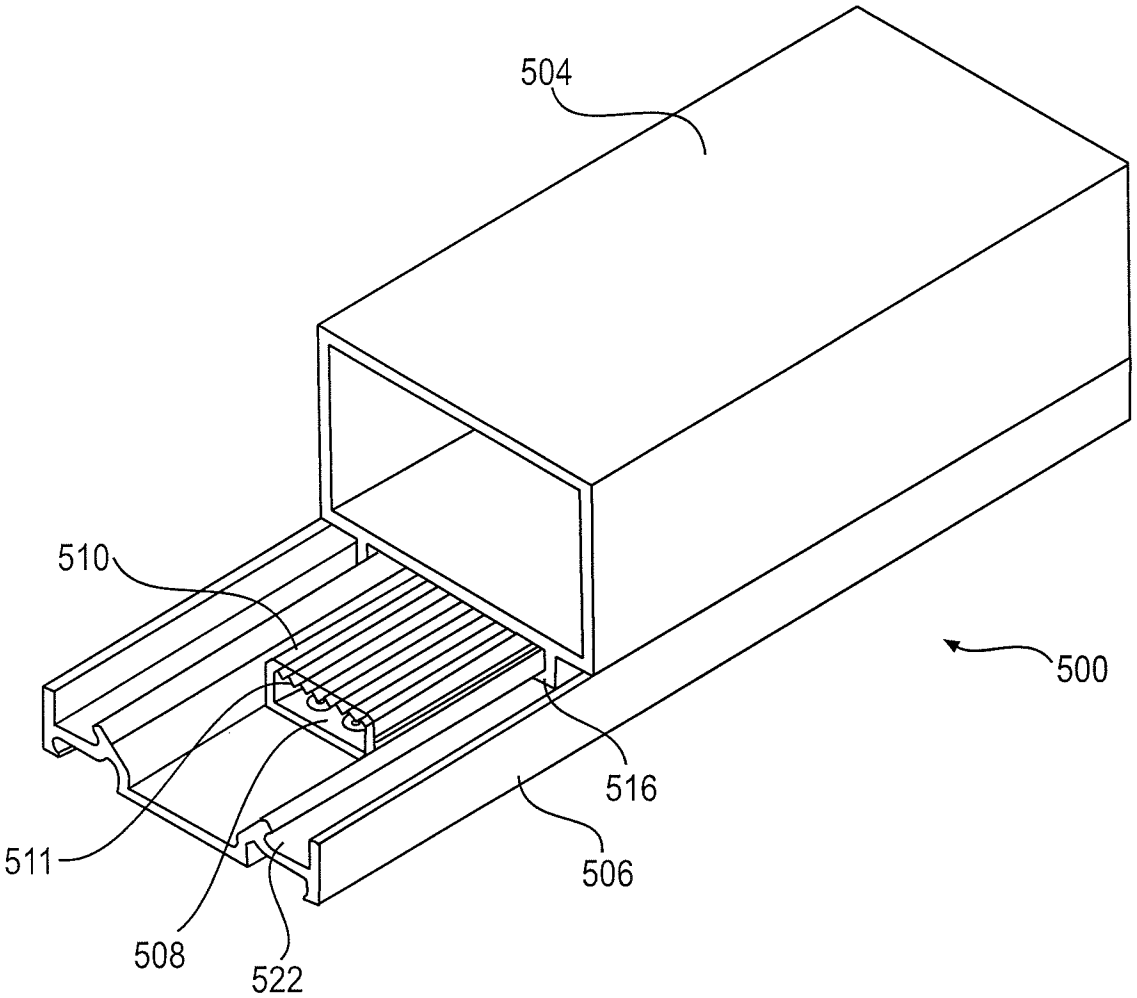
FIG. 30 shows a perspective view of an embodiment of a LED decorative illuminated trim system with a tubular cover and no decorative element.
Figure 31:
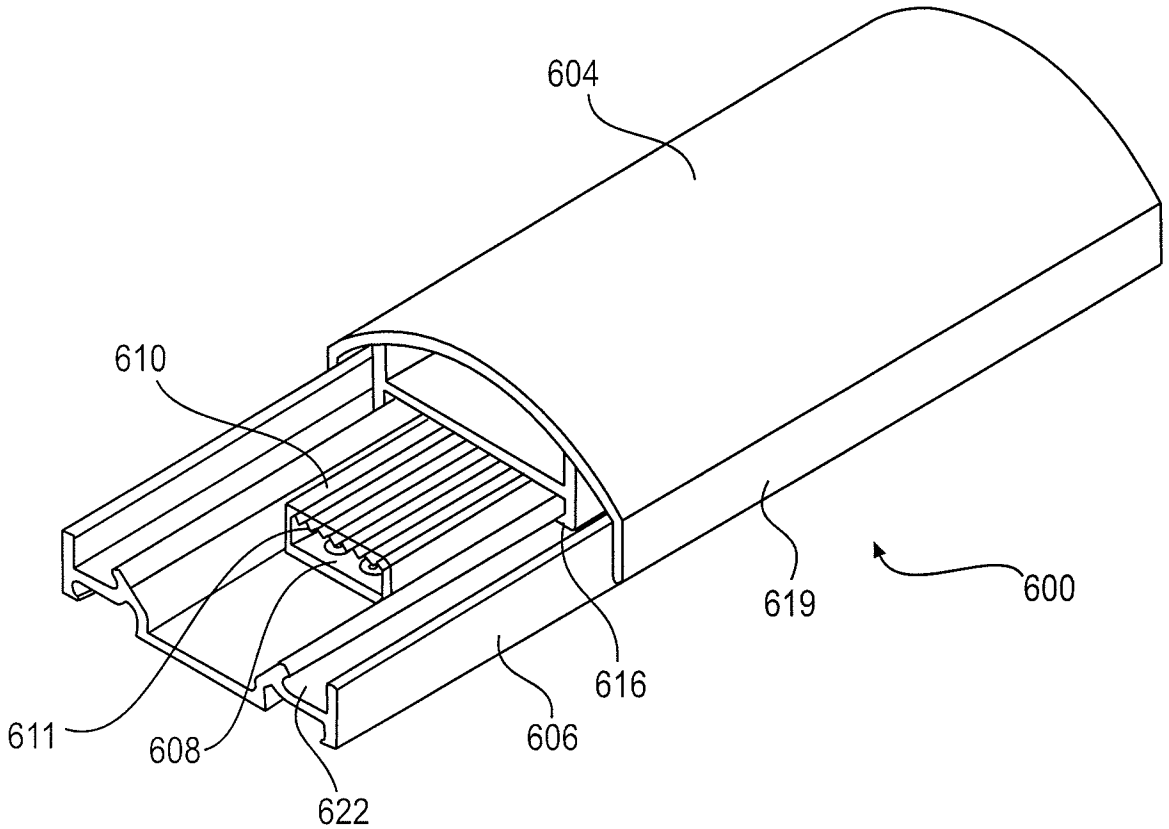
FIG. 31 shows a perspective view of another embodiment of a LED decorative illuminated trim system without a decorative element.

FIGS. 30 and 31 show additional embodiments of LED decorative illuminated trim systems 500, 600 where the base track 506, 606 receives an LED string 508, 608 with a jacket 510, 610. As shown, the jacket 510, 610 can include a plurality of ridges 511, 611 for dispersing light from the LED string 508, 608. A cover 504, 604 can attach to the base track attachment grooves 522, 622 such as by snap fitting or sliding such that rails 516, 616 engage the attachment grooves. In such embodiments, the cover 502, 602 may not attach to a decorative element. It will be appreciated that the cover 502, 602 can provide the decorative aspects of the system. For example, FIG. 30 shows a rectangular tubular cover 502. The embodiment in FIG. 31 shows a cover 602 having a curved exterior surface. In FIG. 31, the cover 604 includes tracks 619 that engage the base track 606.

Figure 32:
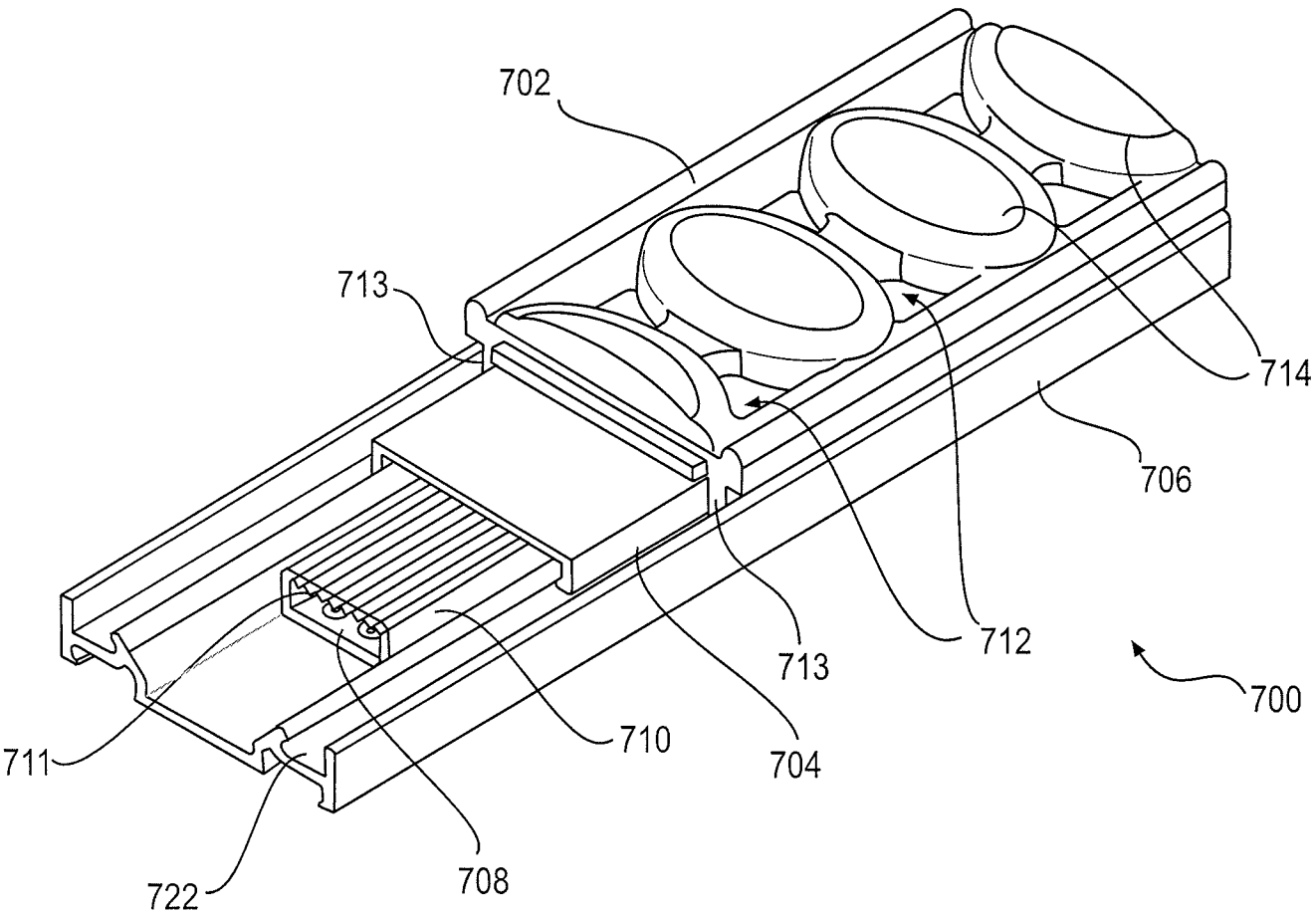
FIG. 32 shows a perspective view of another embodiment of a LED decorative illuminated trim system.

FIG. 32 shows another embodiment of a LED decorative illuminated trim system 700 where the base track 706 receives an LED string 708 with a jacket 710. As shown, the jacket 710 can include a plurality of ridges 711 for dispersing light from the LED string 708. A cover 704 can attach to the base track attachment grooves 722 such as by snap fitting or sliding such that rails 716 engage the attachment grooves. The decorative element 702 can have protrusions 713 that engage with the attachment grooves 722 adjacent the rails 716. The decorative element 702 can be opaque. The cover 704 can be transparent or translucent to permit light to pass therethrough. The illustrated embodiment in FIG. 32 also shows windows 712 and opaque areas 714. The windows 712 can either be holes in a decorative element 702, or can be transparent or translucent sections within the decorative element. In some embodiments, the windowed areas 712 can be disposed such that the windowed areas are located where there is no LED bulb directly disposed behind the windowed area. Thus, the LED bulbs can be hidden by opaque areas 714 of the decorative element 702 to conceal discrete bright spots from the LED bulbs in the LED string 708. The decorative element 702 can be secured to the base track 706 in any suitable manner, such as by friction fit, snapping, sliding, and/or adhesive.

Figure 33:
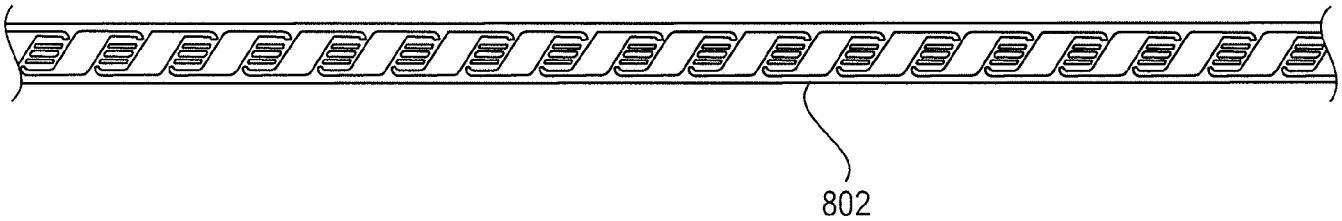
FIG. 33 shows another embodiment of a decorative element in accordance with the disclosure.
Figure 34:
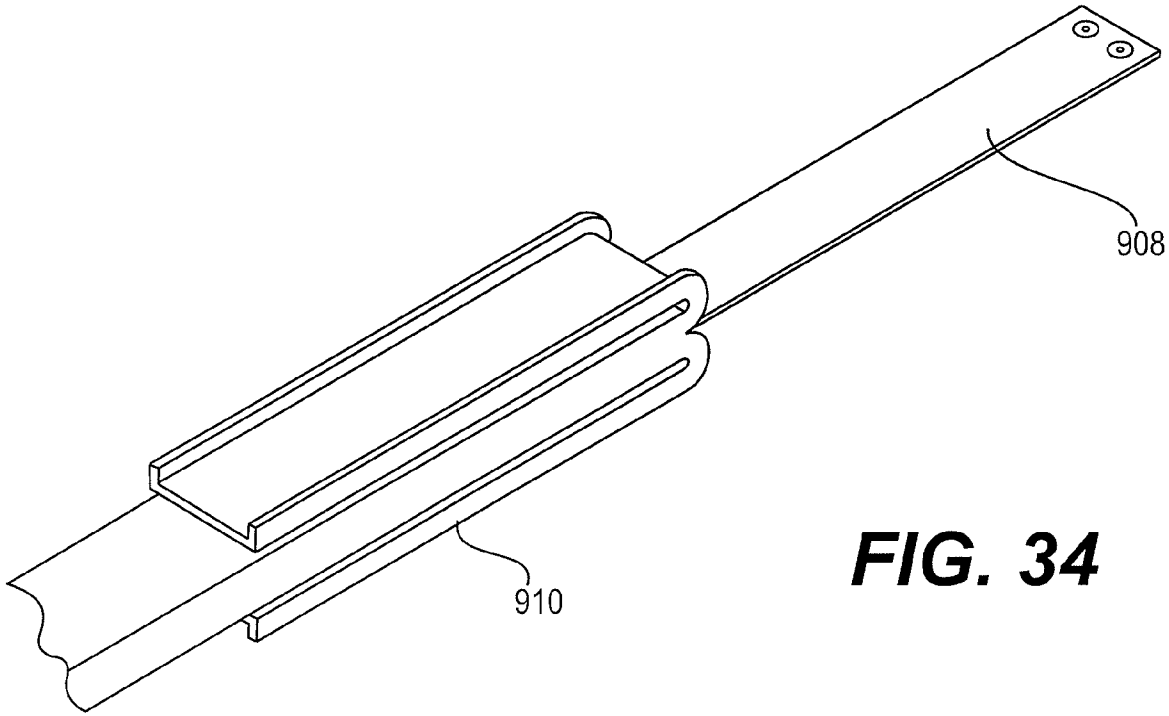
FIG. 34 shows an embodiment of a jacket peeled away from a LED string.

FIG. 33 shows another embodiment of a decorative element 802 to be used in an embodiment of a LED decorative illuminated trim system. FIG. 34 shows a sample of a jacket 910 peeled away from a LED string 908 for illustrative purposes.

Figure 35:
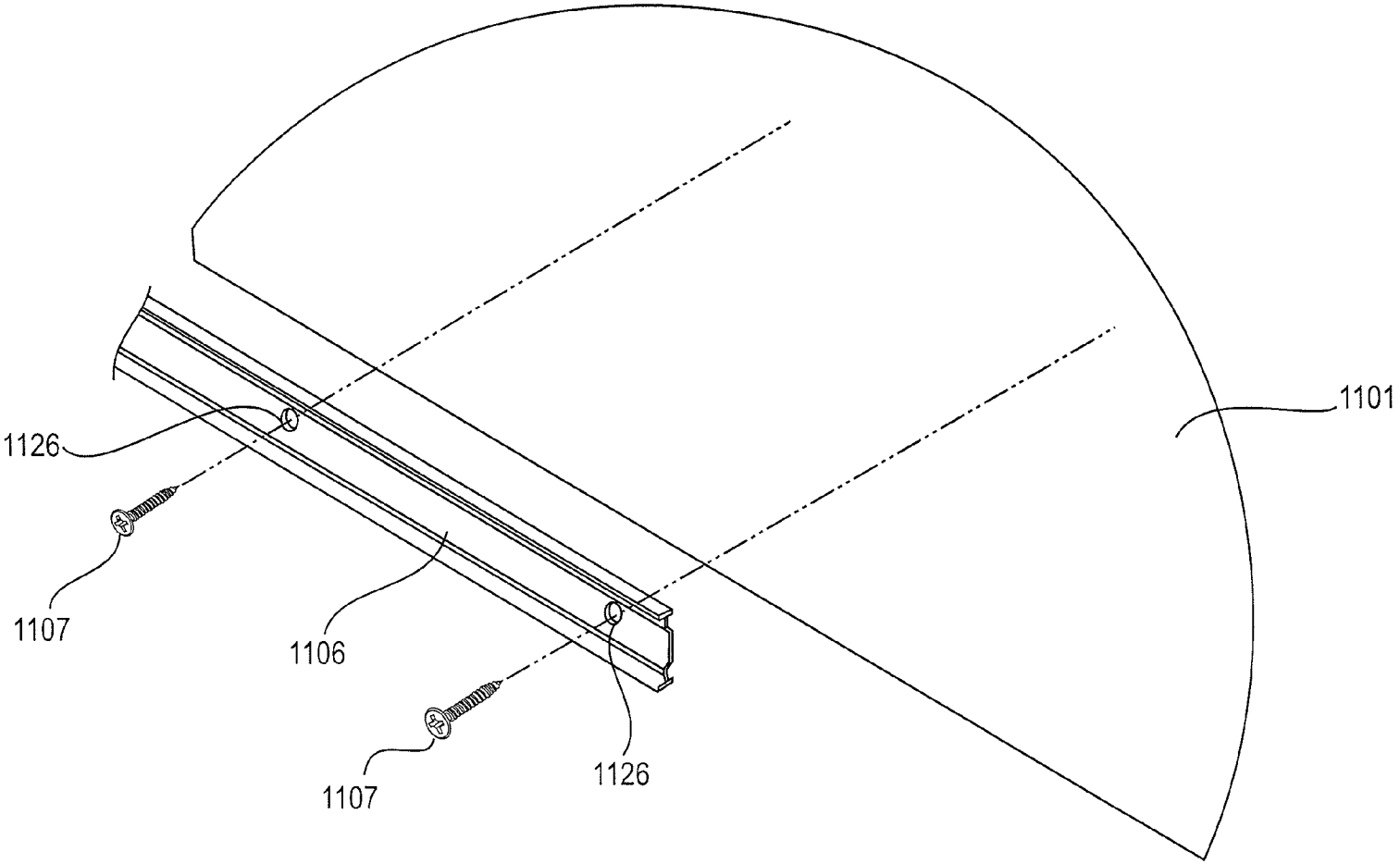
FIGS. 35-40 show an embodiment of a process for attaching co-linear base tracks to a support structure.
Figure 39:
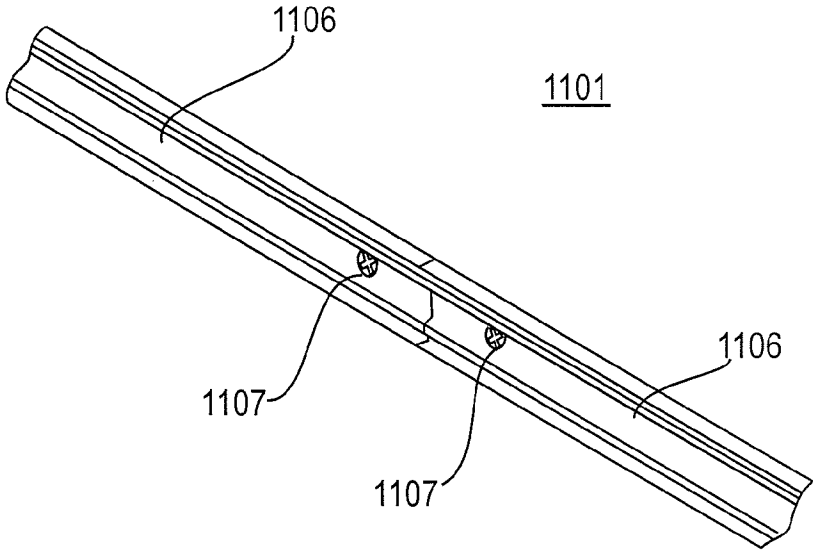
Figure 38:
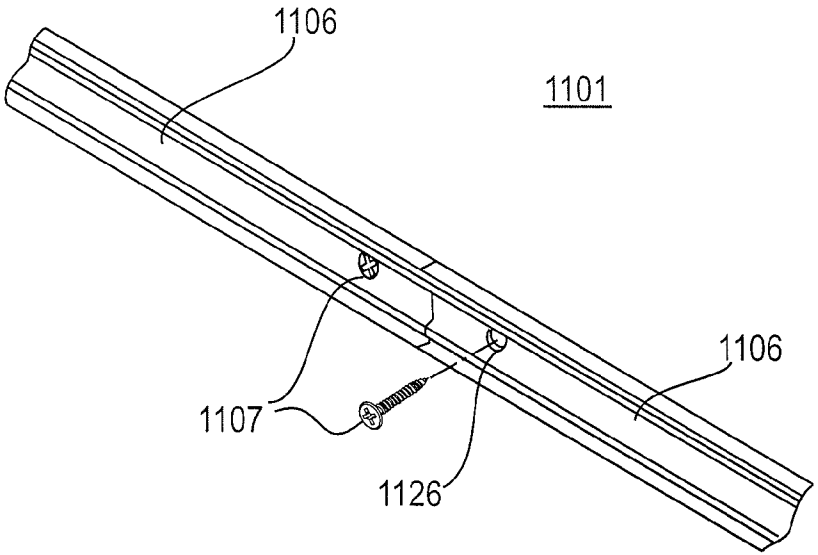
Figure 40:
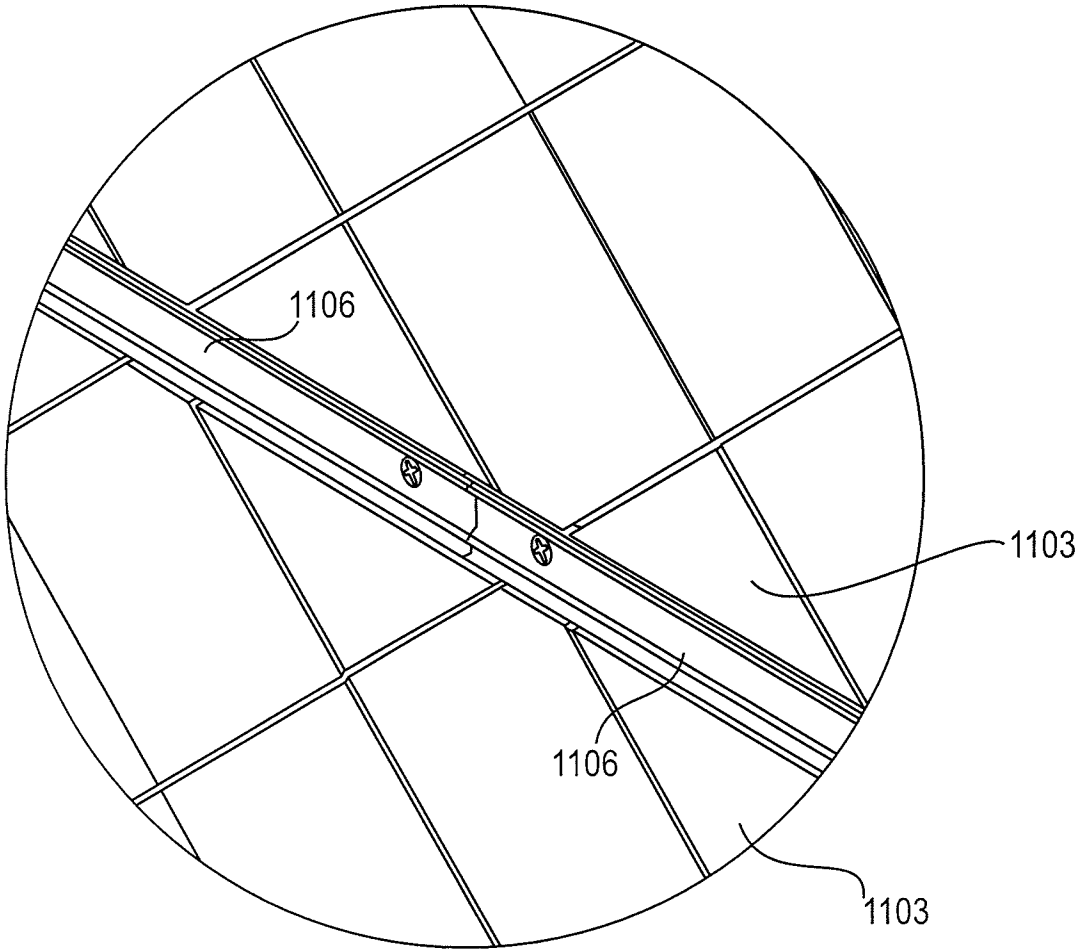

FIGS. 35-40 show an embodiment of a process attaching adjacent co-linear base tracks 1106 to a support structure, such as a wall 1101. In such a process, as illustrated in FIG. 35, a length of base track 1106 can be fastened to a wall 1101 or other support structure by fitting wall fasteners 1107 through countersunk holes 1126 in the base track 1106 and into the wall. As shown in FIG. 36, alignment connectors 1111 can fit partially into alignment tracks 1124. FIG. 37 shows alignment connectors 1111 partially inserted into the alignment tracks 1124. The free ends of the alignment connectors 1111 can then fit into the alignment tracks 1124 of an adjacent length of base track 1106. As shown in FIG. 38, the adjacent length of base track 1106 can slide over the alignment connectors 1111 and abut another length of base track. The adjacent lengths of base track 1106 are both fastened to the wall 1101 with wall fasteners 1107 through countersunk holes 1126, as shown in FIG. 39. FIG. 40 shows an embodiment with two adjacent lengths of base track 1106 mounted to a wall 1101 between tiles 1103.

Figure 41:
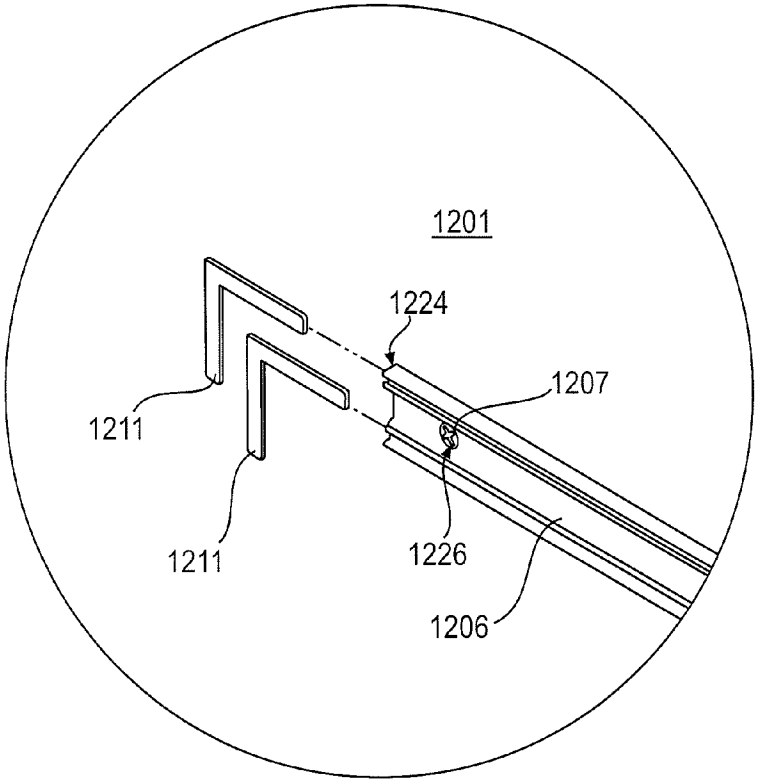
FIGS. 41-45 show an embodiment of a process for attaching adjacent base tracks to a support structure at an angle.
Figure 42:
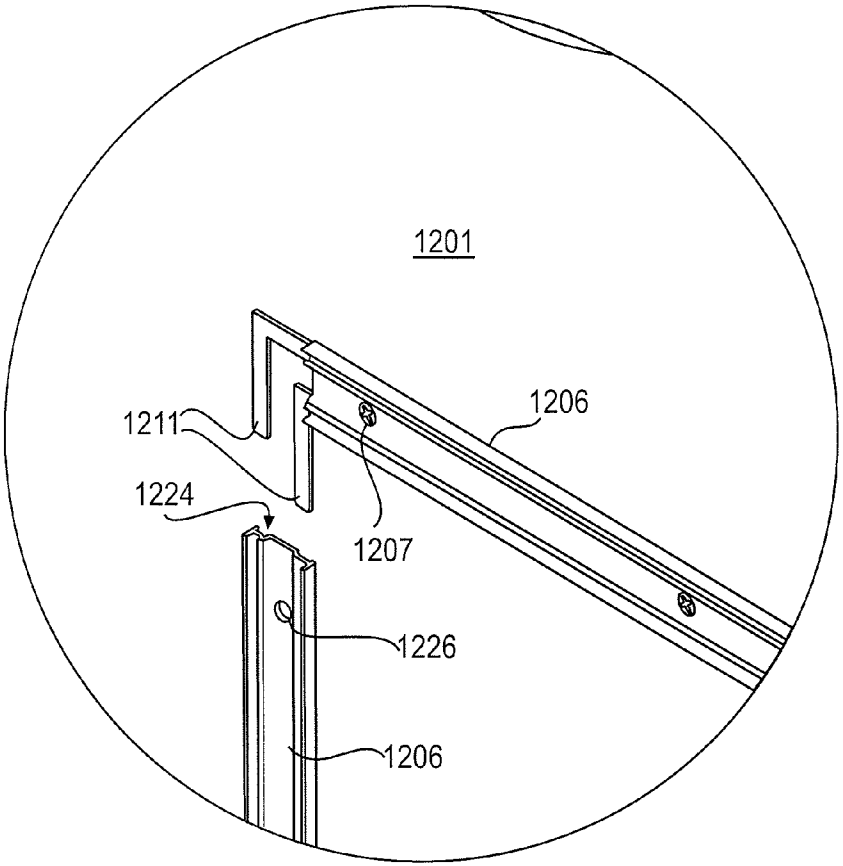
Figure 44:
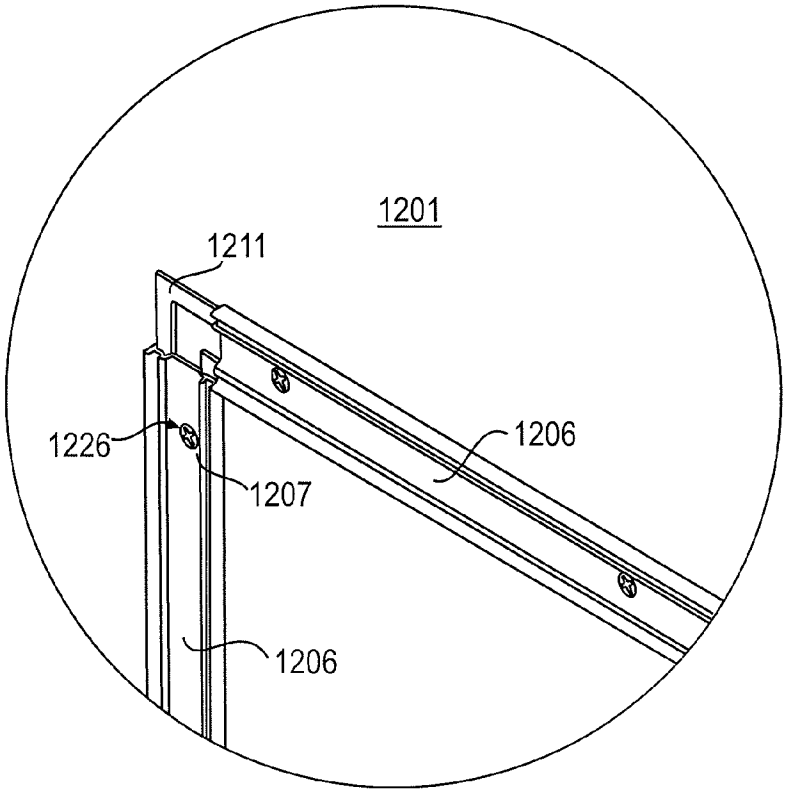
Figure 43:
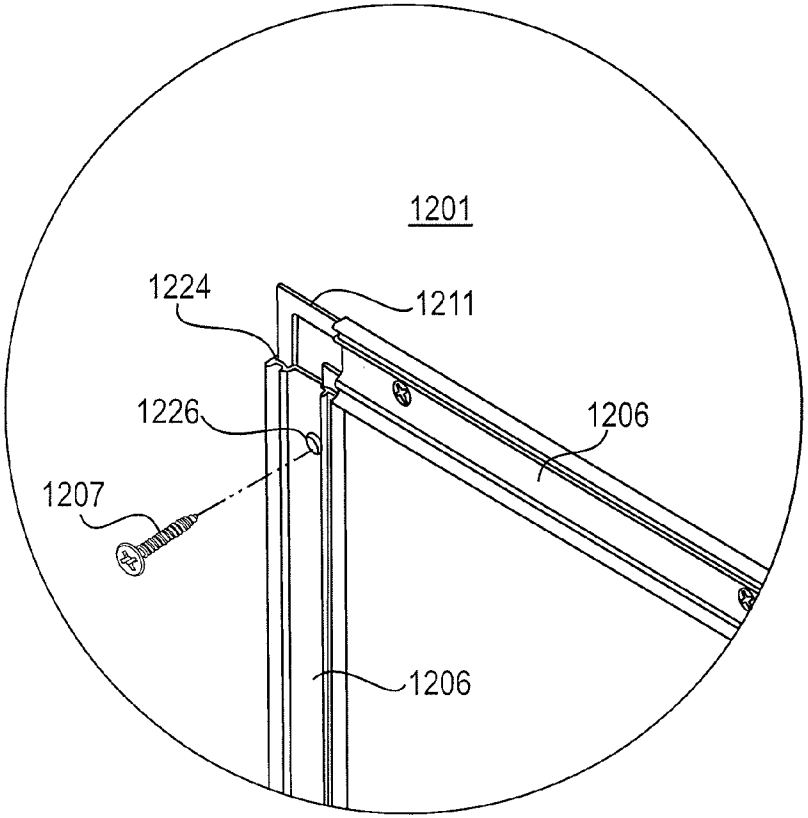
Figure 45:
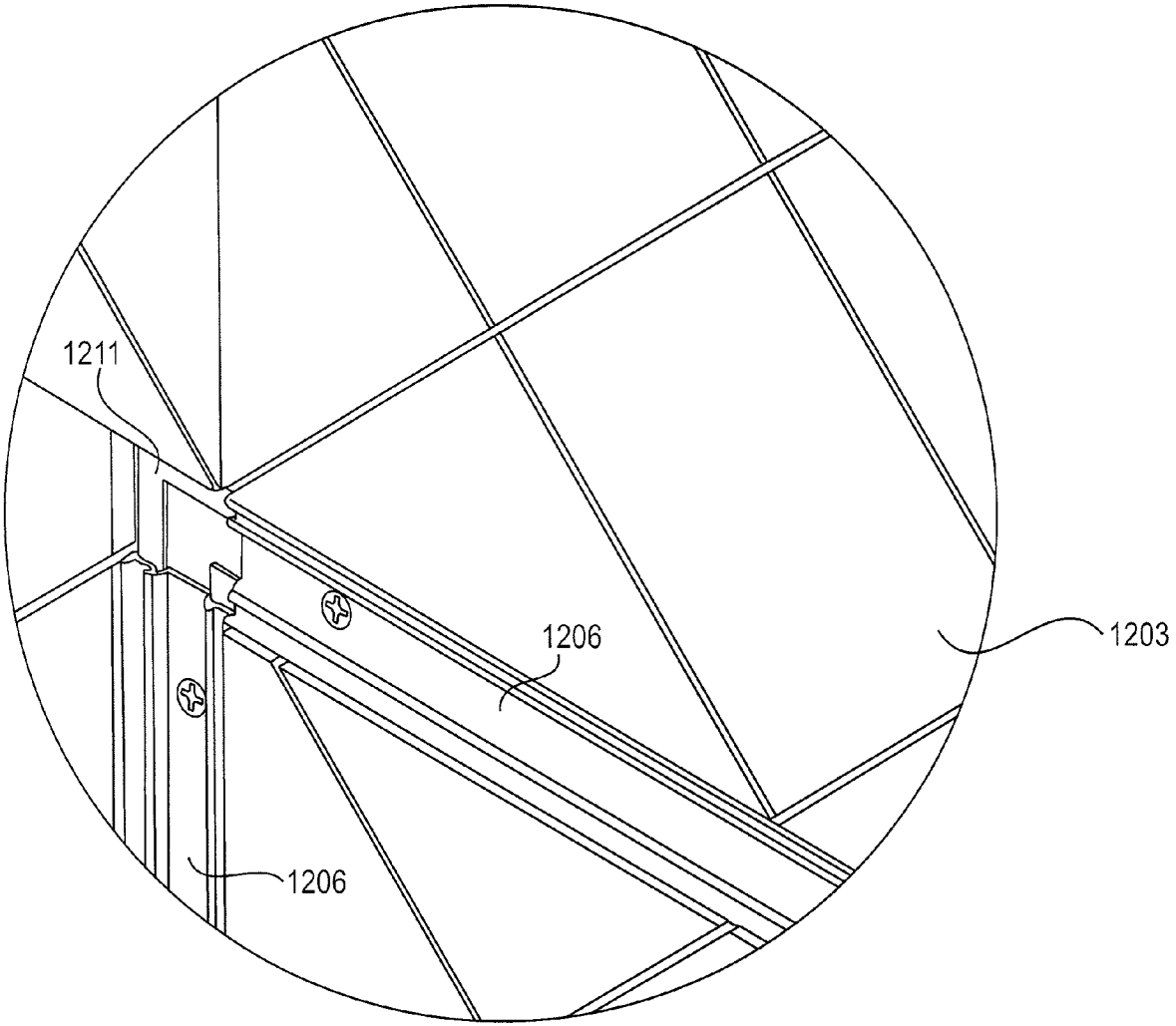

FIGS. 41-45 show the process of attaching adjacent angled base tracks 1206 to a support structure, such as a wall 1201. Although the adjacent base tracks 1206 are shown as perpendicular, it is contemplated that adjacent base tracks can be arranged at any angle. In such a process, as illustrated in FIG. 41, a length of base track 1206 can be fastened to a wall 1201 or other support structure by fitting fasteners 1207 through countersunk holes 1226 in the base track and into the wall. One end of each of two angled alignment connectors 1211 fit into alignment tracks 1224 in the base track 1206. As shown in FIG. 42, an adjacent length of base track 1206 can be arranged such that the opposite ends of the angled alignment connectors 1211 fit into alignment tracks 1224 of the adjacent base track 1206. FIG. 43 and FIG. 44 illustrate the adjacent base track 1206 in place with the alignment connectors 1211 fitted into the adjacent base track alignment tracks 1224. Fasteners 1207 fit through the countersunk holes 1226 of the adjacent length of base track 1206 and secure the base track to the wall at an angle to the other length of base track. FIG. 45 shows an embodiment with two adjacent perpendicular lengths of base track 1206 mounted to a wall 1201 between tiles 1203.

FIGS. 35-45 also illustrate examples of the modular capabilities of the disclosed LED decorative trim system. Additional adjacent lengths of base tracks can be connected as required for a specific application to provide flexibility in design. Other figures throughout the disclosure illustrate the ability for additional parts of the LED decorative trim system to be used in series to provide substantially any length or shape of design.

Figure 46:
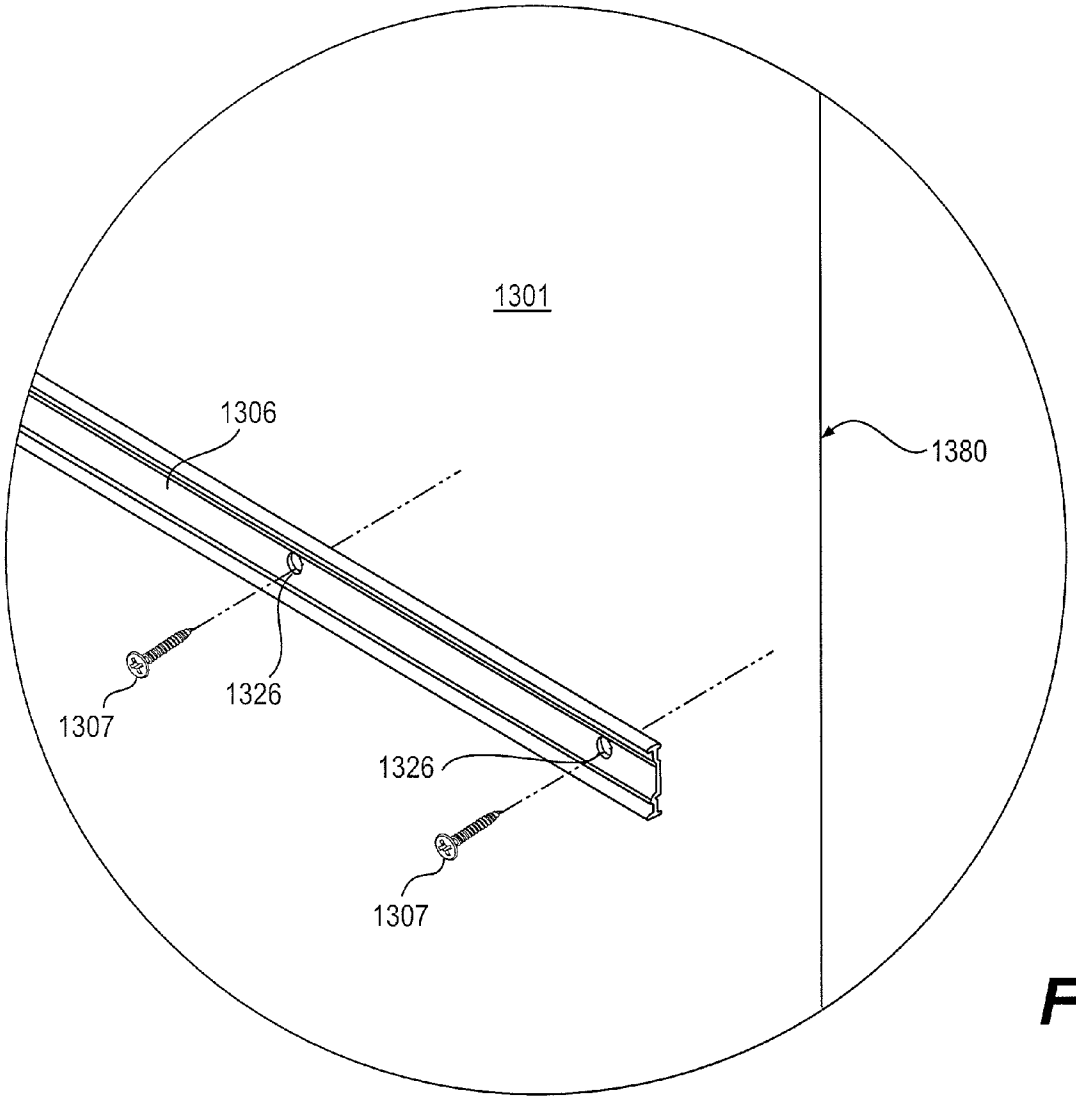
FIGS. 46-51 show an embodiment of a process for attaching adjacent base tracks to a corner of a support structure.
Figure 47:
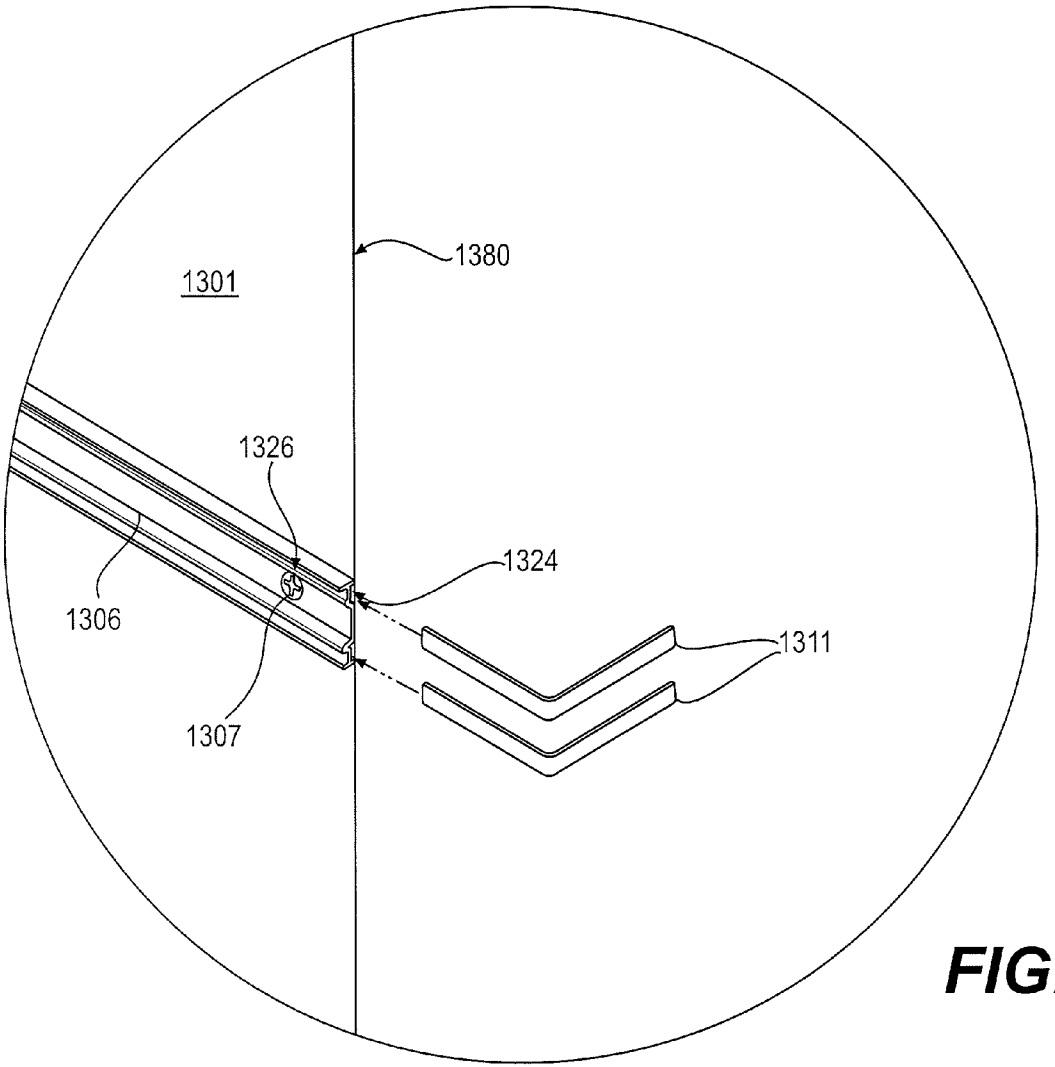
Figure 48:
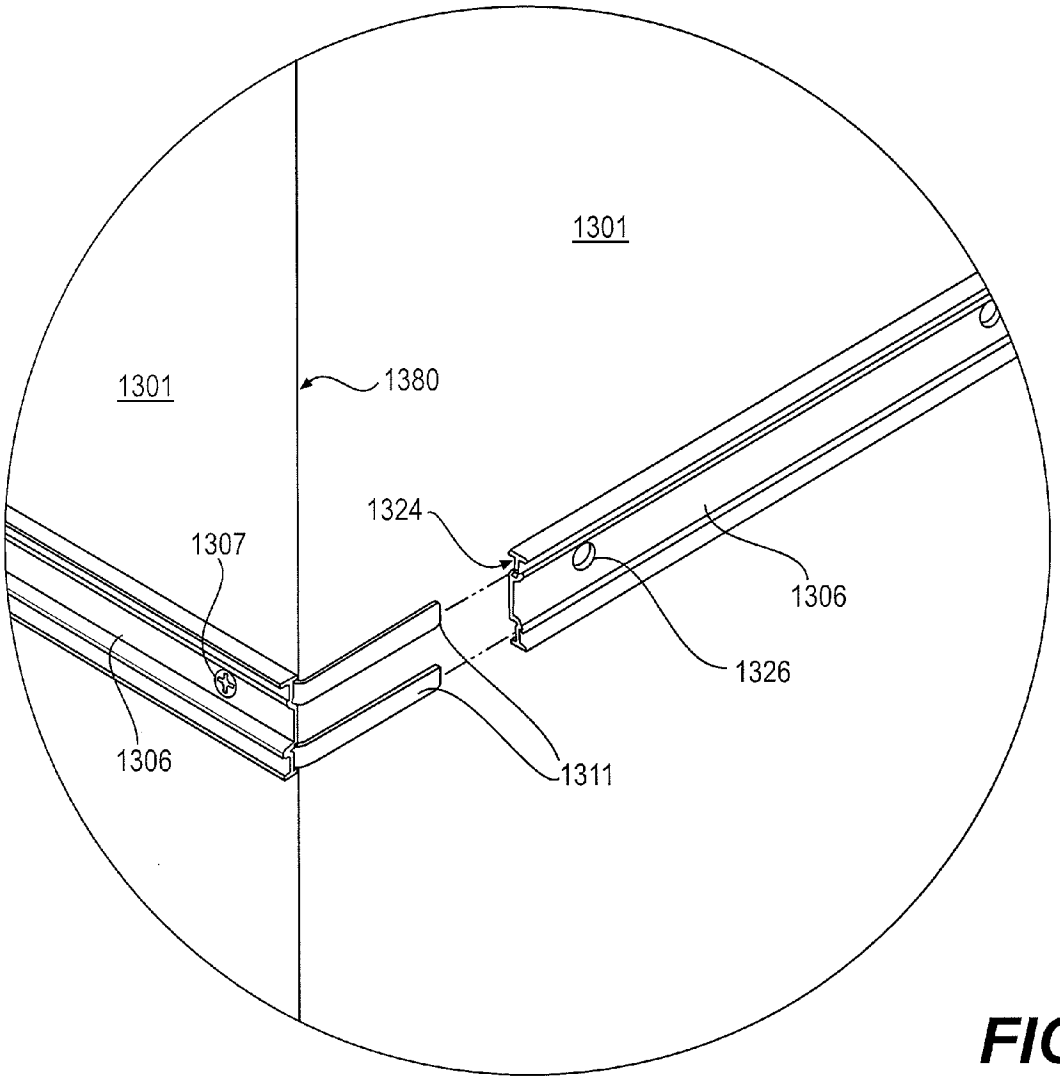
Figure 49:
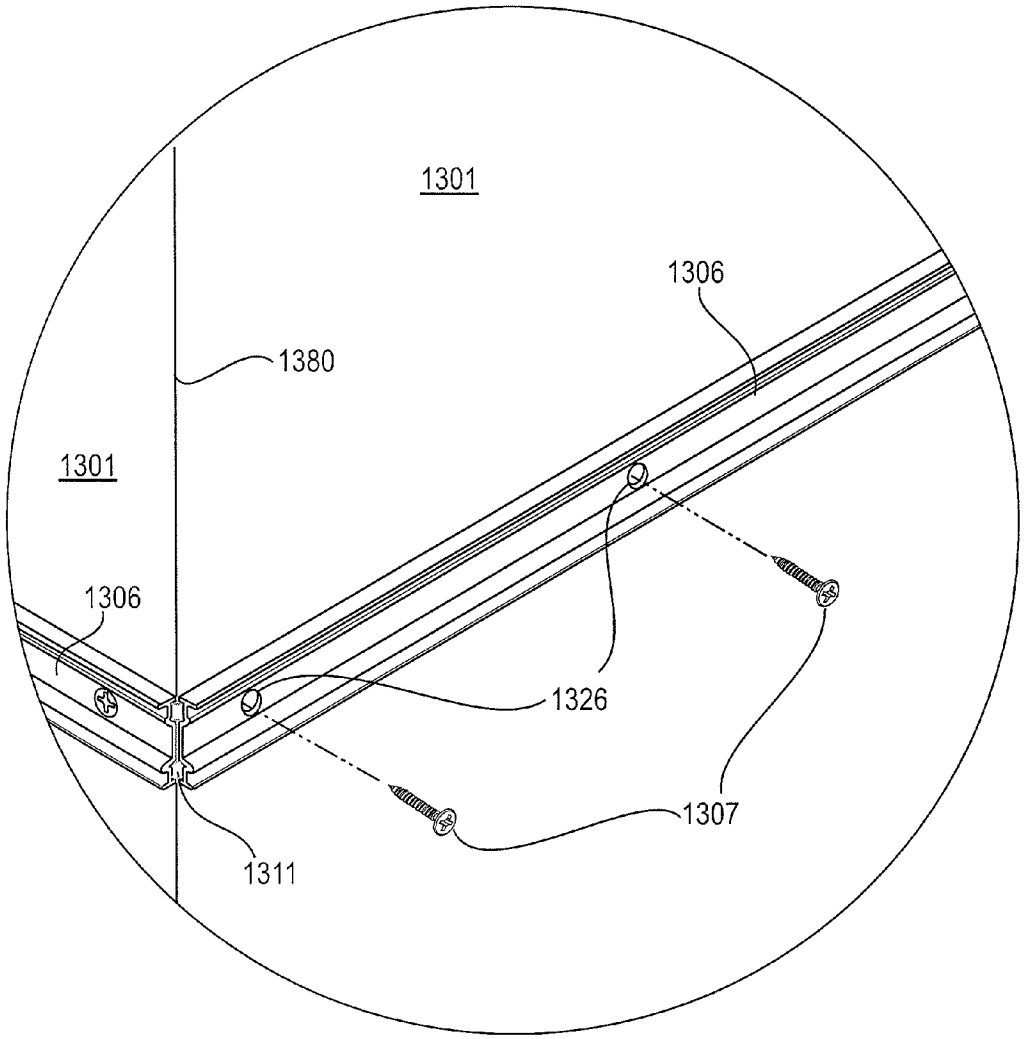
Figure 50:
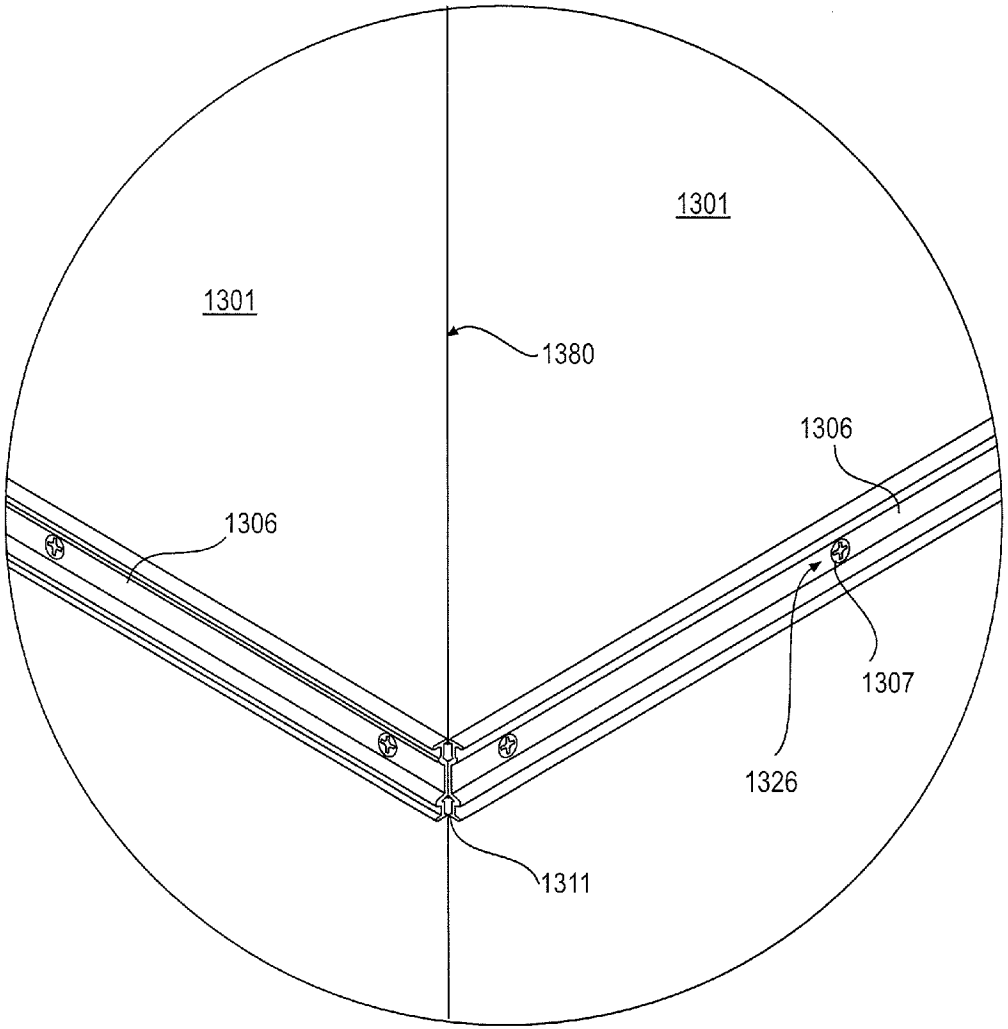
Figure 51:
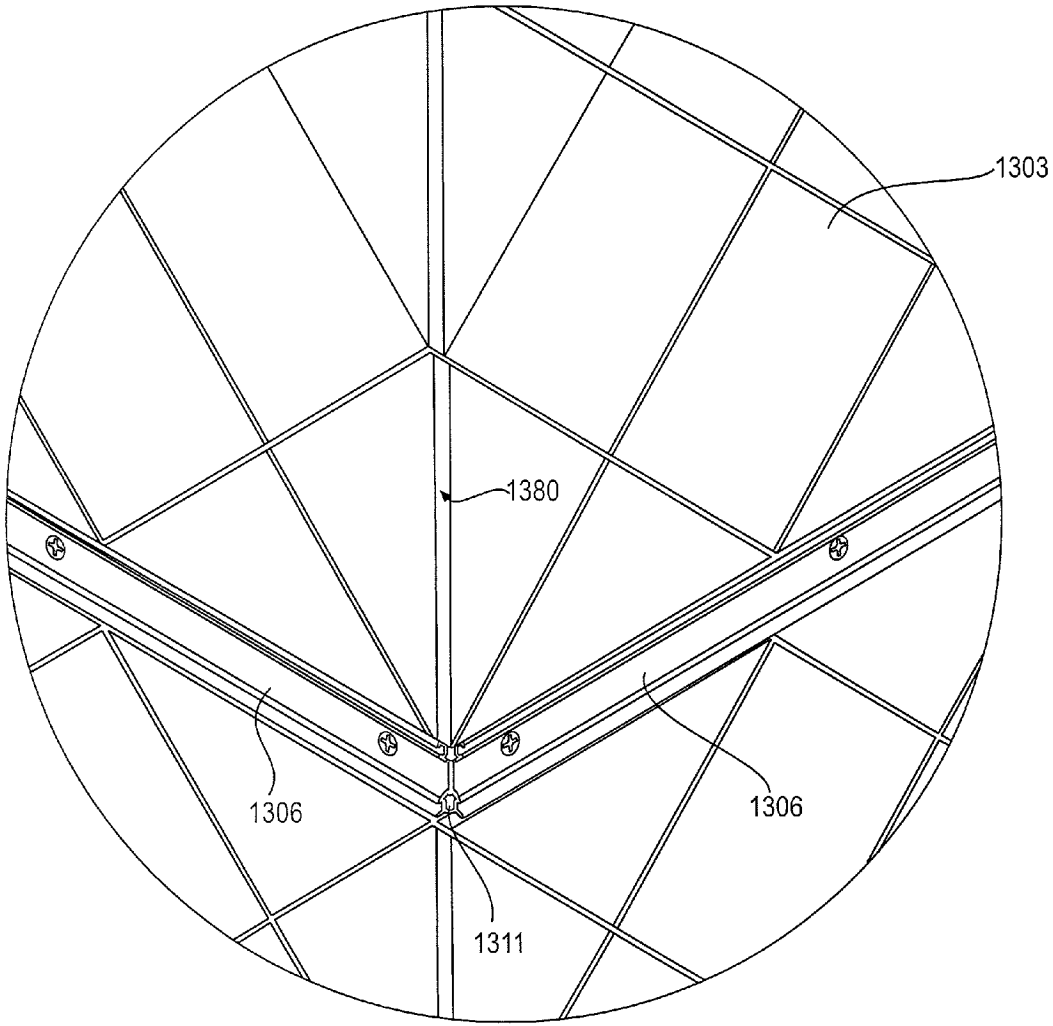

FIGS. 46-51 show the process of attaching adjacent base tracks 1306 to a corner 1380 of a support structure, such as a wall 1301. In such a process, as illustrated in FIG. 46, a length of base track 1306 can be fastened to a wall 1301 or other support structure by fitting fasteners 1307 through countersunk holes 1326 in the base track and into the wall. As shown in FIG. 47, one end of each of two angled alignment connectors 1311 fit into alignment tracks 1324 in the base track 1306. As shown in FIG. 48 and FIG. 49, the angled alignment connectors 1311 wrap around the corner 1380. An adjacent length of base track 1306 can be arranged around the corner 1380 and against the wall 1301 such that the opposite ends of the angled alignment connectors 1311 fit into alignment tracks 1324 of the adjacent base track 1306. Fasteners 1307 fit through the countersunk holes 1326 of the adjacent length of base track 1306 and secure the base track to the wall 1301 around the corner from the other length of base track. FIG. 50 shows an embodiment with two adjacent perpendicular lengths of base track 1306 mounted around a corner 1380 from one another. FIG. 51 shows an embodiment with two adjacent perpendicular lengths of base track 1306 mounted around a corner 1380 from one another and between tiles 1303.

Figure 52:
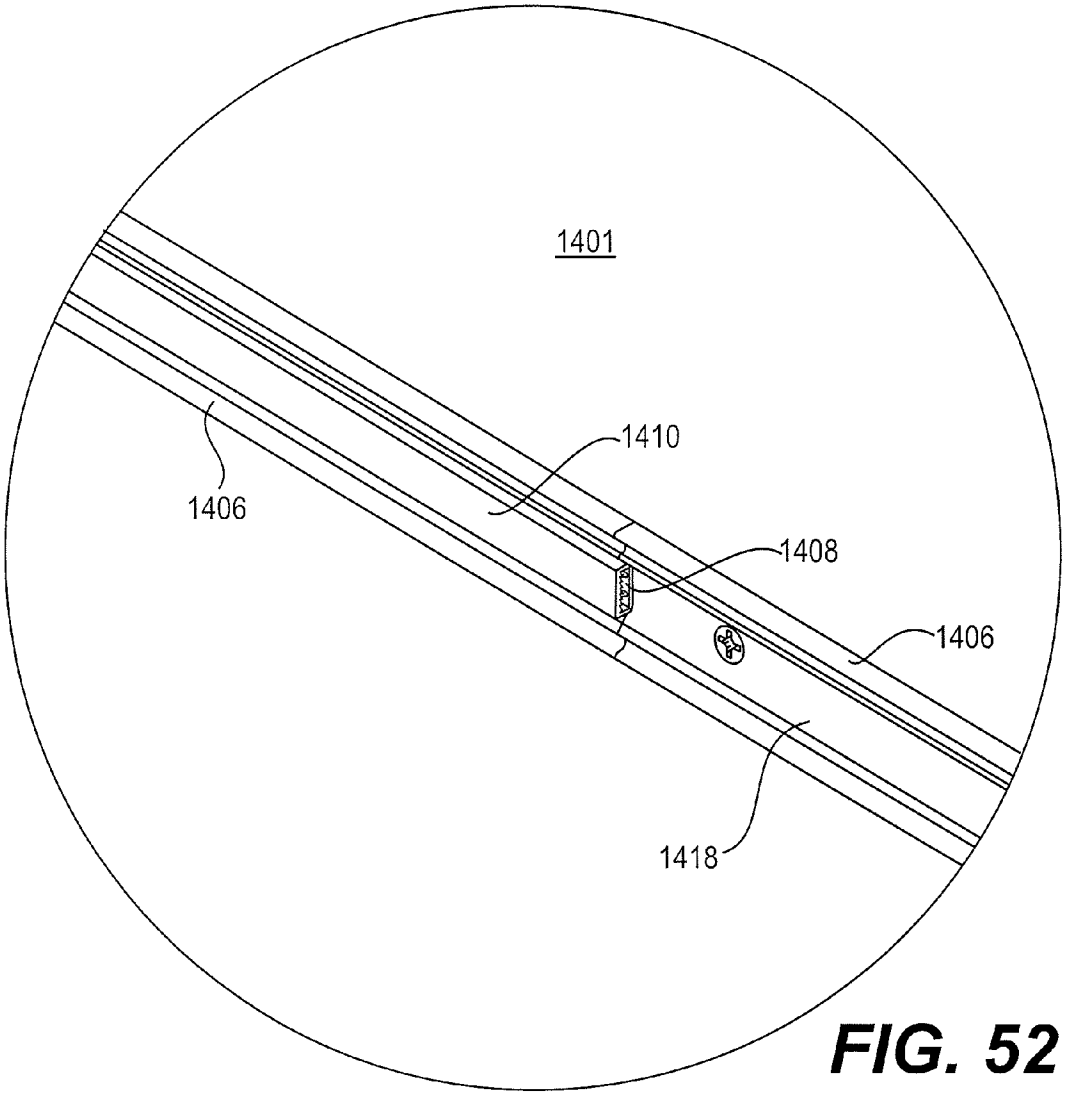
FIGS. 52-56 show an embodiment of a process for combining and installing components of a decorative LED illuminated trim system.
Figure 53:
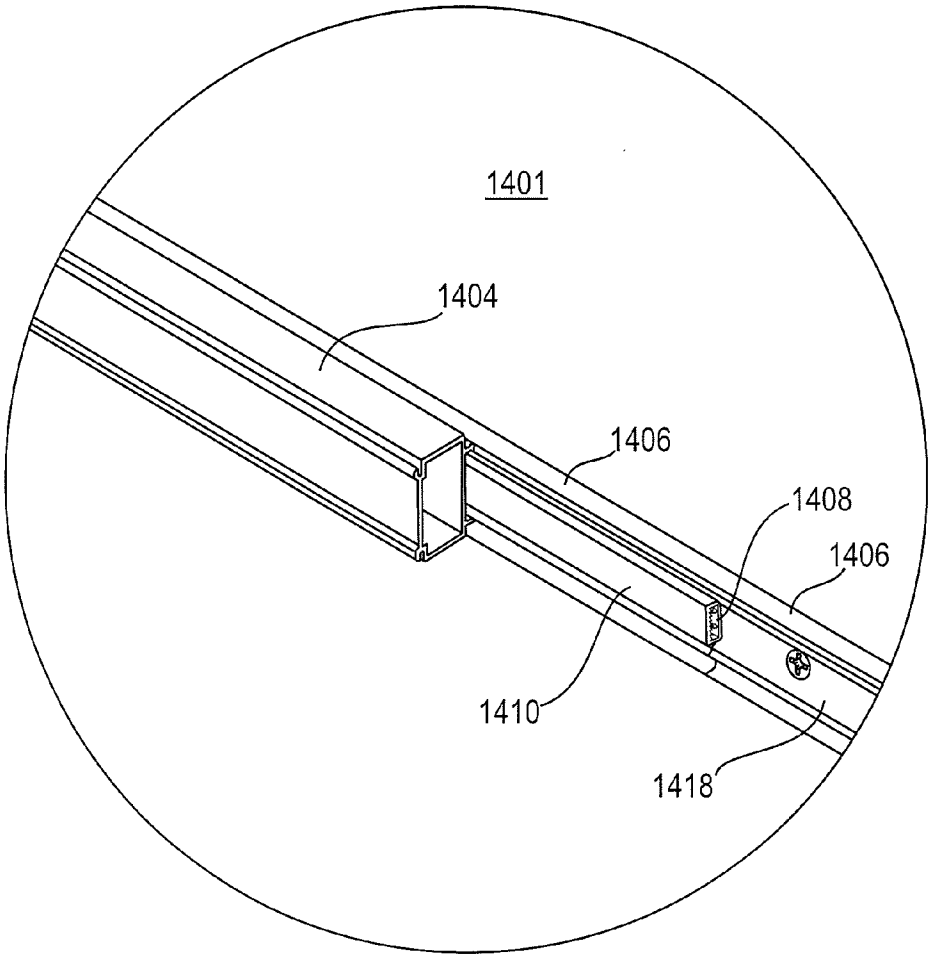
Figure 54:
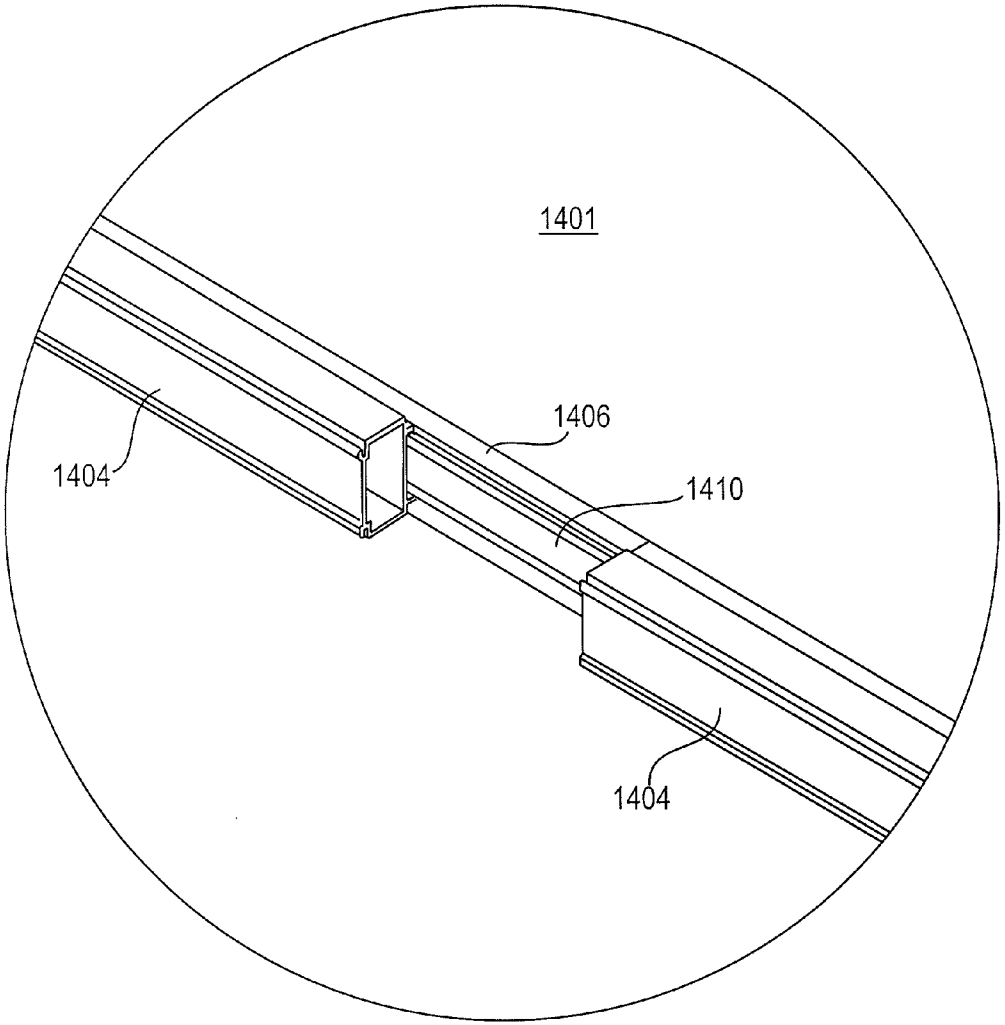
Figure 55:
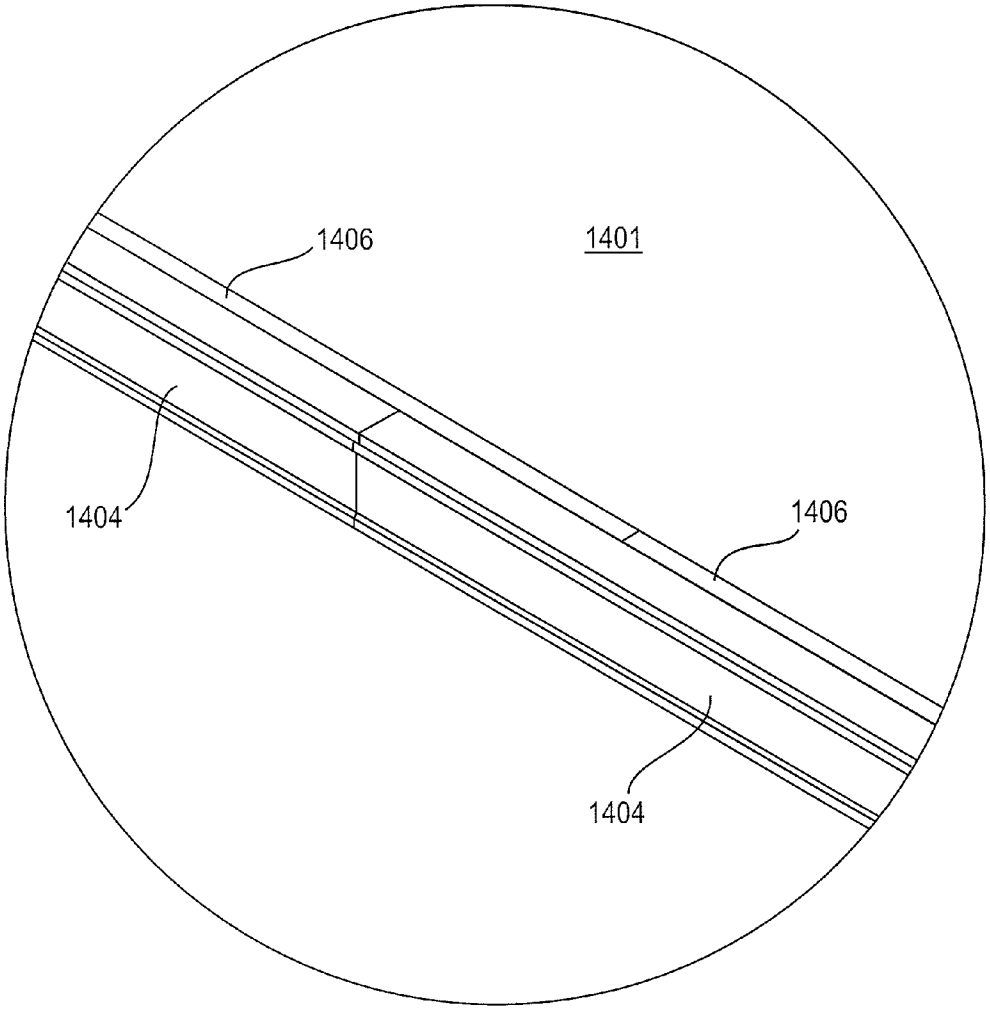
Figure 56:
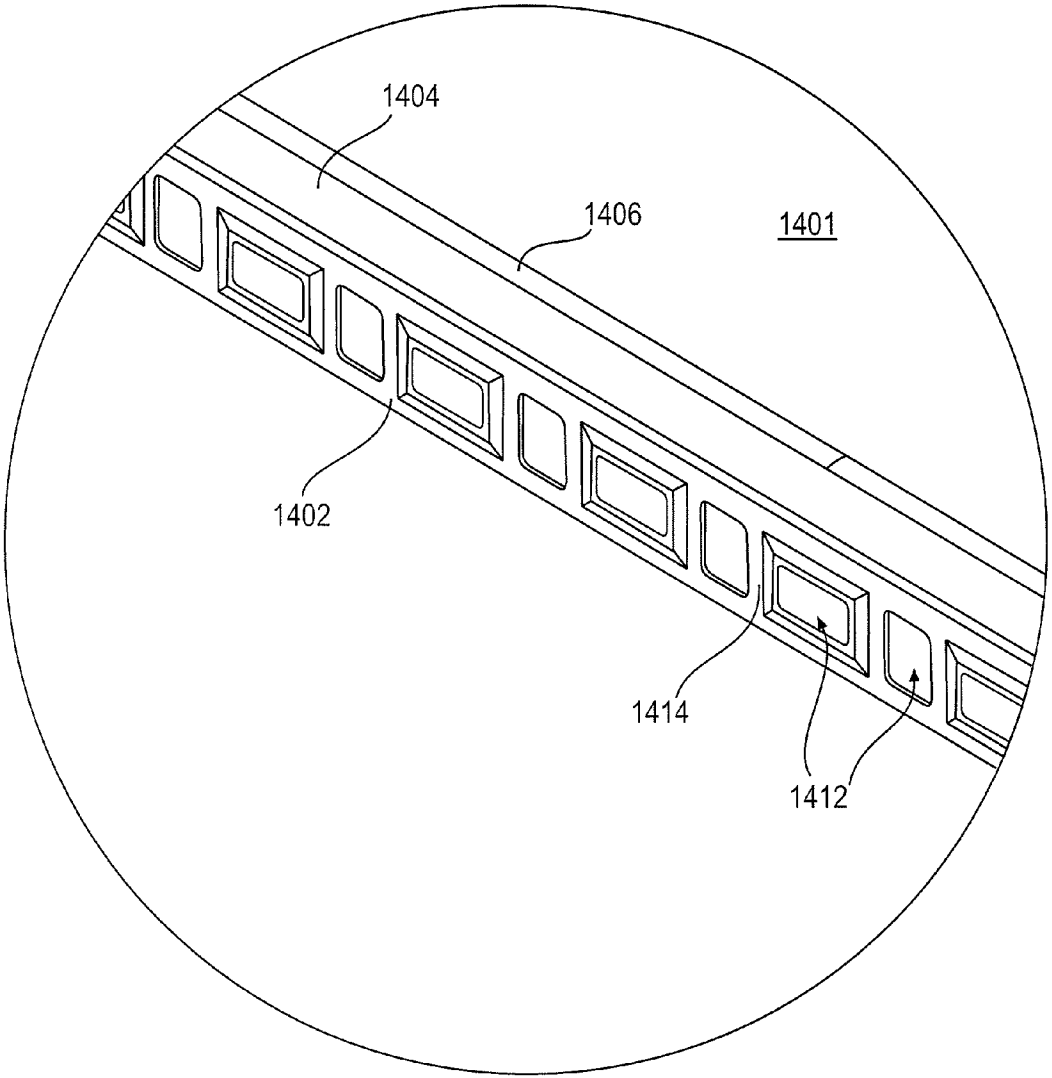

FIGS. 52-56 show the process of attaching embodiments of a LED strip 1408, jacket 1410, cover 1404, and decorative element 1402 to adjacent base tracks 1406. FIG. 52 illustrates a pair of adjacent base tracks 1406 fastened to a wall 1401 with a length of a LED strip 1408 and jacket 1410 installed in a LED seat 1418 of the base track 1406. FIG. 53 shows a cover 1404 attached to the base track 1406 covering the LED string 1408 and jacket 1410. FIG. 54 shows another cover 1404 attached to one of the base tracks 1406 positioned over the jacket 1410. FIG. 55 shows two adjacent covers 1404 installed on two adjacent lengths of base track 1406. FIG. 56 shows a decorative element 1402 installed over the cover 1404 having windows 1412 and opaque areas 1414. The windows 1412 can either be holes in the decorative element 1402, or can be transparent or translucent sections within the decorative element. In some embodiments, the windowed areas 1412 can be disposed such that the windowed areas are located where there is no LED bulb directly disposed behind the windowed area. The LED strip 1408, base tracks 1406, jacket 1410, cover 1404, and decorative element 1402 shown in FIGS. 52-56 can be attached to one another in a similar manner to corresponding elements shown in FIG. 14.

Figure 57:
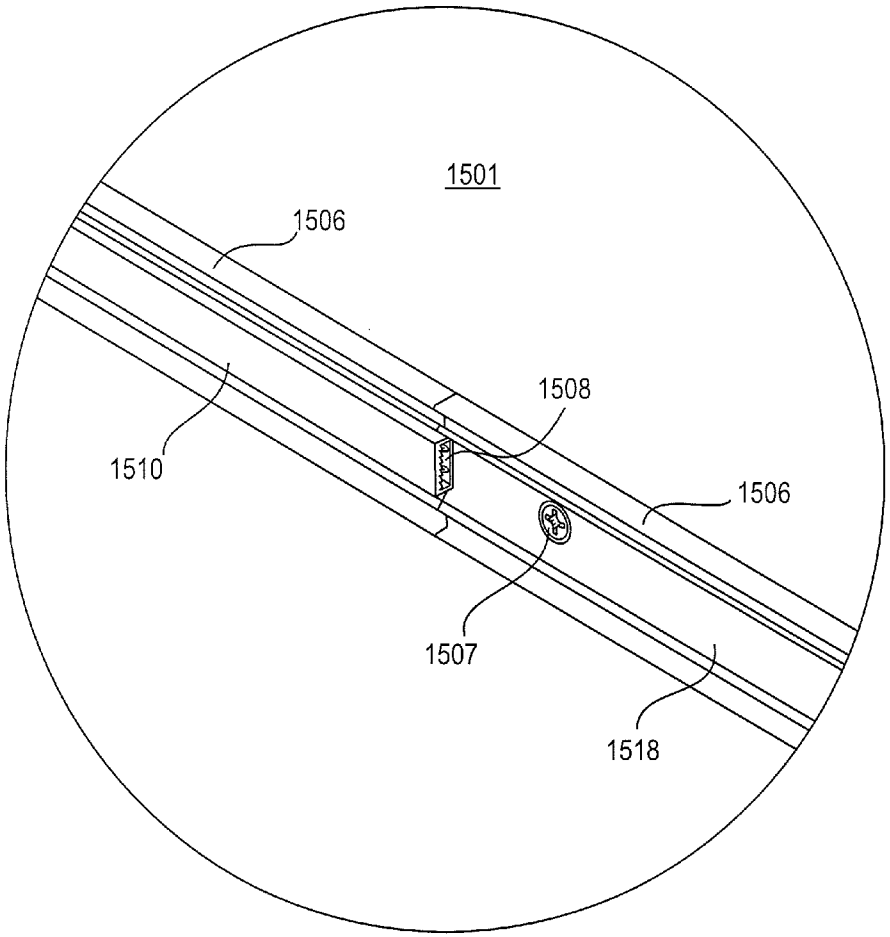
FIGS. 57-61 show another embodiment of a process for combining and installing components of a decorative LED illuminated trim system.
Figure 58:
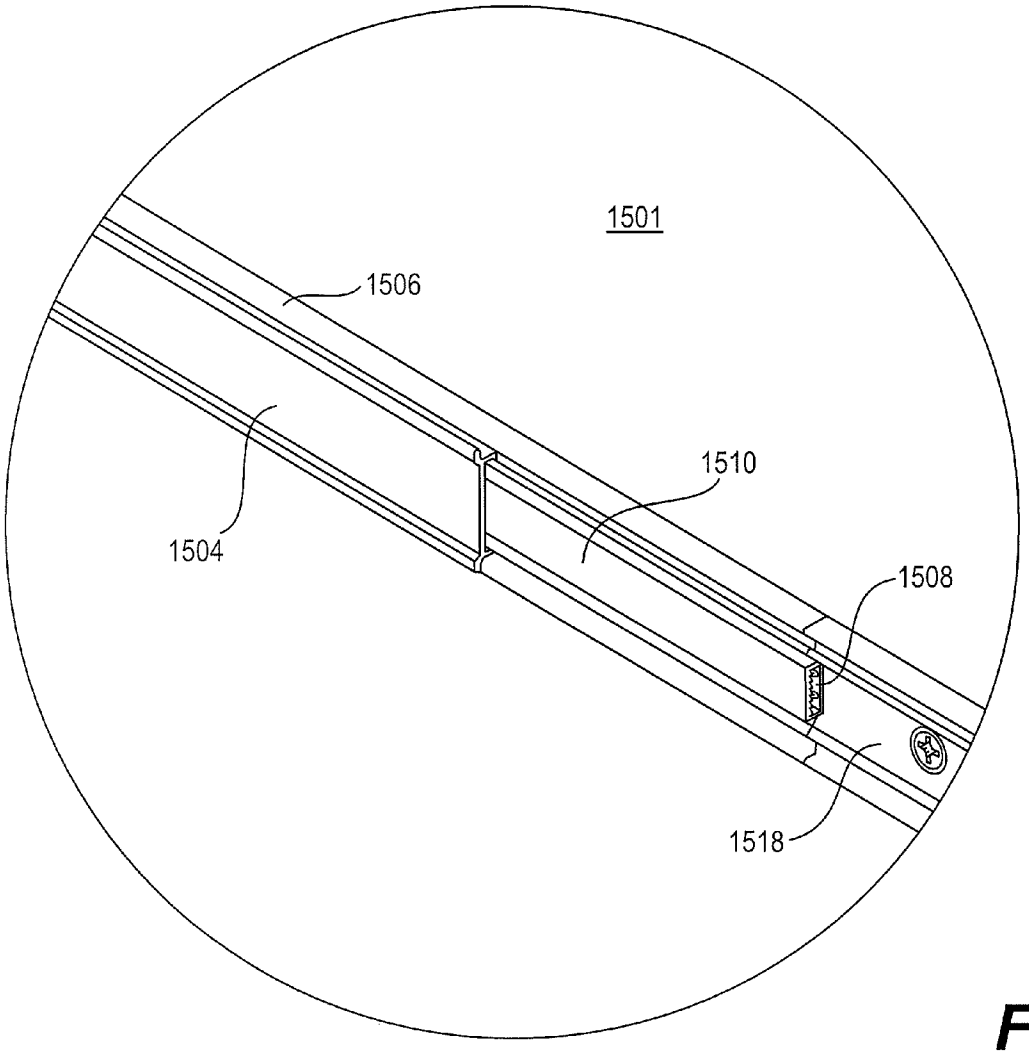
Figure 59:
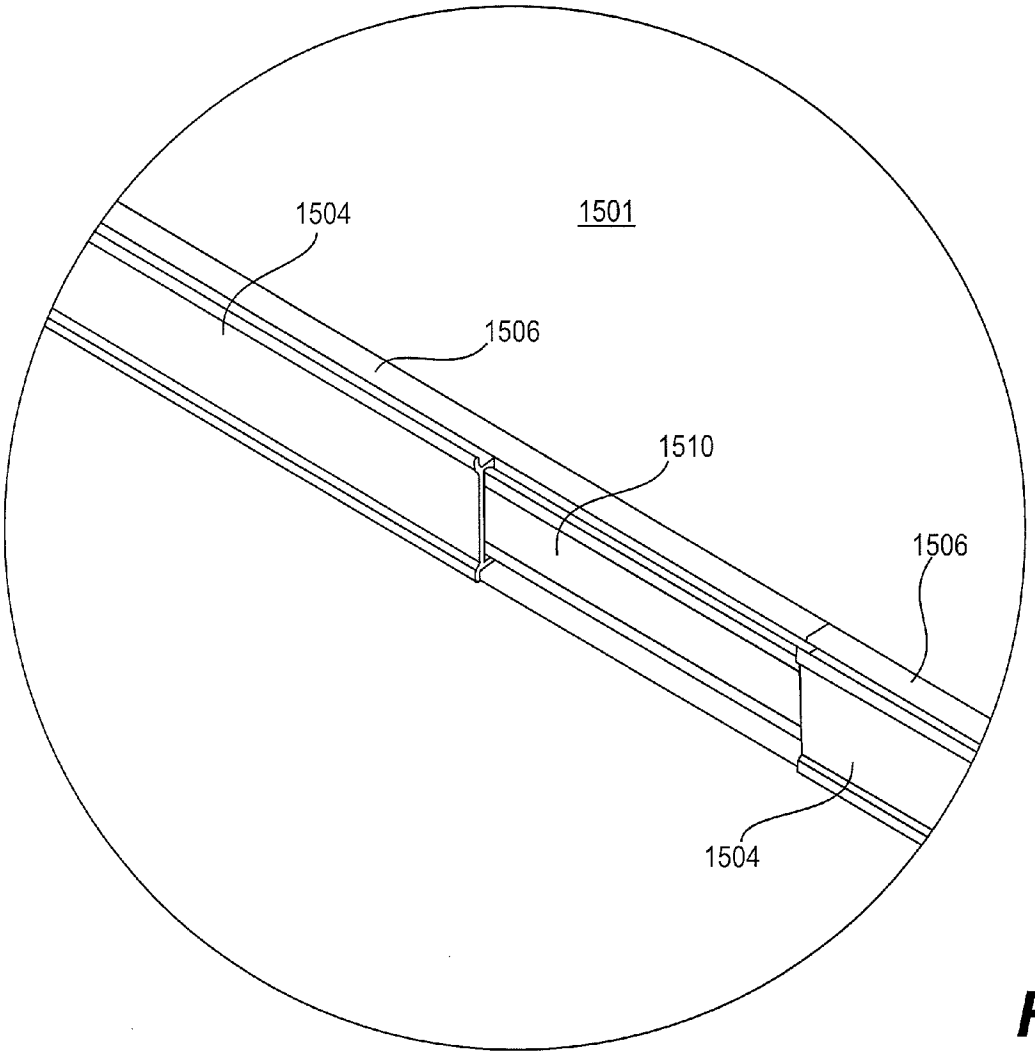
Figure 60:
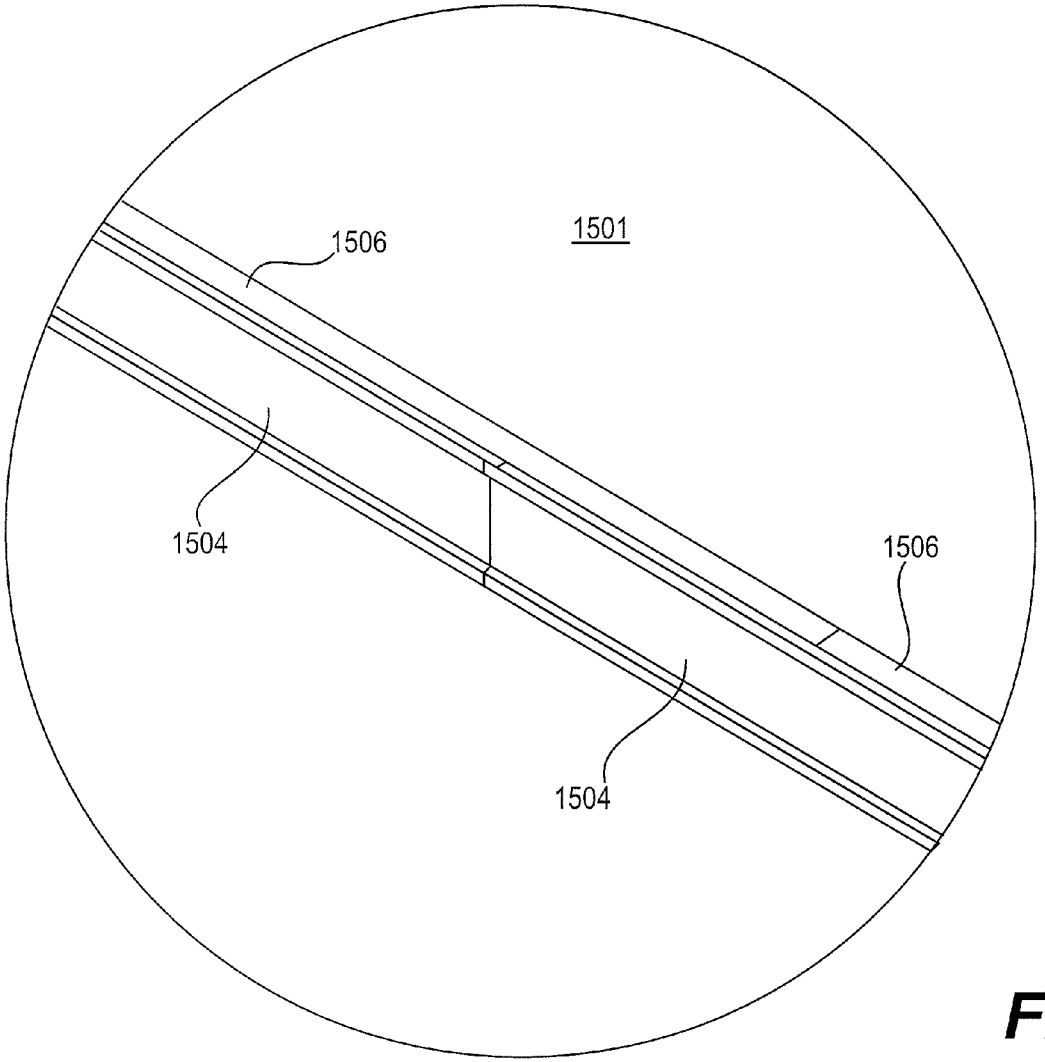
Figure 61:
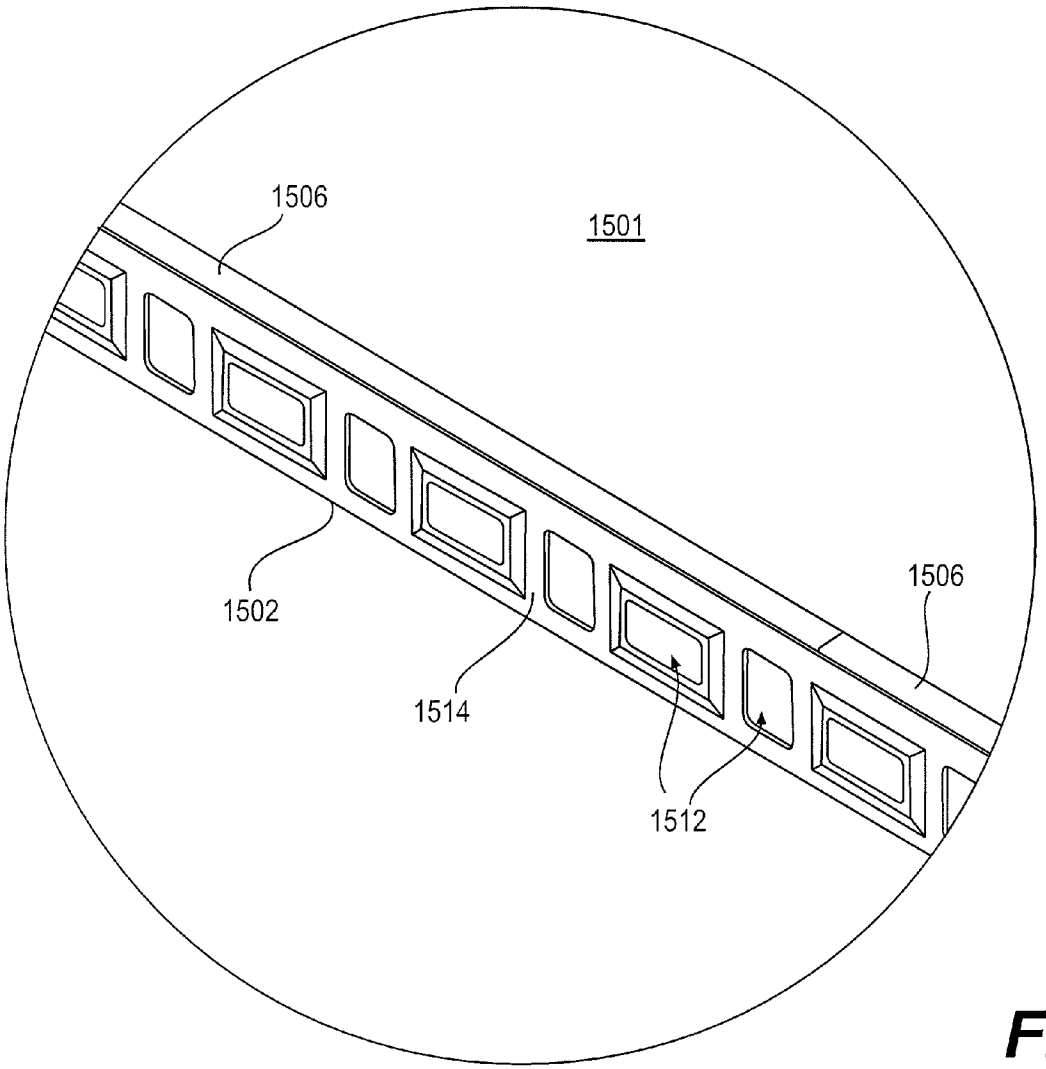

Similarly, FIGS. 57-61 show the process of attaching embodiments of a LED strip 1508, jacket 1510, cover 1504, and decorative element 1502 to adjacent base tracks 1506. FIG. 57 illustrates a pair of adjacent base tracks 1506 fastened to a wall 1501 with a length of a LED strip 1508 and jacket 1510 installed in a LED seat 1518 of the base track 1506. FIG. 58 shows a cover 1504 attached to the base track 1506 covering the LED string 1508 and jacket 1510. FIG. 59 shows another cover 1504 attached to one of the lengths of base track 1506 positioned over the jacket 1510. FIG. 60 shows two adjacent covers 1504 installed on two adjacent lengths of base track 1506. FIG. 61 shows a decorative element 1502 installed over the cover 1504 having windows 1512 and opaque areas 1514. The windows 1512 can either be holes in the decorative element 1502, or can be transparent or translucent sections within the decorative element. In some embodiments, the windowed areas 1512 can be disposed such that the windowed areas are located where there is no LED bulb directly disposed behind the windowed area. The LED strip 1508, base tracks 1506, jacket 1510, cover 1504, and decorative element 1502 shown in FIGS. 57-61 can be attached to one another in a similar manner to corresponding elements shown in FIG. 29.

Figure 62:
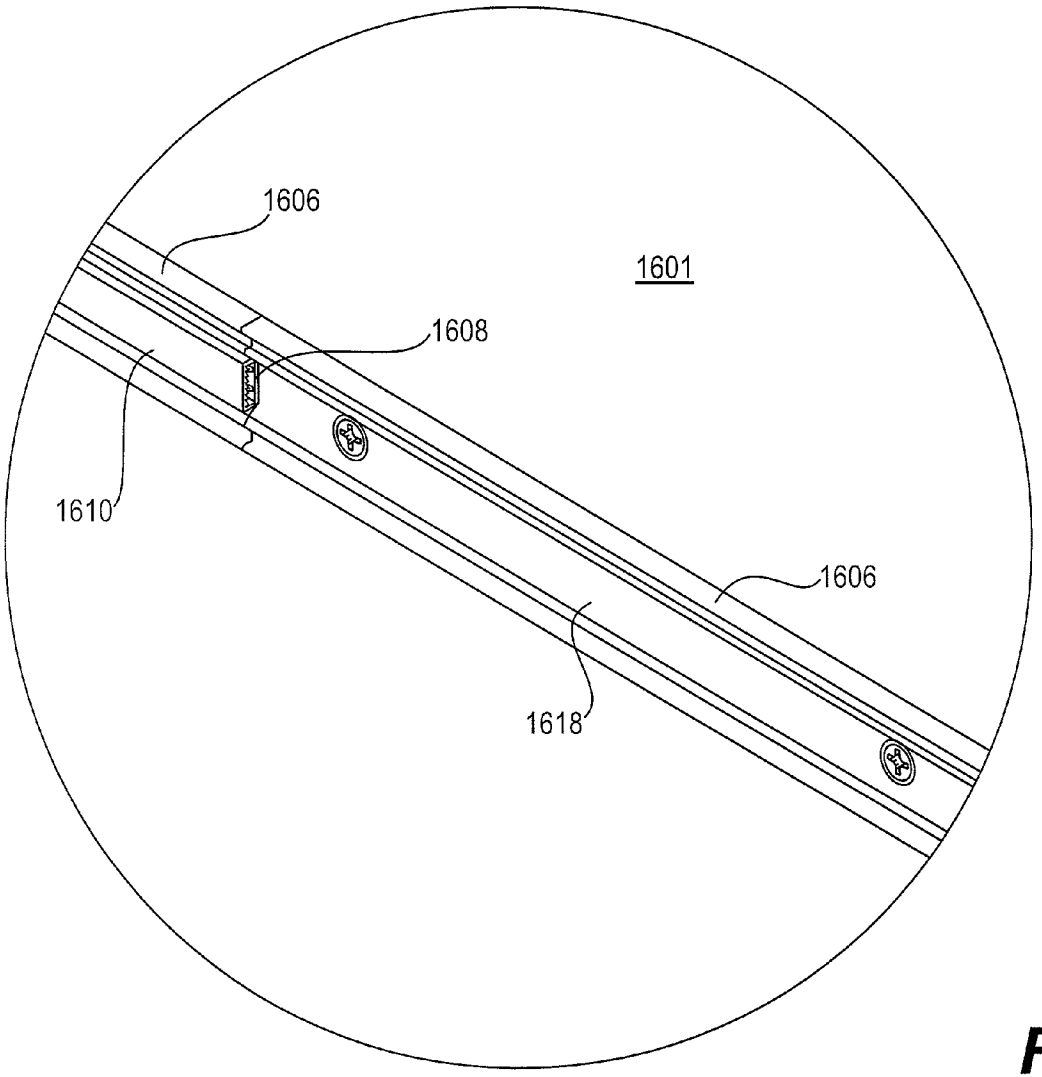
FIGS. 62-65 show another embodiment of a process for combining and installing components of a decorative LED illuminated trim system.
Figure 63:
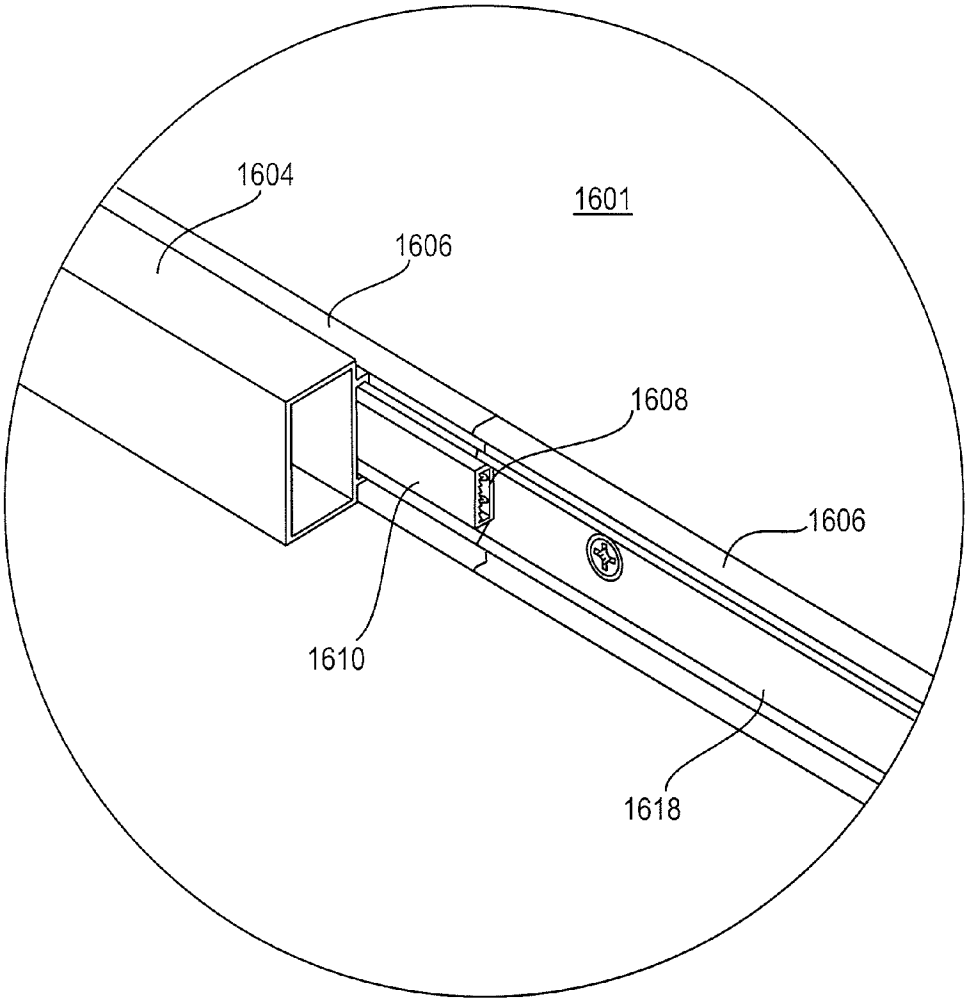
Figure 64:
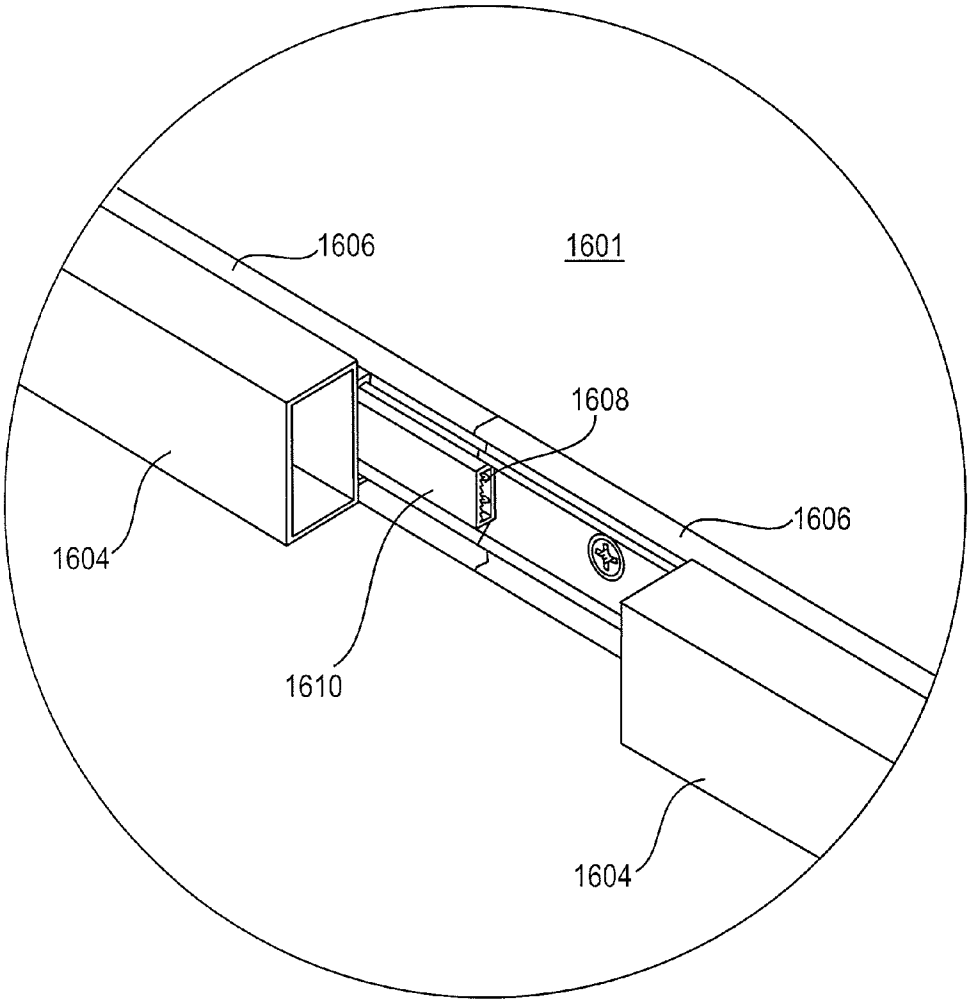
Figure 65:
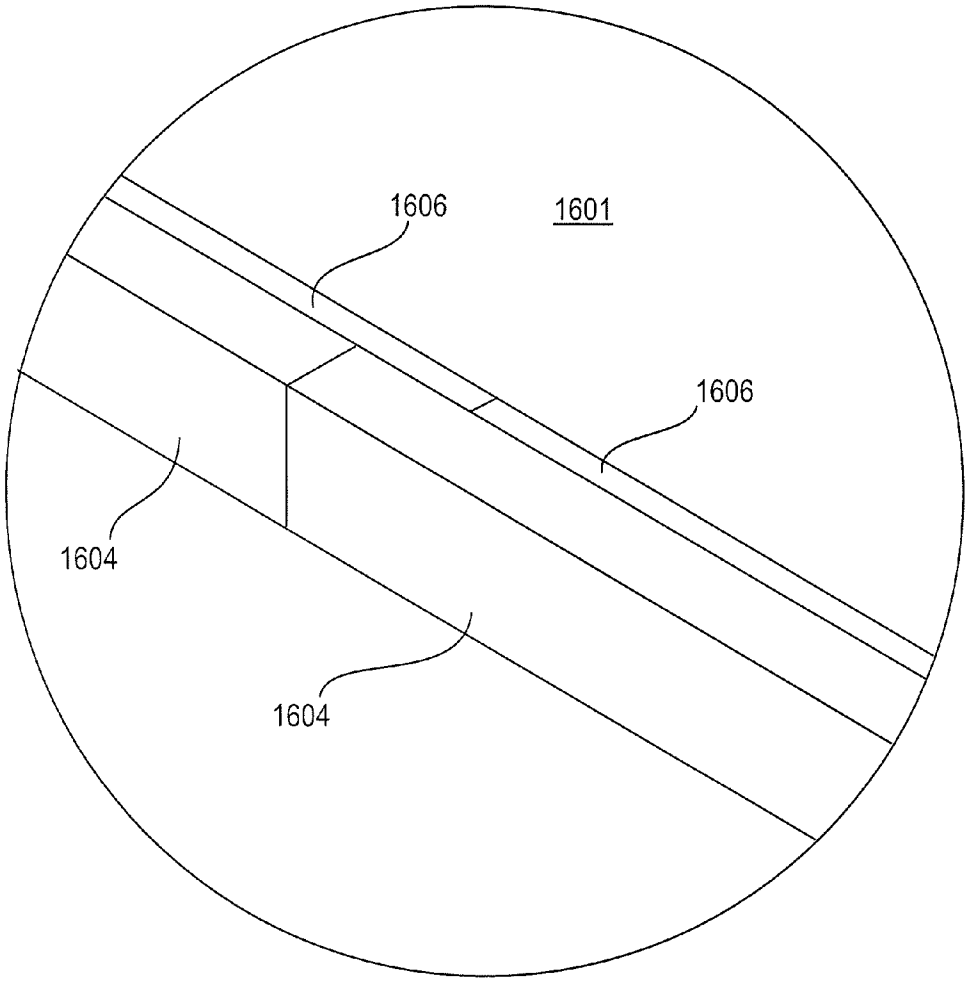

FIGS. 62-65 show the process of attaching embodiments of an LED strip 1608, jacket 1610, cover 1604 without a decorative element to adjacent base tracks 1606. FIG. 62 illustrates a pair of adjacent base tracks 1606 fastened to a wall 1601 with a length of a LED strip 1608 and jacket 1610 installed in a LED seat 1618 of the base track 1606. FIG. 63 shows a tubular cover 1604 attached to the base track 1606 covering the LED string 1608 and jacket 1610. In this embodiment, the tubular cover 1604 does not receive a decorative element like in some other embodiments herein. FIG. 64 shows another tubular cover 1604 attached to one of the lengths of base track 1606 positioned over the jacket 1610. FIG. 65 shows two adjacent tubular covers 1604 without attached decorative elements installed on two adjacent lengths of base track 1606.

Figure 66:
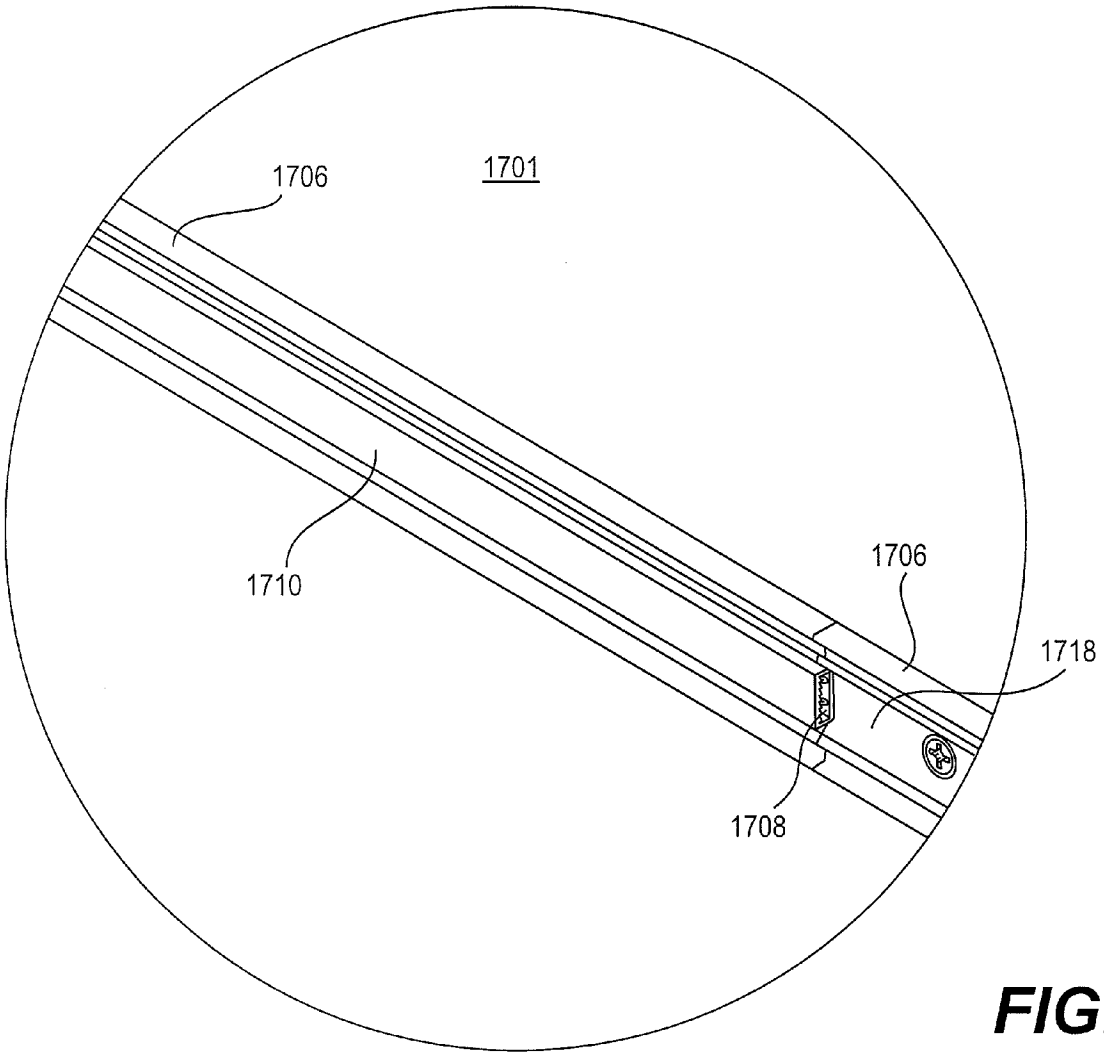
FIGS. 66-69 show another embodiment of a process for combining and installing components of a decorative LED illuminated trim system.
Figure 67:
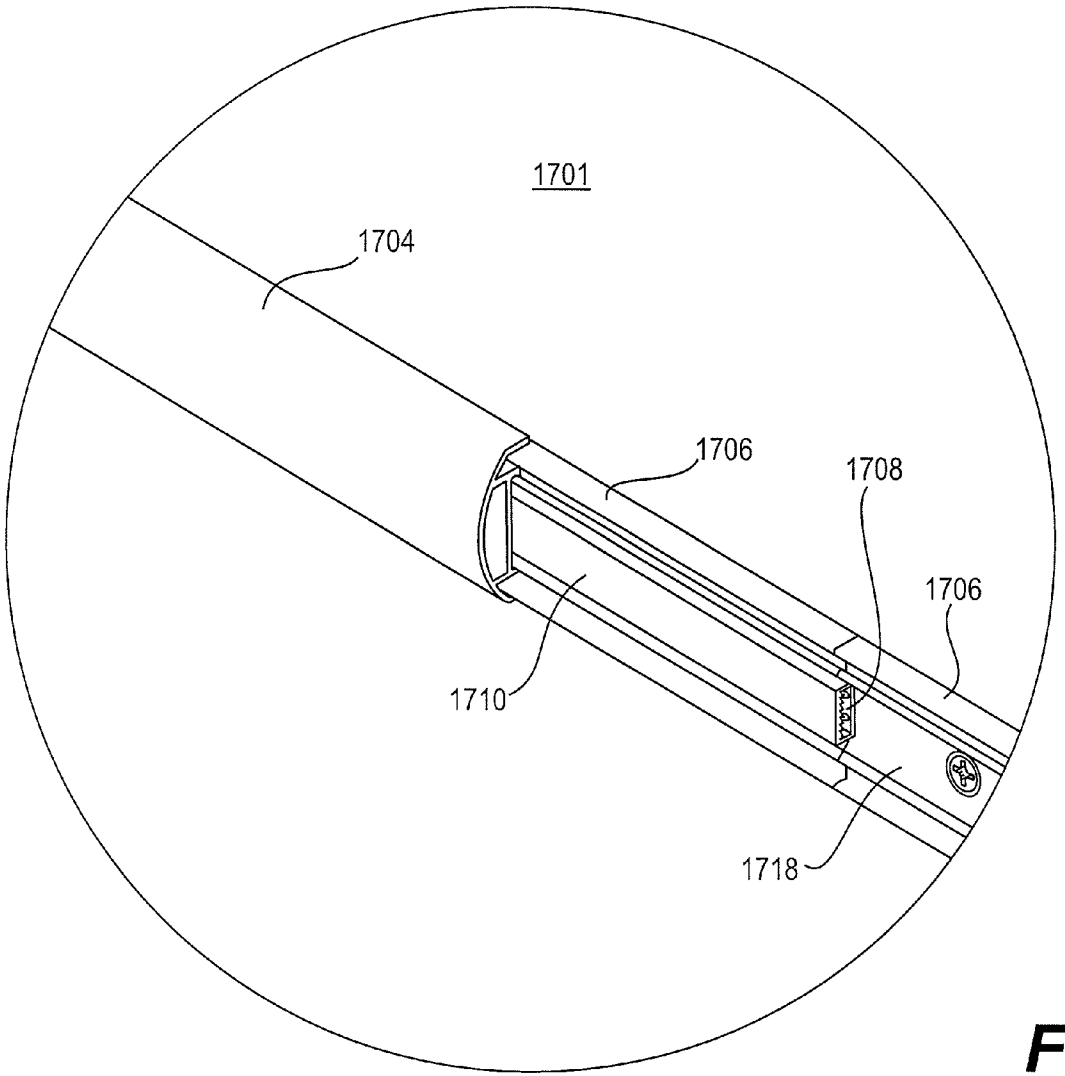
Figure 68:
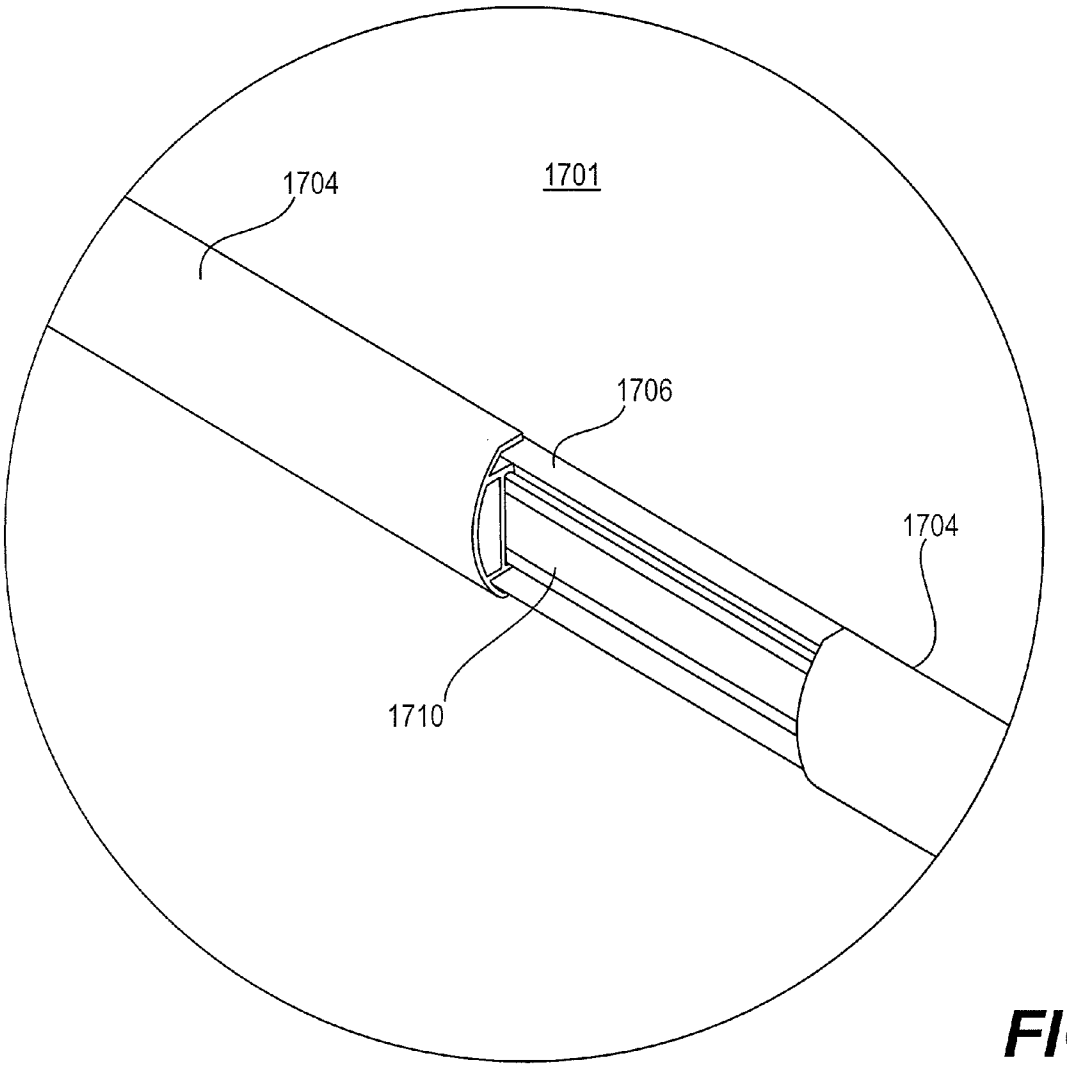
Figure 69:
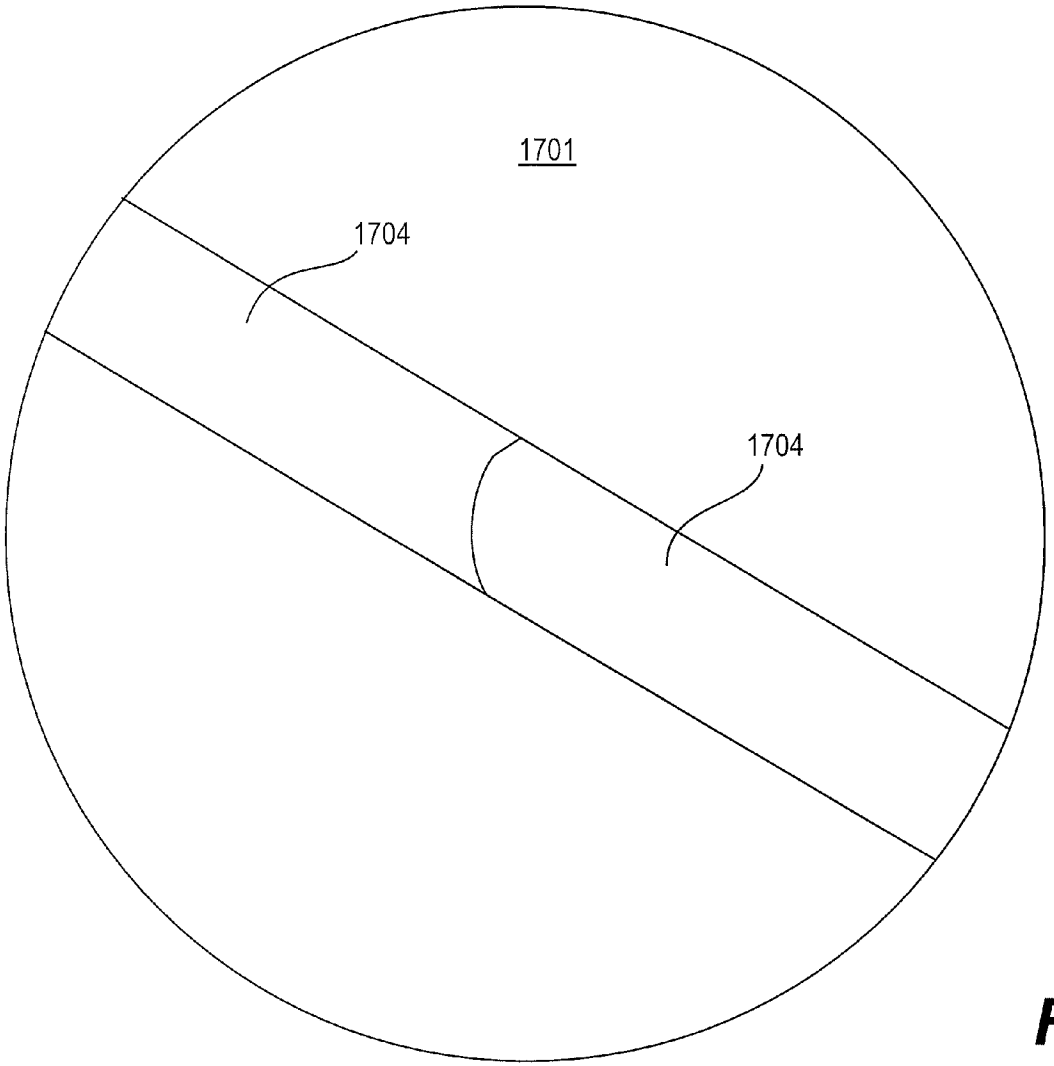

FIGS. 66-69 show the process of attaching embodiments of an LED strip 1708, jacket 1710, cover 1704 without a decorative element to adjacent base tracks 1706. FIG. 66 illustrates a pair of adjacent base tracks 1706 fastened to a wall 1701 with a length of a LED strip 1708 and jacket 1710 installed in a LED seat 1718 of the base track 1706. FIG. 67 shows a cover 1704 attached to the base track 1706 covering the LED string 1708 and jacket 1710. In this embodiment, the cover 1704 does not receive a decorative element like in some other embodiments herein. FIG. 68 shows another cover 1704 attached to one of the lengths of base track 1706 positioned over the jacket 1710. FIG. 69 shows two adjacent covers 1704 without attached decorative elements installed on two adjacent lengths of base track 1706.

Figure 70:
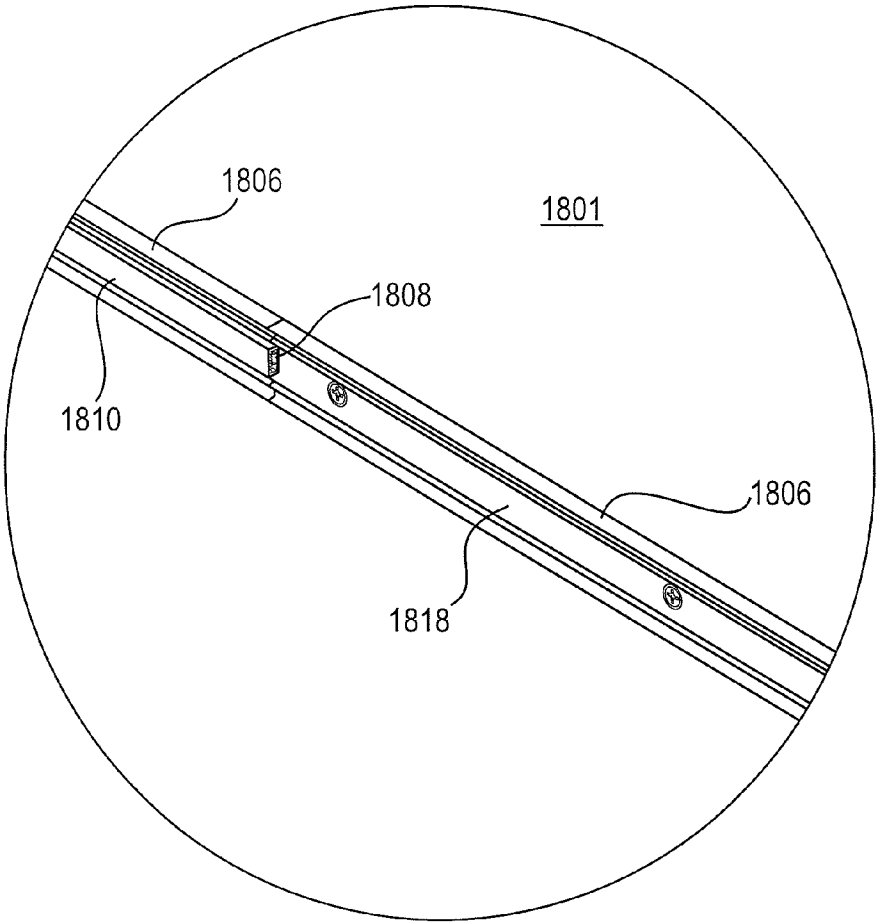
FIGS. 70-75 show another embodiment of a process for combining and installing components of a decorative LED illuminated trim system.
Figure 71:
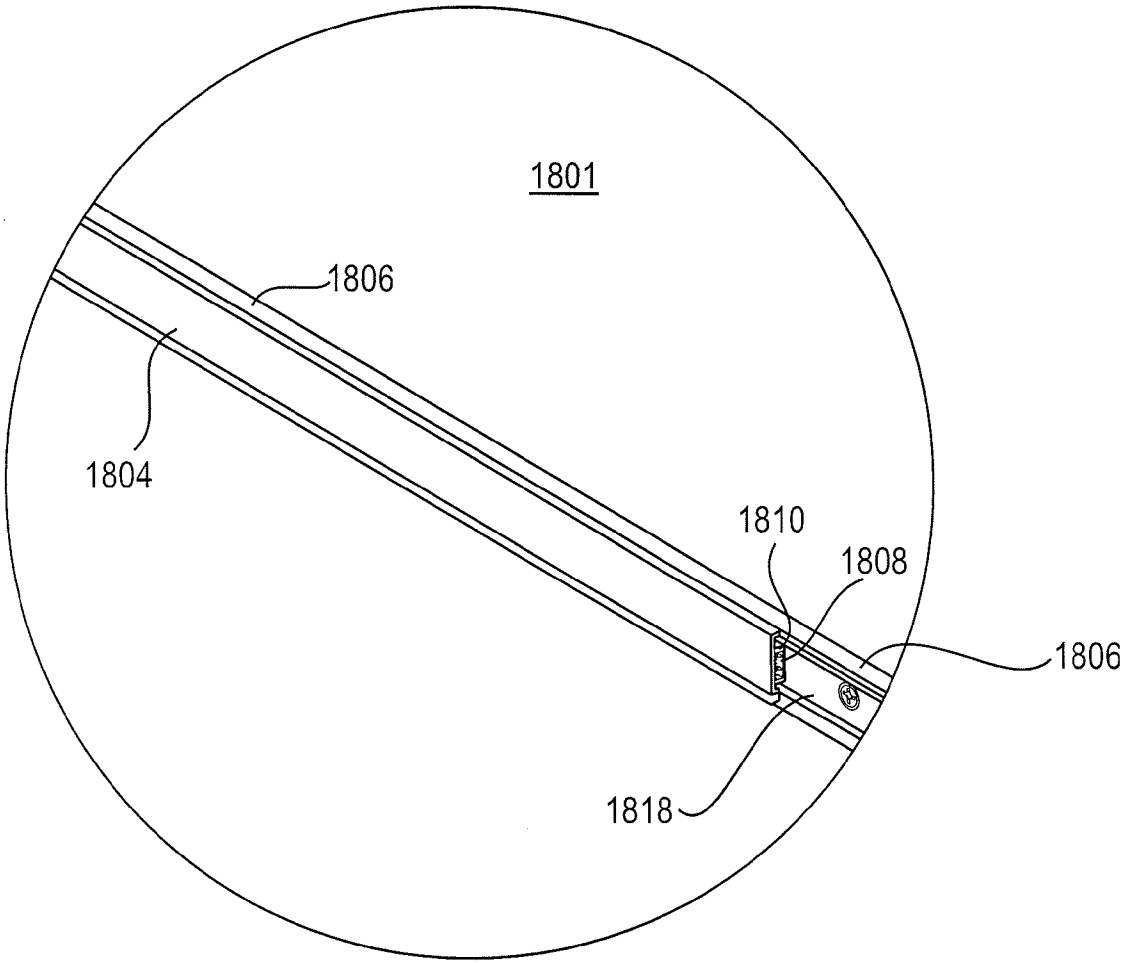
Figure 72:
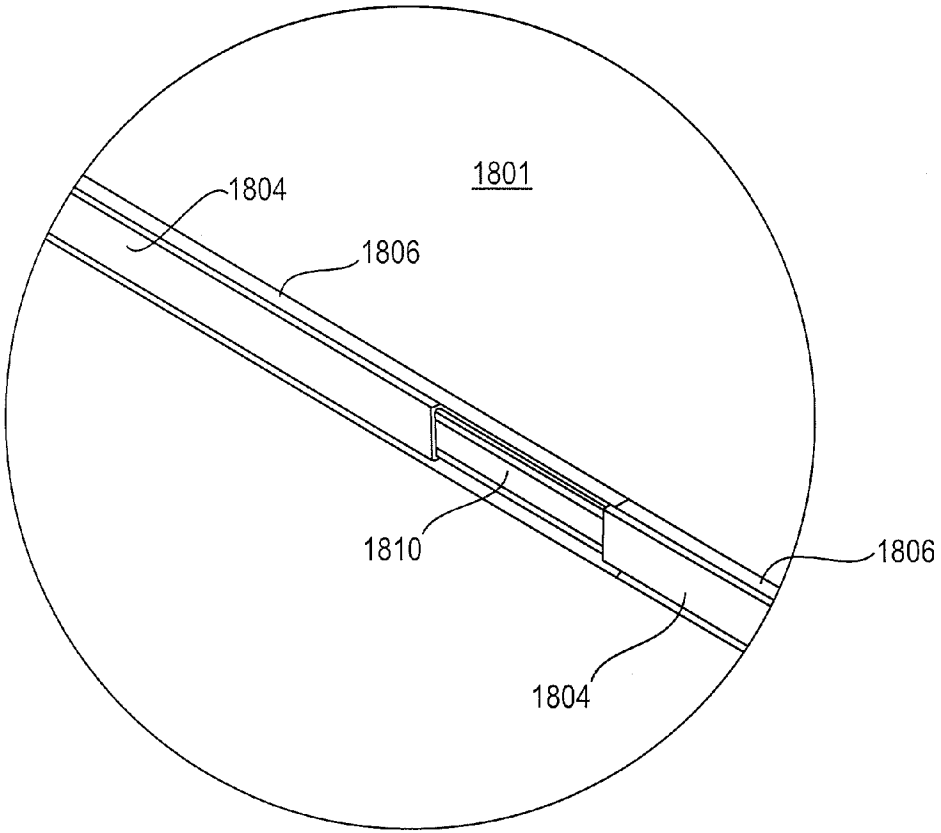
Figure 73:
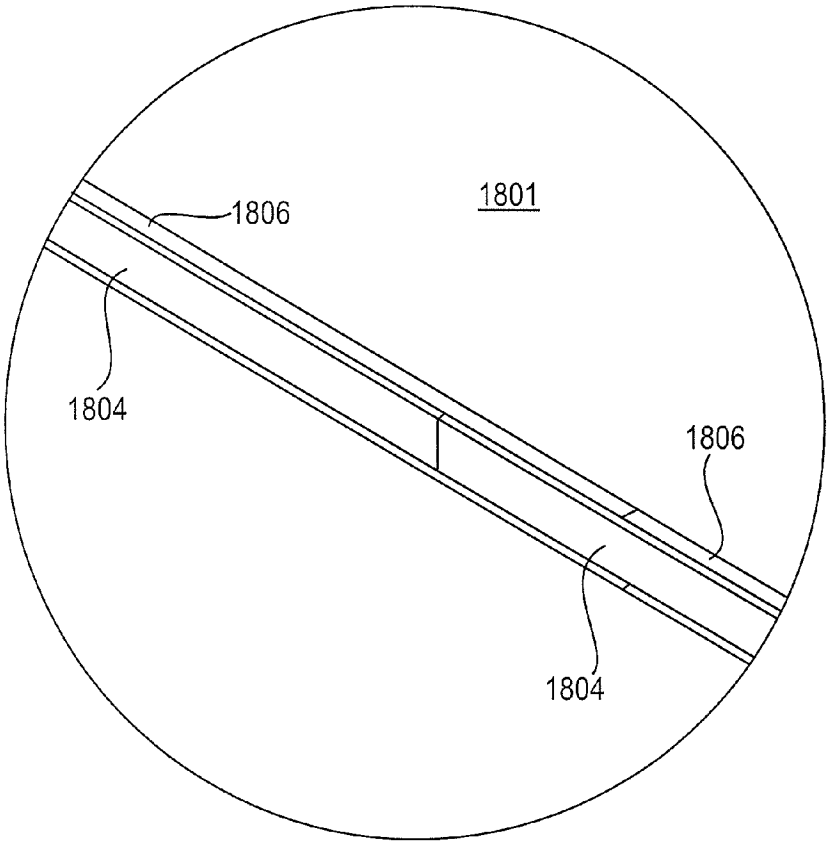
Figure 74:
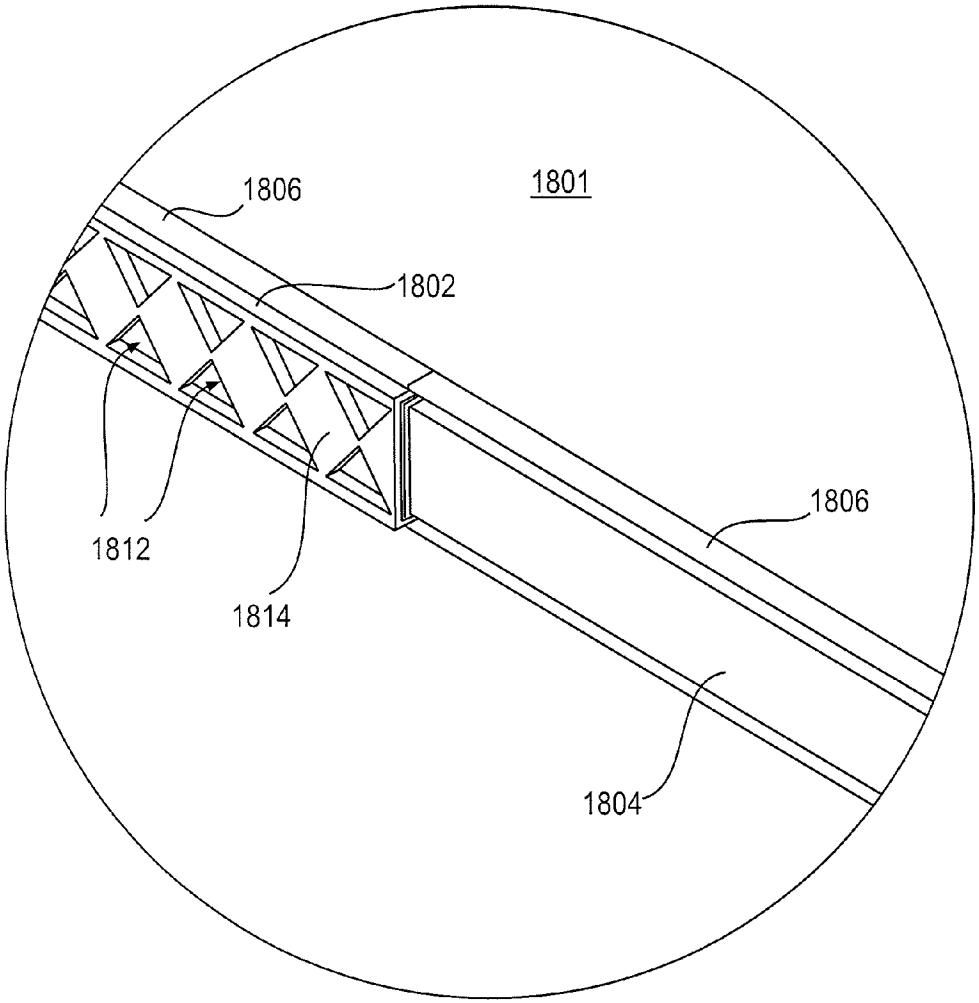
Figure 75:
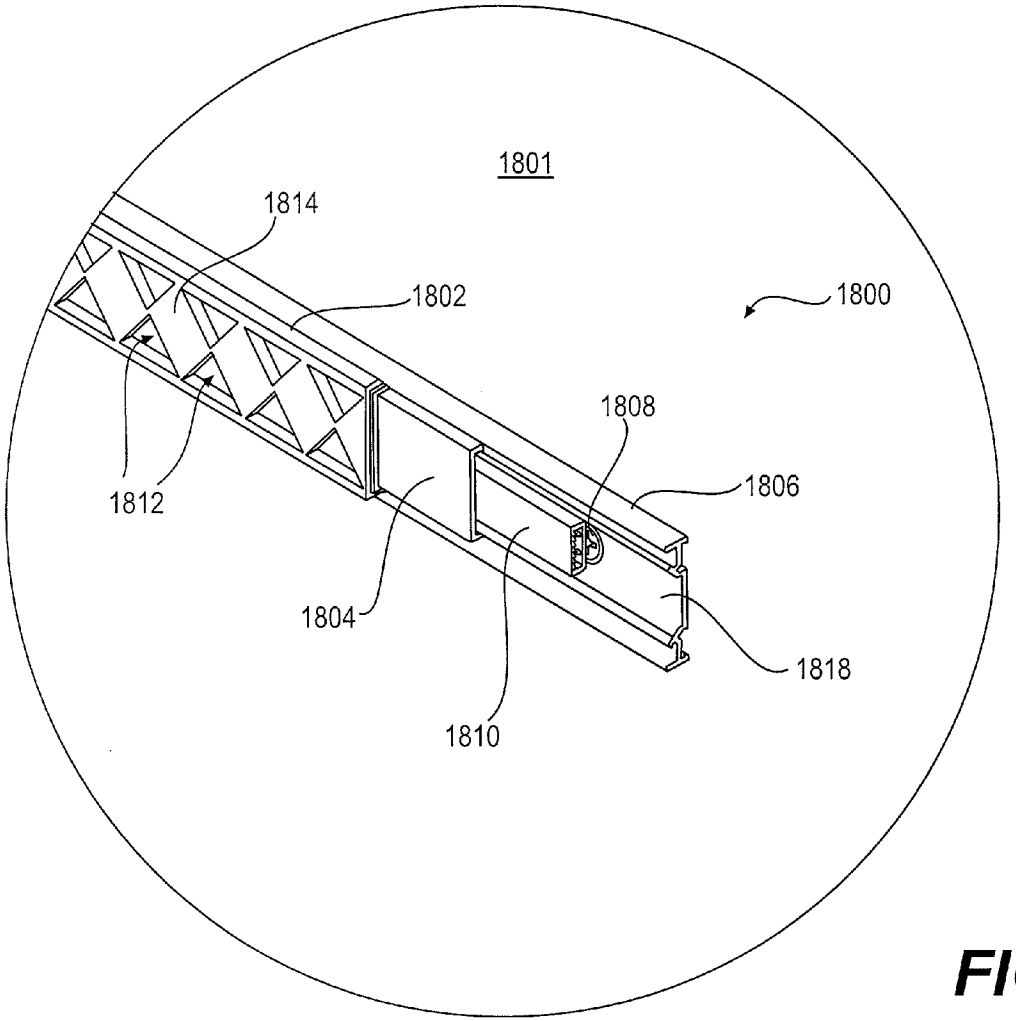

FIGS. 70-75 show the process of attaching an embodiment of a LED strip 1808, cover 1804, and decorative element 1802 similar to the embodiment of FIG. 2 to adjacent base tracks 1806. FIG. 70 illustrates a pair of adjacent base tracks 1806 fastened to a wall 1801 with a length of a LED strip 1808 and jacket 1810 installed in a LED seat 1818 of the base track 1806. FIG. 71 shows a cover 1804 attached to the base track 1806 covering the LED string 1808 and jacket 1810. FIG. 72 shows another cover 1804 attached to one of the lengths of base track 1806 positioned over the jacket 1810. FIG. 73 shows two adjacent covers 1804 installed on two adjacent lengths of base track 1806. FIG. 74 shows a decorative element 1802 installed over the cover 1804 having windows 1812 and opaque areas 1814. The windows 1812 can either be holes in the decorative element 1802, or can be transparent or translucent sections within the decorative element. In some embodiments, the windowed areas 1812 can be disposed such that the windowed areas are located where there is no LED bulb directly disposed behind the windowed area. FIG. 75 shows a partially constructed embodiment of a LED decorative illuminated trim systems 1800 with a base track 1806 having a LED seat 1818 and a LED strip 1808 within a jacket 1810 positioned in the LED seat. FIG. 75 also includes a cover 1804 that fits into the base track 1806 and over the jacket 1810 with a decorative element 1802 fitting over the cover. The decorative element 1802 includes windowed areas 1812 and opaque areas 1814.

Figure 76:
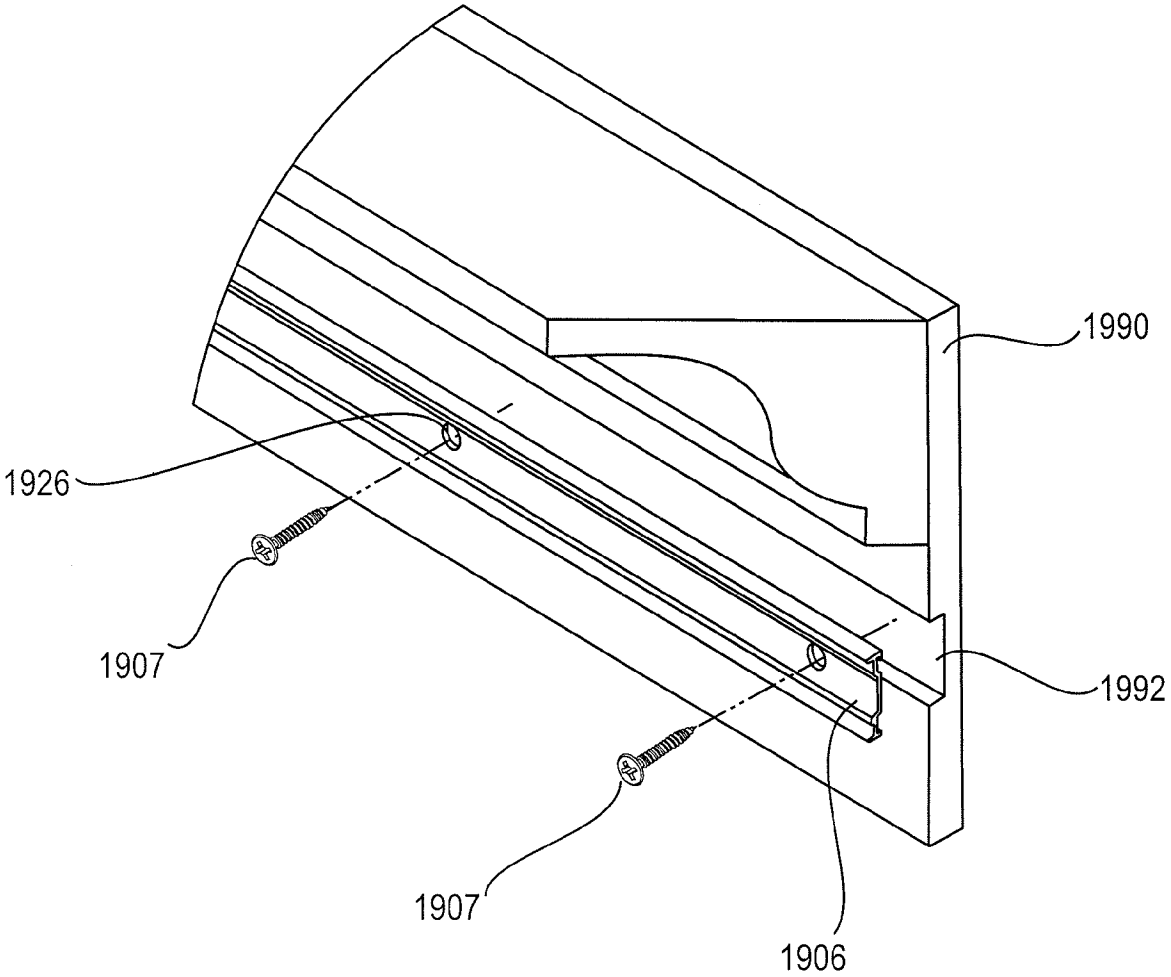
FIGS. 76-79 show another embodiment of a process for combining and installing components of a decorative LED illuminated trim system.
Figure 77:
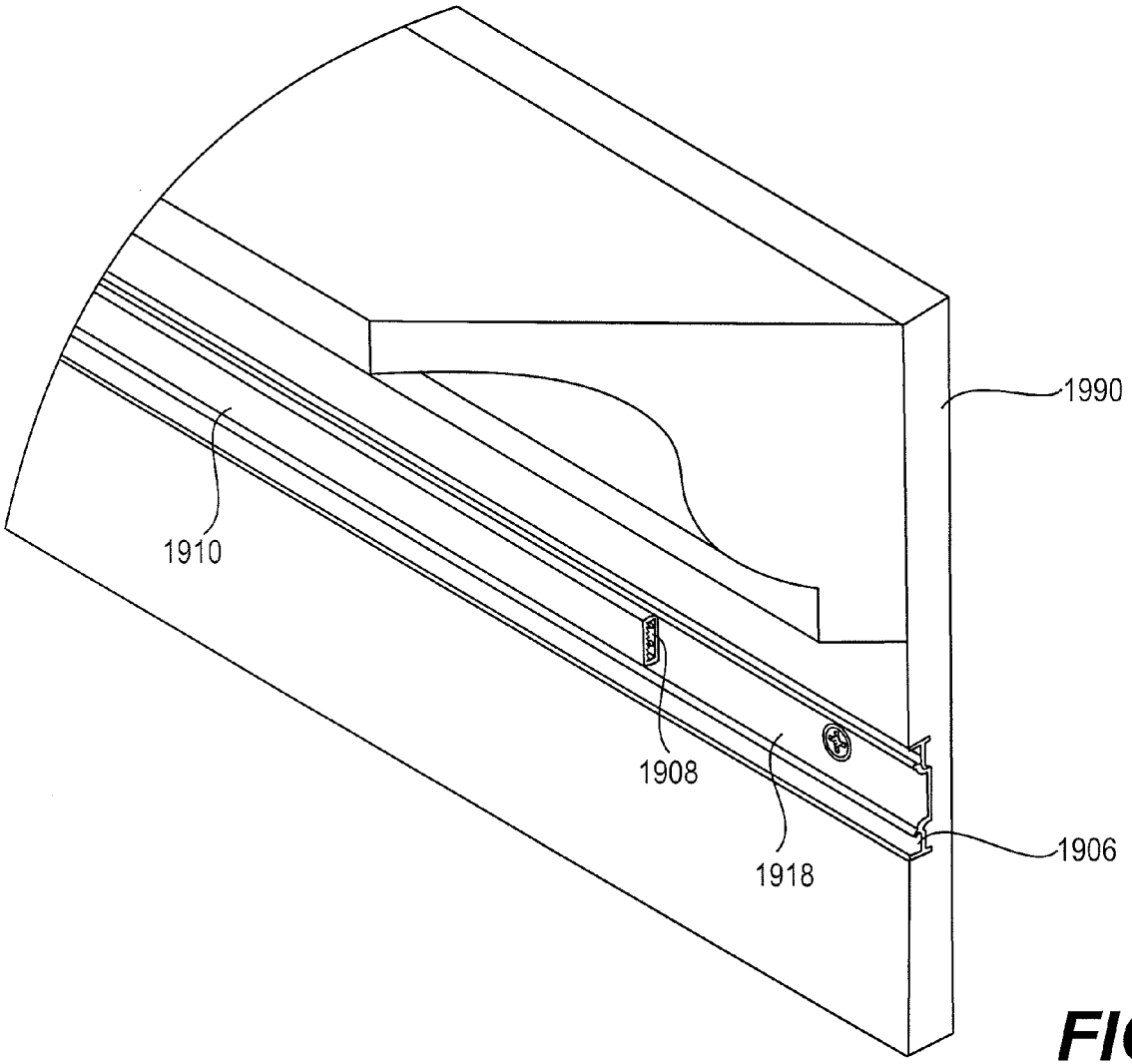
Figure 78:
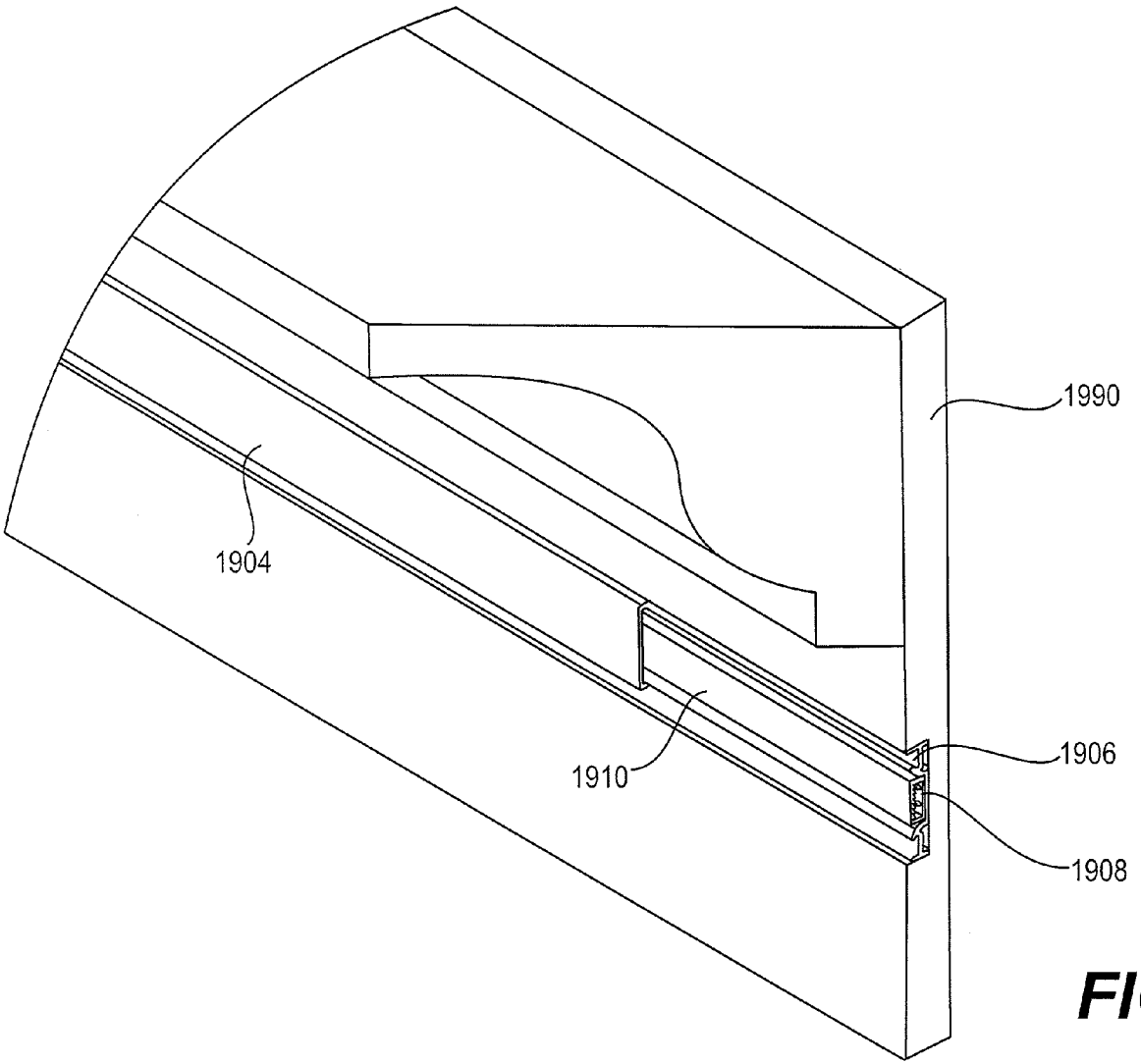
Figure 79:
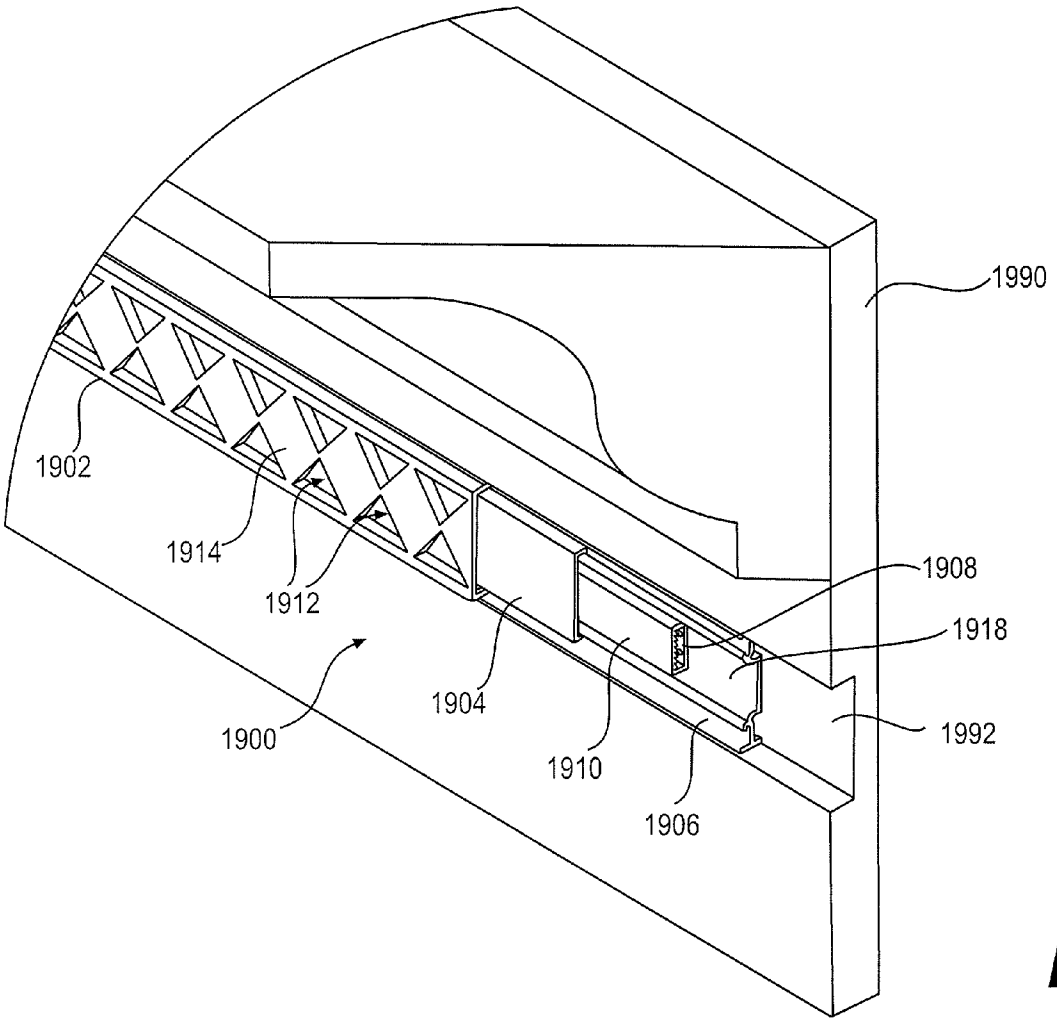

FIGS. 76-79 show the process of attaching an embodiment of a LED strip 1908, cover 1904, and decorative element 1902 similar to the embodiment of FIG. 2 to adjacent base tracks 1906 mounted on an alternative support structure 1990 such as a mantle or molding. It will be appreciated that the base tracks 1906 can be disposed in a recessed groove 1992. In such a process, as shown in FIG. 76, a length of base track 1906 can be fastened to a support structure 1990 in a recessed groove 1992 by fitting fasteners 1907 through countersunk holes 1926 in the base track and into the support structure. FIG. 77 shows the length of base track 1906 installed into the recessed groove 1992 of the support structure 1990 with a LED strip 1908 within a jacket 1910 positioned in an LED seat 1918 of the base track. FIG. 78 shows a cover 1904 fitting into the base track 1906 over the jacket 1910 and the LED strip 1908. FIG. 79 illustrates a partially constructed LED decorative illuminated trim system 1900 installed into the support structure 1990 with a decorative element 1902 installed over the cover 1904 and fitting into the base track 1906. FIGS. 76-79 also illustrate examples of how the decorative illuminated trip system disclosed herein can be incorporated into architectural building aspects of structures such as moldings for walls, ceilings, stair rails, etc.

The LED decorative illuminated trim system can use any suitable power supply system. The LED bulbs can be controlled on and off using a standard light switch, dimmer switch, and/or utilizing a remote system such as a suitable wireless technology. In certain embodiments, the LED bulbs that provide light can be turned on, off, and/or dimmed wirelessly using a suitable remote. If a wireless system is used, then an application can be installed on a suitable device, such as a smart phone, which allows the system to be controlled using a virtual interactive slide dimmer and/or a virtual on and off switch. One suitable technology for use with the system is SecuRemote, but it will be appreciated that the lights can be controlled in any suitable way using any suitable device or structure.

It will be appreciated that any suitable light source can be used. In addition, it will be appreciated that the LED decorative illuminated trim system can be used for any suitable application such as on a wall, ceiling, floor, handrail, cabinet, molding, mantle, staircase, etc. The decorative element, cover, jacket, and base track can be made of any suitable material.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A decorative illuminated trim system comprising:

at least one elongate base track mountable to a support surface, the at least one base track comprising:
a recessed light emitting diode (LED) seat; and
two substantially parallel attachment grooves;

at least one cover having two rails, the cover being at least partially translucent and disposed adjacent the base track such that the rails engage with the attachment grooves; and at least one LED string disposed between the cover and the LED seat, the LED string including at least one LED bulb capable of receiving electric current from an electricity source and emitting light;

wherein at least one decorative element is disposed over the cover, the at least one decorative element including at least one window that allows at least some light emitted by the at least one LED string to pass through portions of the cover and at least one opaque area that does not allow light emitted by the at least one LED string to pass through other portions of the cover.

2. The decorative illuminated trim system of claim 1, wherein the at least one decorative element further comprises two substantially parallel protrusions adapted to engage the attachment grooves adjacent the rails.

3. The decorative illuminated trim system of claim 1 further comprising at least one jacket substantially surrounding the LED string, the at least one jacket being at least partially translucent and allowing at least some light emitted by the LED string to pass through the at least one jacket.

4. The decorative illuminated trim system of claim 1, wherein the support surface is an architectural building aspect.

5. The decorative illuminated trim system of claim 1 wherein the at least one LED string further comprises conductive material adapted to establish an electronic connection between adjacent LED strings, the conductive material in electronic connection with the at least one LED bulb.

6. The decorative illuminated trim system of claim 5, further comprising at least one wire adapted to engage the conductive material on two adjacent LED strings such that electricity can pass from one LED string to another through the at least one wire.

7. The decorative illuminated trim system of claim 6, further comprising at least one connector board defining a plurality of holes, the at least one connector board adapted to:

bridge a junction between two adjacent LED strings; and receive the at least one wire through the plurality of holes.

8. A method of assembling a decorative illuminated trim system, the method comprising:

providing at least one elongate base track mountable to a support surface, the at least one base track comprising:
a recessed light emitting diode (LED) seat; and
two substantially parallel attachment grooves;

providing at least one cover, the cover having two rails and being at least partially translucent;

installing the cover over the base track such that the rails engage with the attachment grooves; and installing at least one LED string between the cover and the LED seat, wherein the LED string includes at least one LED bulb capable of receiving electric current from an electricity source and emitting light;

installing at least one decorative element over the cover, the at least one decorative element including at least one window that allows at least some light emitted by the at least one LED string to pass through portions of the cover, and at least one opaque area that does not allow light emitted by the at least one LED string to pass through other portions of the cover.

9. The method of assembling a decorative illuminated trim system of claim 8, wherein the at least one decorative element further comprises two substantially parallel protrusions adapted to engage the attachment grooves adjacent the rails.

10. The method of assembling a decorative illuminated trim system of claim 8, the method further comprising substantially surrounding the at least one LED string with at least one jacket, the at least one jacket being at least partially translucent and allowing at least some light emitted by the LED string to pass through the at least one jacket.

11. The method of assembling a decorative illuminated trim system of claim 10, wherein the at least one jacket further comprises a plurality of ridges adapted to disperse light emitted from the LED string.

12. The method of assembling a decorative illuminated trim system of claim 8, wherein the at least one LED string further comprises conductive material adapted to establish an electronic connection between adjacent LED strings, the conductive material in electronic connection with the at least one LED bulb.

13. The method of assembling a decorative illuminated trim system of claim 12, the method further comprising engaging at least one wire with the conductive material of two adjacent LED strings such that electricity can pass from one LED string to another through the at least one wire.

14. The method of assembling a decorative illuminated trim system of claim 13, the method further comprising:

providing a connector board defining a plurality of holes; and installing the connector board at a junction between two adjacent LED strings such that the connector board is adapted to receive the at least one wire through the plurality of holes.

15. A decorative illuminated trim system comprising:

at least one elongate base track mountable to a support surface, the at least one base track comprising:

a recessed light emitting diode (LED) seat; and two substantially parallel attachment grooves;

at least one cover having two rails, the cover being at least partially translucent and disposed adjacent the base track such that the rails engage with the attachment grooves; and at least one LED string disposed between the cover and the LED seat, the LED string including at least one LED bulb capable of receiving electric current from an electricity source and emitting light, and wherein at least some light emitted by the at least one LED string passes through the at least one cover;

a decorative element disposed over the cover, the decorative element comprising:

at least one window that allows at least some light emitted by the at least one LED string to pass through; and at least one opaque area that does not allow light emitted by the at least one LED string to pass through; and at least one jacket substantially surrounding the LED string, the jacket being at least partially translucent and allowing at least some light emitted by the LED string to pass through the jacket.

16. The decorative illuminated trim system of claim 15, further comprising:

conductive material in the at least one LED string, the conductive material adapted to engage to establish an electronic connection between adjacent LED strings, wherein the conductive material is in electronic connection with the at least one LED bulb;

at least one wire adapted to engage the conductive material on two adjacent LED strings such that electricity can pass from one LED string to another through the at least one wire; and a connector board defining a plurality of holes, the connector board adapted to:

bridge a junction between two adjacent LED strings; and receive the at least one wire through the plurality of holes.

* * * * *